US011680453B2

(12) United States Patent
Khorshidian et al.

(10) Patent No.: US 11,680,453 B2
(45) Date of Patent: Jun. 20, 2023

(54) MANAGED PRESSURE DRILLING MANIFOLD AND METHODS

(71) Applicant: Opla Energy Ltd., Calgary (CA)

(72) Inventors: Hossein Khorshidian, Calgary (CA); Vitaliy Shpak, Calgary (CA); Elvin Mammadov, Calgary (CA)

(73) Assignee: Opla Energy Ltd., Calgary (CA)

( * ) Notice: Subject to any disclaimer, the term of this patent is extended or adjusted under 35 U.S.C. 154(b) by 68 days.

(21) Appl. No.: 17/115,622

(22) Filed: Dec. 8, 2020

(65) Prior Publication Data

US 2021/0172284 A1 Jun. 10, 2021

Related U.S. Application Data

(60) Provisional application No. 62/945,783, filed on Dec. 9, 2019.

(51) Int. Cl.

| | |
|---|---|
| ***E21B 21/08*** | (2006.01) |
| ***E21B 21/10*** | (2006.01) |
| ***E21B 34/02*** | (2006.01) |
| ***E21B 44/06*** | (2006.01) |

(52) U.S. Cl.

CPC ..... *E21B 21/08* (2013.01); *E21B 21/106* (2013.01); *E21B 34/025* (2020.05); *E21B 44/06* (2013.01)

(58) Field of Classification Search

CPC ..... E21B 34/02; E21B 34/04; E21B 34/045; E21B 33/03; E21B 33/0355; E21B 29/08; E21B 29/10; E21B 29/106; F16K 27/003; F16K 11/02; F16K 11/06; F16K 11/0716; Y10T 137/86558

See application file for complete search history.

(56) References Cited

U.S. PATENT DOCUMENTS 2,094,812 A * 10/1937 Penick et al. ..... E21B 33/04 166/88.4
2,730,910 A * 1/1956 Province ..... E21B 19/008 74/471 XY (Continued)

FOREIGN PATENT DOCUMENTS

CA 3101895 A1 * 2/2021 ..... E21B 34/08
GB 2591309 A * 7/2021 ..... E21B 21/08
WO WO-2018183861 A1 * 10/2018 ..... E21B 21/08

*Primary Examiner* — Jennifer H Gay

(74) *Attorney, Agent, or Firm* — Christopher N. Hunter; Laurie Wright; Blake, Cassels & Graydon LLP

(57) ABSTRACT

A managed pressure drilling (MPD) manifold has one or more valves that are operable by one or more actuators configured to synchronize the opening of one or more passageways in the valves with the closing of one or more of the other passageways in the valves, in order to minimize the likelihood of error and reduce response time. The valves are configured to transition smoothly between positions without fully blocking fluid flow in the manifold while changing the flow direction. The synchronization may be achieved mechanically, electrically, hydraulic, and/or pneumatically. The actuators may be remotely controlled by a control unit having a processor and control logic software, based on data collected by one or more sensors in the MPD manifold. The positions of the valves of the MPD manifold may be automatically adjusted by the control unit via the actuators.

16 Claims, 51 Drawing Sheets

(56) References Cited

U.S. PATENT DOCUMENTS

| | | | | | |
|---|---|---|---|---|---|
| 2,858,851 | A * | 11/1958 | Holl | F16K 27/04 | 251/117 |
| 3,310,284 | A * | 3/1967 | Seiuemon | F15B 9/14 | 91/375 R |
| 3,422,329 | A * | 1/1969 | Anderson | E21B 34/04 | 307/64 |
| 3,494,377 | A * | 2/1970 | Thuse | E21B 34/02 | 251/329 |
| 4,874,008 | A * | 10/1989 | Lawson | E21B 43/017 | 137/454.2 |
| 4,934,652 | A | 6/1990 | Golden | | |
| 9,963,956 | B2 * | 5/2018 | Vilstrup | E21B 43/12 | |
| 10,184,310 | B2 * | 1/2019 | McHugh | E21B 49/08 | |
| 10,253,585 | B2 * | 4/2019 | Hickie | E21B 21/106 | |
| 10,323,490 | B2 * | 6/2019 | Vilstrup | E21B 47/10 | |
| 10,738,552 | B1 * | 8/2020 | Parker | E21B 21/106 | |
| 10,968,710 | B1 * | 4/2021 | Parker | G05D 7/0664 | |
| 11,193,349 | B1 * | 12/2021 | Dille | E21B 33/072 | |
| 11,226,642 | B2 * | 1/2022 | Cook | G05D 7/0664 | |
| 2008/0060846 | A1 * | 3/2008 | Belcher | E21B 19/16 | 175/25 |
| 2016/0222743 | A1 | 8/2016 | Gosney | | |
| 2017/0010139 | A1 * | 1/2017 | Vilstrup | E21B 47/10 | |
| 2017/0328153 | A1 * | 11/2017 | Watters | F16K 31/54 | |
| 2017/0342792 | A1 * | 11/2017 | McHugh | G01F 1/74 | |
| 2018/0252080 | A1 * | 9/2018 | Vilstrup | E21B 43/12 | |
| 2018/0283113 | A1 * | 10/2018 | Hickie | E21B 34/16 | |
| 2018/0284816 | A1 * | 10/2018 | Cook | B62D 21/20 | |
| 2019/0218872 | A1 * | 7/2019 | Hickie | E21B 33/0355 | |
| 2020/0318746 | A1 * | 10/2020 | Parthasarathy | F16K 3/34 | |
| 2020/0399980 | A1 * | 12/2020 | Spencer | E21B 34/04 | |
| 2021/0172284 | A1 * | 6/2021 | Khorshidian | E21B 34/025 | |
| 2021/0301638 | A1 * | 9/2021 | Boyd | E21B 43/2607 | |
| 2022/0025722 | A1 * | 1/2022 | Lymberopoulos | E21B 34/08 | |

* cited by examiner 920
922
924b
926
928
936a
936b
938a
938b
940a
940b
942a
942b
944
946
948a
948b
950
952
954
956
958
960a
960b
962a
962b
964a
964b
966a
966b
968a
968b
970a
970b
972a
972b
974a
974b
976a
976b
978a
978b
980
982
984
986
988
990
992
994
996
998
1000
1002
1004
1006
1008
1010
1012
1014
1016
1018
1020
1022
1024
1026
1028
1030
1032
1034
1036
1038
1040
1042
1044
1046
1048
1050
1052
1054
1056
1058

MANAGED PRESSURE DRILLING MANIFOLD AND METHODS

CROSS-REFERENCE TO RELATED APPLICATIONS

This application claims the benefit of U.S. Provisional Application No. 62/945,783, filed on Dec. 9, 2019, the content of which is hereby incorporated by reference in its entirety.

FIELD

The present disclosure relates generally to oil and gas exploration and production operations and, more particularly, to managed pressure drilling ("MPD") manifolds for use in oil and gas drilling operations, and to related modules and methods.

BACKGROUND

An MPD system may include one or more drilling chokes and one or more flowmeters, with the drilling chokes and the flowmeter being separate and distinct from one another. The drilling chokes are in fluid communication with a wellbore that traverses a subterranean formation. As a result, the MPD system may be used to control backpressure in the wellbore as part of an adaptive drilling process that allows greater control of the annular pressure profile throughout the wellbore. During such a process, the flowmeter may be used to measure the flow rate of drilling mud received from the wellbore.

In some situations, it is desirable to have the fluid flow in the MPD system bypass one or more portions of the system in order to maintain appropriate backpressure in the wellbore. For example, in case of choke failure and/or blockage, the fluid flow in the MPD system can be rerouted to bypass one or more of the drilling chokes in order to prevent a spike in pressure in the wellbore, as a sudden increase in pressure above a certain level could lead to unwanted fractures in the formation and/or compromise the integrity of surface equipment (e.g. the flowmeter) and cause leakage of wellbore fluids to the atmosphere. In another example, it is necessary for the fluid in the MPD system to bypass the flowmeter during maintenance and servicing of the flowmeter or when there is blockage in the flowmeter.

Conventional MPD manifolds require human operators to manually open and close valves in order to bypass certain portions of the MPD system, even if the pressures of the MPD system are digitally monitored by a computer. As such, conventional MPD manifolds are error prone as the maintenance of appropriate pressure in the wellbore relies on human operators to open and close valves in the proper sequence. Failure to open and close the valves in the proper sequence can, in some cases, lead to a pressure spike in the wellbore causing unwanted fractures therein, which may cause fluid loss. Further, such unwanted fractures may lead to damage of surface equipment and may eventually cause a blowout of the well and leakage of wellbore fluids into the atmosphere. Another disadvantage of conventional MPD manifolds is that the response time to a failure event can be slow as it takes time for the human operator to travel to the manifold and to execute the valve opening/closing sequence.

Some drilling systems have a relief valve, usually upstream of the MPD manifold, for rerouting fluid to bypass the MPD manifold if there is a failure and/or blockage in the manifold causing an increase in fluid pressure in the system.

The relief valve is configured to actuate when the fluid pressure in the system exceeds a predetermined threshold in order to prevent the fluid pressure from increasing any further. The predetermined threshold of the relief valve is often fixed and, in some cases, the relief valve may be actuated when the system pressure is already higher than the limit within which the well pressure profile is safe.

Therefore, a need exists for an improved MPD manifold.

SUMMARY

According to a broad aspect of the present disclosure, there is provided an MPD manifold comprising one or more valves that are operated by one or more actuators configured to synchronize the opening of one or more passageways in the valves with the closing of one or more of the other passageways in the valves, in order to minimize the likelihood of error and reduce response time in case of a failure event. The valves are configured to transition smoothly between positions without fully blocking fluid flow in the manifold during the transition. The synchronization may be achieved mechanically, electrically, hydraulic, pneumatically, or a combination thereof. The one or more actuators may be controlled by a control unit having a processor and control logic software executable by the processor, based on data collected by one or more sensors in the MPD manifold. The positions of the one or more valves of the MPD manifold may be automatically adjusted by the control unit via the one or more actuators.

According to a broad aspect of the present disclosure, there is provided a manifold for use in a managed pressured drilling operation, the manifold comprising: one or more housings; a first passageway and a second passageway defined in the one or more housings; a first valve assembly comprising: a first valve control mechanism in communication with the first and second passageways, the first valve control mechanism movable to synchronously open and/or close the first and second passageways; and a first actuator operably coupled to the first valve control mechanism for actuating the first valve control mechanism to transition the first valve assembly between a first position and a second position, wherein one of: (i) in the first position, the first passageway is open and the second passageway is closed; and in the second position, the first passageway is closed and the second passageway is open; and (ii) in the first position, the first and second passageways are open; and in the second position, the first and second passageways are closed.

In some embodiments, the manifold comprises: a third passageway defined in the one or more housings, wherein the first valve control mechanism is in communication with the third passageway, the first valve control mechanism movable to synchronously open and/or close the first, second, and third passageways; the first actuator is operable to actuate the first valve control mechanism to transition the first valve assembly between the first position, the second position, and a third position; and one of: (i) in the first position, the first passageway is open, and the second and third passageways are closed; in the second position, the first and third passageways are closed, and the second passageway is open; and in the third position, the first and second passageways are closed, and the third passageways is open; (ii) in the first position, the first and third passageways are open, and the second passageway is closed; in the second position, the first passageway is closed, and the second and third passageways are open; and in the third position, the first and second passageways are open, and the third passageway is closed; and (iii) in the first position, the first and third passageways are open, and the second passageway is closed; in the second position, the first and third passageways are closed, and the second passageway is open; and the third position is the same as the second position.

In some embodiments, actuating the first valve control mechanism comprises moving the first valve control mechanism axially and/or rotationally.

In some embodiments, the first valve control mechanism comprises a gate valve.

In some embodiments, the first, second, and third passageways are defined in one of the one or more housings.

In some embodiments, the manifold comprises: a fourth passageway and a fifth passageway defined in the one or more housings; and a second valve assembly comprising: a second valve control mechanism in communication with the fourth and fifth passageways, the second valve control mechanism movable to synchronously open and/or close the fourth and fifth passageways; and a second actuator operably coupled to the second valve control mechanism for actuating the second valve control mechanism to transition the second valve assembly between a fourth position and a fifth position, wherein one of: (i) in the fourth position, the fourth passageway is open and the fifth passageway is closed; and in the fifth position, the fourth passageway is closed and the fifth passageway is open; and (ii) in the fourth position, the fourth and fifth passageways are open; and in the fifth position, the fourth and fifth passageways are closed.

In some embodiments, the second actuator is one and the same as the first actuator.

In some embodiments, the first valve control mechanism is hydraulically synchronized with the second valve control mechanism such that when the first valve assembly is in the first and second positions, the second valve assembly is in the fourth and fifth positions, respectively.

In some embodiments, the first actuator and the second actuator are configured to simultaneously actuate the first and second valve control mechanisms, respectively, and the first and second actuators are synchronized mechanically, electrically, hydraulically, pneumatically, or a combination thereof, such that: when the first and second passageways are open, the fourth and fifth passageways are closed; and when the first and second passageways are closed, the fourth and fifth passageways are open.

In some embodiments, the manifold comprises a sixth passageway defined in the one or more housings; and a third valve assembly comprising: a third valve control mechanism in communication with the sixth passageway, the third valve control mechanism movable to open and close the sixth passageway; and a third actuator operably coupled to the third valve control mechanism for actuating the third valve control mechanism to transition the third valve assembly between a sixth position and a seventh position, wherein in the sixth position, the sixth passageway is open; and in the seventh position, the sixth passageway is closed.

In some embodiments, the third actuator is one and the same as the first actuator.

In some embodiments, the first actuator and the third actuator are configured to simultaneously actuate the first and third valve control mechanisms, respectively, and the first and third actuators are synchronized mechanically, electrically, hydraulically, pneumatically, or a combination thereof, such that: when the first and second passageways are open, the sixth passageway is closed; and when the first and second passageways are closed, the sixth passageway is open.

In some embodiments, the manifold comprises: an inlet; and a drilling choke, wherein the first and second passageways are in communication with the inlet; and one of the first and second passageways is in communication with the drilling choke.

In some embodiments, the manifold comprises: an inlet; and a drilling choke, wherein the first passageway is in communication with the inlet; and the first and second passageways are in communication with the drilling choke.

In some embodiments, the sixth passageway is in communication with the inlet.

In some embodiments, the manifold comprises: an outlet; and a flowmeter, wherein the first passageway is in communication with the flowmeter; and the first and second passageways are in communication with the outlet.

In some embodiments, the manifold comprises: an outlet; and a flowmeter, wherein the first and second passageways are in communication with the flowmeter; and the second passageway is in communication with the outlet.

In some embodiments, the sixth passageway is in communication with the outlet.

In some embodiments, the first actuator is remotely controlled.

In some embodiments, the first actuator is a hydraulic actuator, an electrical actuator, a pneumatic actuator, or a combination thereof.

According to another broad aspect of the present disclosure, there is provided a method of operating a managed pressure drilling manifold having a first choke, a second choke, and a flowmeter, the method comprising: receiving well upstream data, well downstream data, and well data; receiving flowmeter pressure data and choke pressure data; determining a status of the first choke, a status of the second choke, a status of the flowmeter, based at least in part on the well upstream data, well downstream data, well data, flowmeter pressure data, and/or choke pressure data; remotely activating, based on the determination, one or more actuators to: place a choke section valve assembly in a first position to allow fluid to flow through the first choke but not the second choke; place the choke section valve assembly in a second position to allow fluid to flow through the second choke but not the first choke; place the choke section valve assembly in a third position to allow fluid to bypass both the first choke and the second choke; or place the choke section valve assembly in a fourth position to allow fluid to flow through both the first choke and the second choke; and place a flowmeter section valve assembly in a first position to allow fluid to flow through the flowmeter; or place the flowmeter section valve assembly in a second position to allow fluid to bypass the flowmeter.

The details of one or more embodiments are set forth in the description below. Other features and advantages will be apparent from the specification and the claims.

BRIEF DESCRIPTION OF THE DRAWINGS

Embodiments will now be described by way of example only, with reference to the accompanying simplified, diagrammatic, not-to-scale drawings. Any dimensions provided in the drawings are provided only for illustrative purposes, and do not limit the scope as defined by the claims. In the drawings:

FIG. 7 is a second side plan view of the MPD manifold shown in FIG. 3.

FIGS. 14A and 14B may be collectively referred to herein as FIG. 14.

FIGS. 15A and 15B may be collectively referred to herein as FIG. 15.

FIGS. 16A, 16B, and 16C may be collectively referred to herein as FIG. 16.

FIGS. 20A and 20B may be collectively referred to herein as FIG. 20.

FIGS. 21A and 21B may be collectively referred to herein as FIG. 21.

FIGS. 31A and 31B may be collectively referred to herein as FIG. 31.

FIGS. 33A and 33B may be collectively referred to herein as FIG. 33.

FIG. 37 is a front plan view of the choke section shown in FIG. 35.

FIG. 42 is a perspective cross-sectional view of the choke section shown in FIG. 36, taken along line A-A.

DETAILED DESCRIPTION

All terms not defined herein will be understood to have their common art-recognized meanings. To the extent that the following description is of a specific embodiment or a particular use, it is intended to be illustrative only, and not limiting. The following description is intended to cover all alternatives, modifications and equivalents that are included in the scope, as defined in the appended claims.

DESCRIPTION OF THE FIGURES

Figure 1:
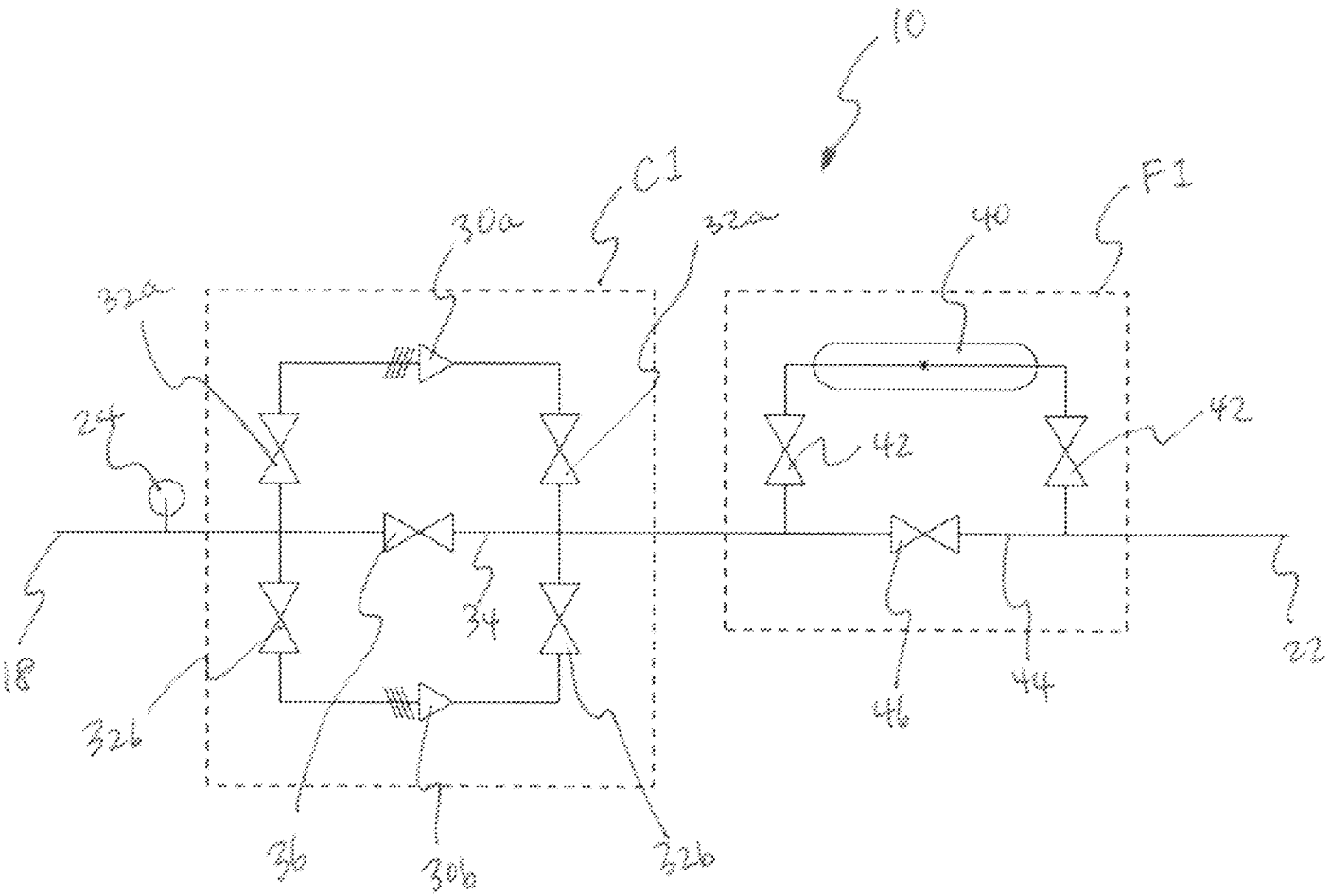
FIG. 1 PRIOR ART
FIG. 1 is a schematic view of a prior art MPD manifold, illustrating the basic components thereof.

FIG. 1 is a schematic drawing showing the basic components of a prior art MPD manifold 10. Manifold 10 comprises an inlet 18, a pressure sensor 24, an outlet 22, one or more drilling chokes 30*a*,30*b*, a choke gut line 34, a flowmeter 40, and a flowmeter gut line 44. Manifold 10 further comprises choke valves 32*a*,32*b*, flowmeter valves 42, choke gut line valve 36, and flowmeter gut line valve 46.

Typically, the one or more drilling chokes 30*a*,30*b* are for maintaining the desired backpressure of the drilling mud within the wellbore. While MPD manifolds may operate with only one choke, additional chokes are usually included for redundancy. The flowmeter 40 can be configured to measure, volumetric flow rate, mass flow rate, temperature, density, and/or concentration of the fluid flowing therethrough. For example, the flowmeter 40 may be a Coriolis flowmeter.

The chokes 30*a*,30*b* are connected in parallel with the choke gut line 34. Each choke 30*a*,30*b* is connected in series with the flowmeter 40 and flowmeter gut line 44. Each choke 30*a*,30*b* is positioned between a respective pair of choke valves 32*a*,32*b* such that fluid flow through the choke is controlled by opening and closing the respective choke valves 32*a*,32*b*. The choke gut line 34 has a choke gut line valve 36 which controls the flow of fluids through the choke gut line 34. The chokes 30*a*,30*b*, the choke gut line 34, the choke valves 32*a*,32*b*, and the choke gut line valve 36 are collectively referred to as the choke section C1 of the manifold 10.

The flowmeter 40 is positioned between a pair of flowmeter valves 42, the opening and closing of which control the flow of fluids through the flowmeter 40. The flowmeter gut line 44 has a flowmeter gut line valve 46 which controls the flow of fluids through the flowmeter gut line 44. The flowmeter 40 the flowmeter gut line 44, the flowmeter valves 42, and the flowmeter gut line valve 46 are collectively referred to as the flowmeter section F1 of the manifold 10.

In operation, the manifold 10 receives fluid from the wellbore at inlet 18 via, for example, a rotating control device. The pressure sensor 24 is situated close to the inlet 18 to measure the pressure of the incoming fluid as it passes through the pressure sensor 24. The fluid then takes one of three flow paths in the choke section C1 depending on which valves are open and which are closed.

If the pair of choke valves 32*a* associated with the first choke 30*a* are open, and choke gut line valve 36 and choke valves 32*b* are closed, the fluid flows through the first choke 30*a* and bypasses the choke gut line 34 and the second choke 30*b*.

If the pair of choke valves 32*b* associated with the second choke 30*b* are open, and the choke gut line valve 36 and choke valves 32*a* are closed, the fluid flows through the second choke 30*b* and bypasses the choke gut line 34 and the first choke 30*a*.

If the choke valves 32*a*,32*b* of both chokes 30*a*,30*b* are closed and the choke gut line valve 36 is open, the fluid flows through the choke gut line 34 and bypasses both chokes 30*a*,30*b*.

The fluid then flows out of the choke section C1 and to the flowmeter section F1 downstream. The fluid takes one of two flow paths in the flowmeter section F1. If the flowmeter gut line valve 46 is closed and the flowmeter valves 42 are open, the fluid flows through the flowmeter 40 and bypasses the flowmeter gut line 44 to exit the manifold 10 at outlet 22. If the flowmeter valves 42 are closed and the flowmeter gut line valve 46 is open, the fluid flows through the flowmeter gut line 44 and bypasses the flowmeter 40 to exit the manifold 10 at outlet 22. In some embodiments, a mud gas separator is adapted to receive the fluid from outlet 22.

As can be seen in FIG. 1, the prior art MPD manifold with two chokes requires eight separate valves that operate independently from one another and each valve needs to be opened and closed individually by a human operator, leading to slow response time. Controlling the opening and closing of eight separate valves manually can be prone to operator error. Even if the eight valves of the prior art manifold are each automated, controlling eight actuators individually may also lead to errors and/or slow response time.

Provided herein is an alternative MPD manifold that may address one or more of the above-described shortcomings of the prior art manifold. The MPD manifold described herein has one or more valves that are operable by one or more actuators configured to synchronize the opening of one or more passageways in the valves with the closing of one or more of the other passageways in the valves, in order to reduce or minimize the likelihood of error and/or reduce response time in case of a failure event. The manifold is configured to transition the valves smoothly between positions without fully blocking fluid flow in the manifold while changing the flow path. The synchronization may be achieved mechanically, electrically, hydraulically, pneumatically, or a combination thereof. The one or more actuators may be (remotely) controlled by a control unit having a processor and control logic software executable by the processor, based on data collected by one or more sensors in the MPD manifold. The positions of the one or more valves of the MPD manifold may be automatically adjusted by the control unit via the one or more actuators.

Figure 2:
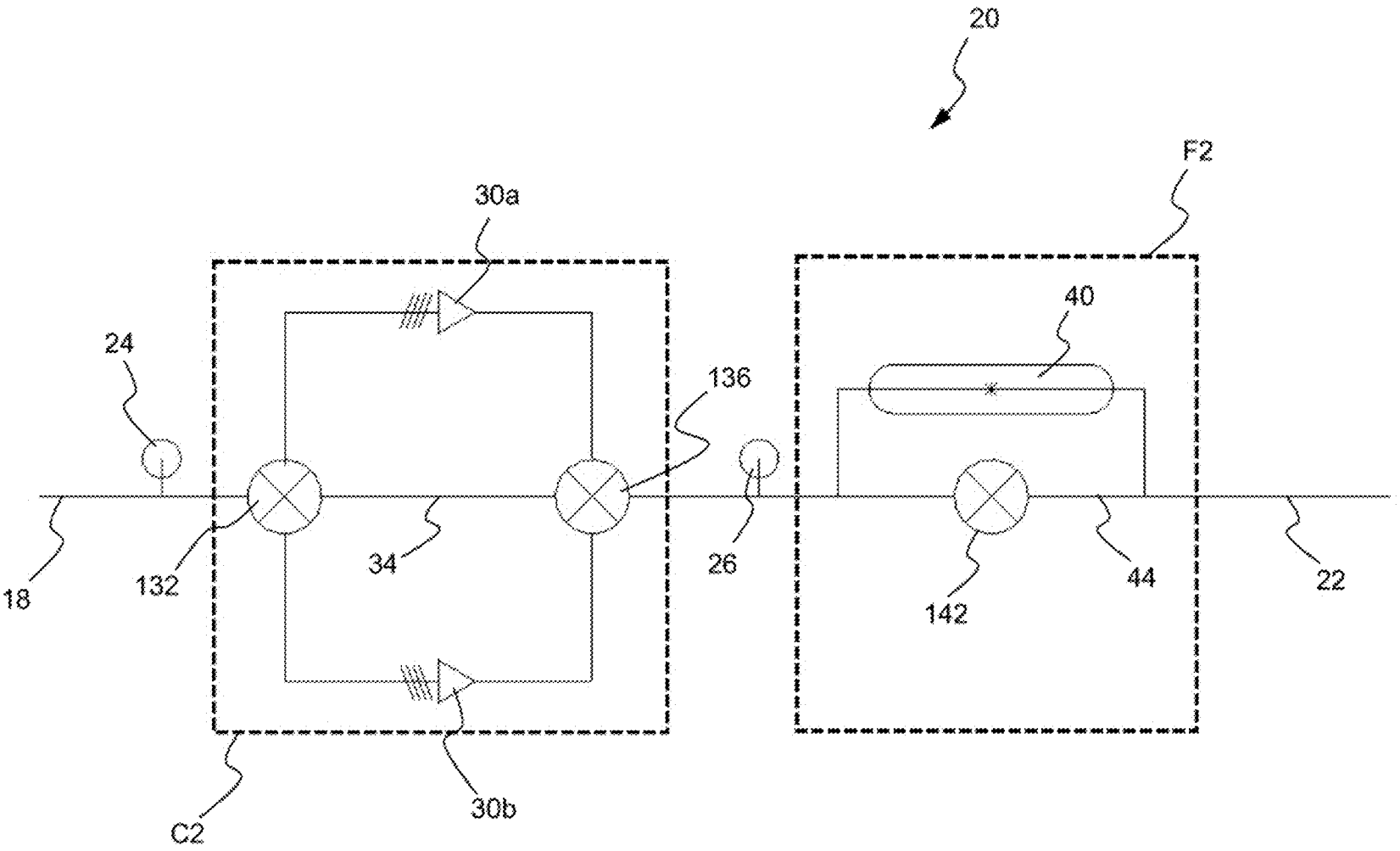
FIG. 2 is a schematic view of an MPD manifold according to one embodiment of the present disclosure.
Figure 3:
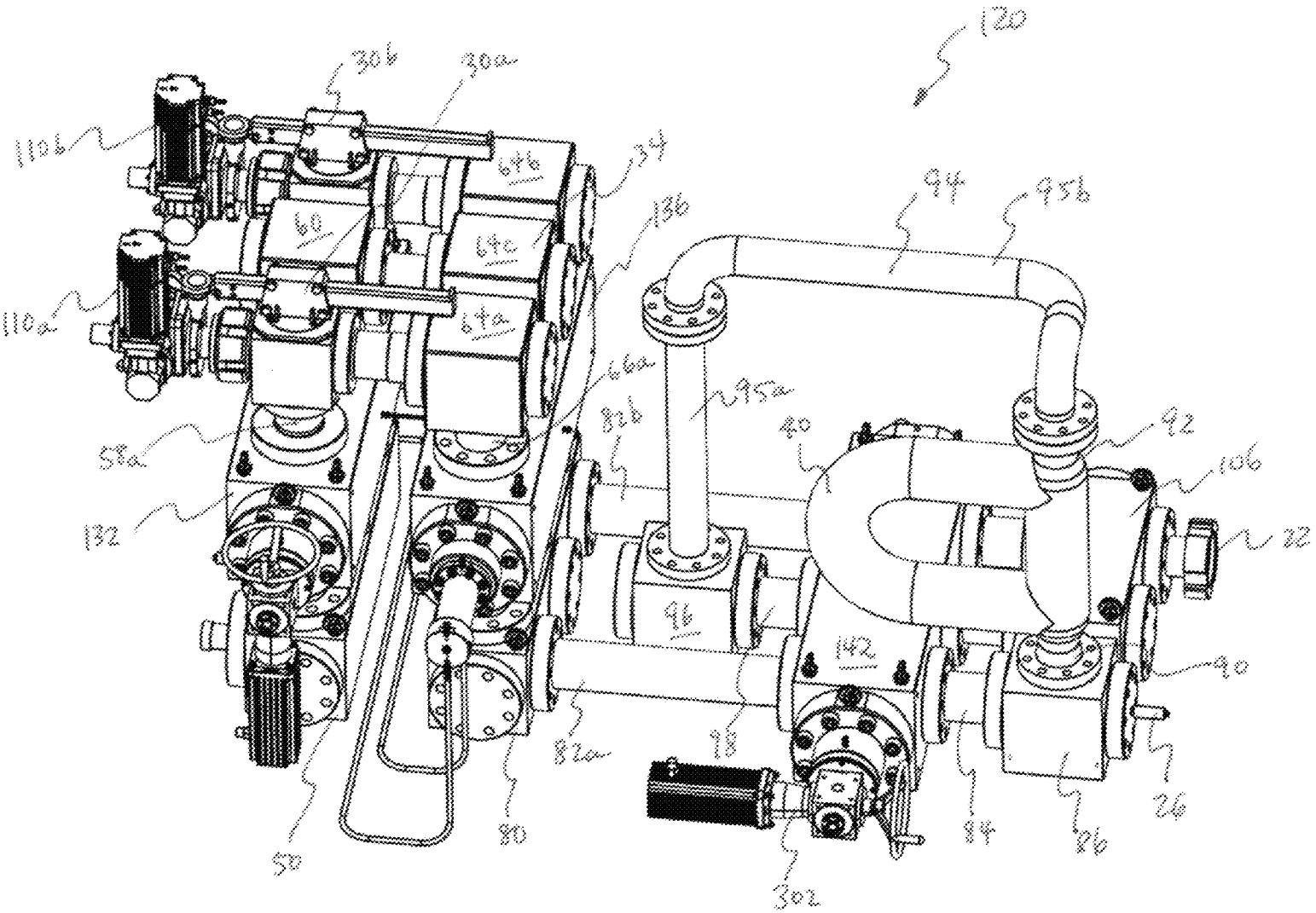
FIG. 3 is a perspective view of a sample configuration of the MPD manifold of FIG. 2 according to one embodiment of the present disclosure.
Figure 4:
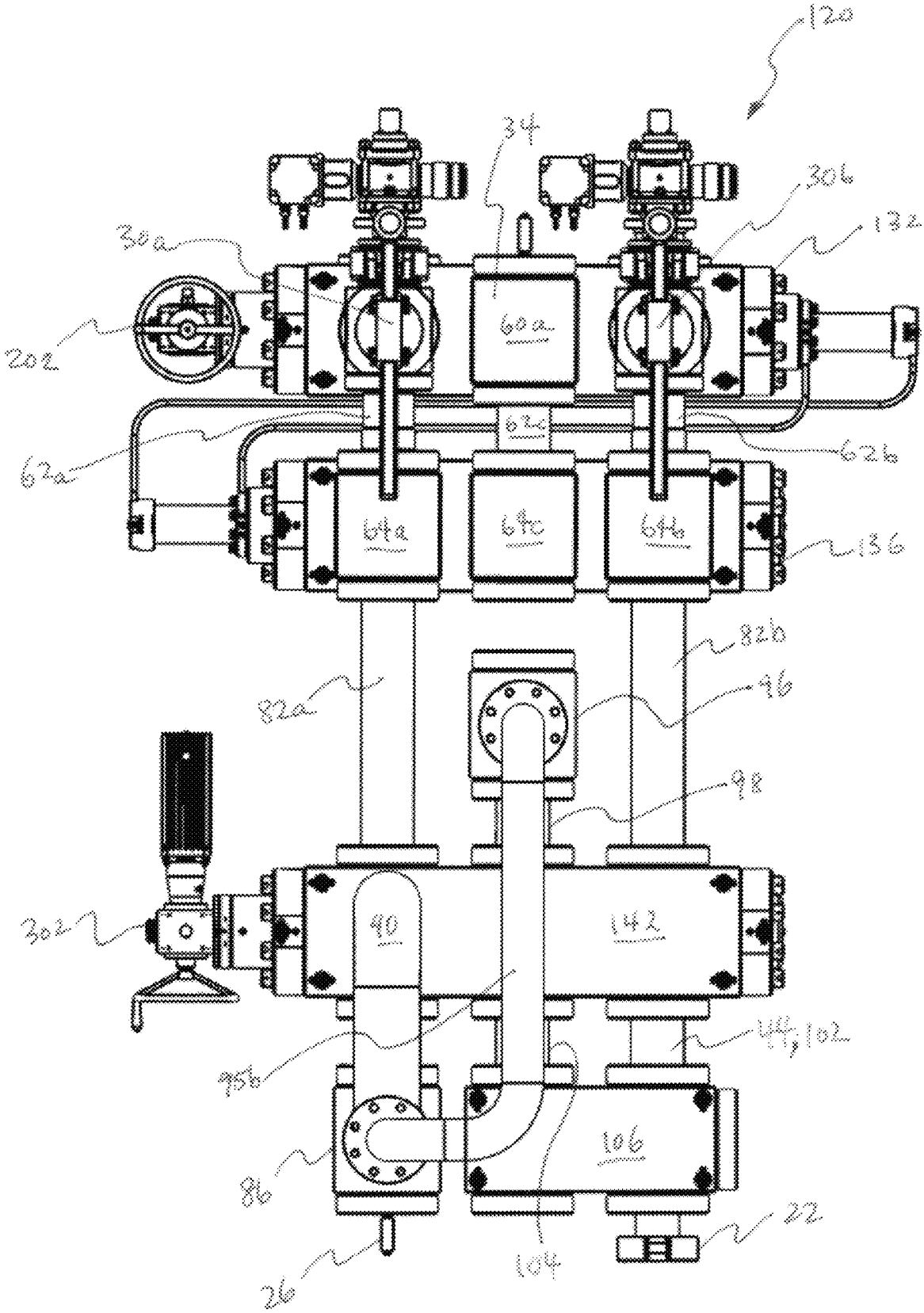
FIG. 4 is a top plan view of the MPD manifold shown in FIG. 3.
Figure 5:
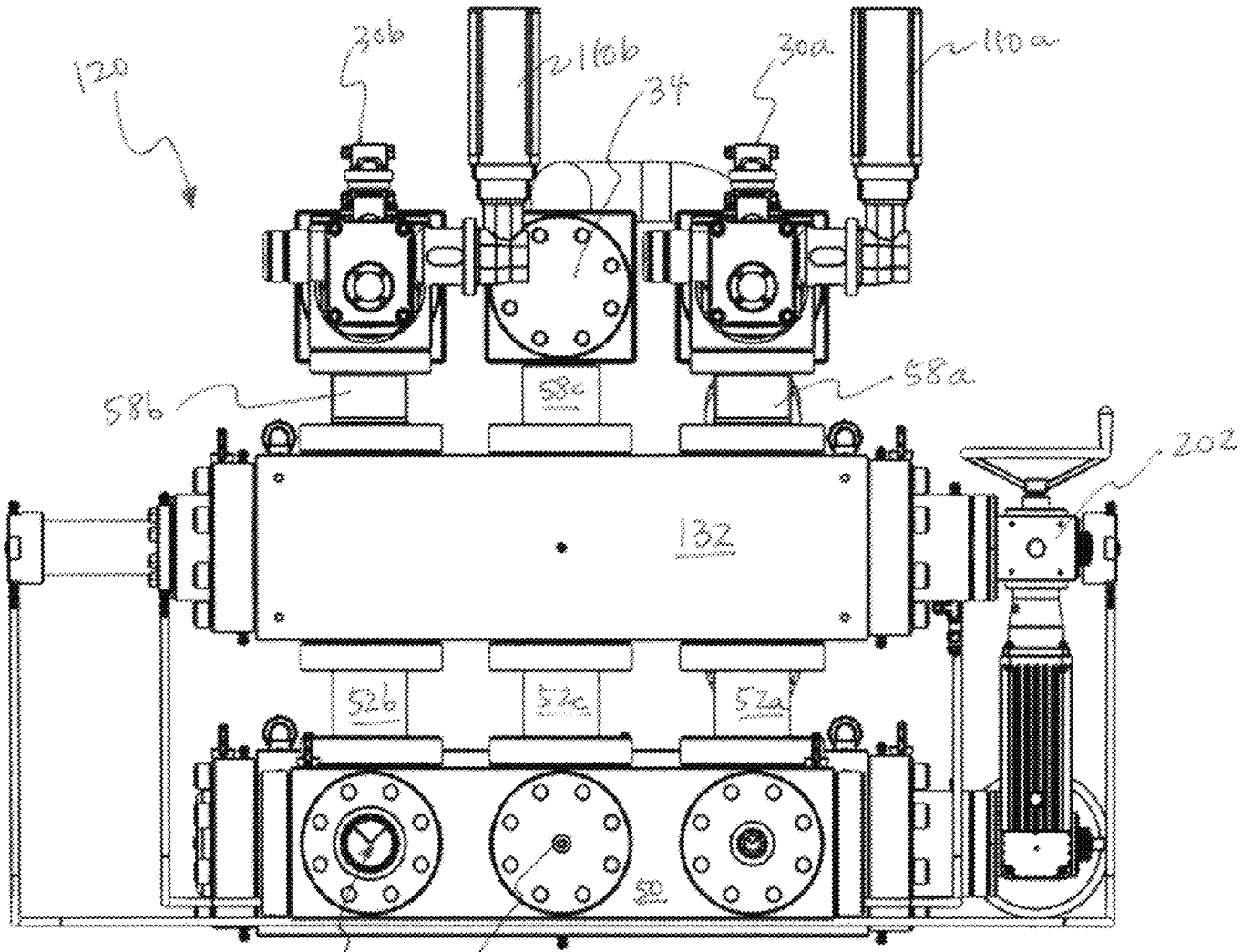
FIG. 5 is a front plan view of the MPD manifold shown in FIG. 3.
Figure 6:
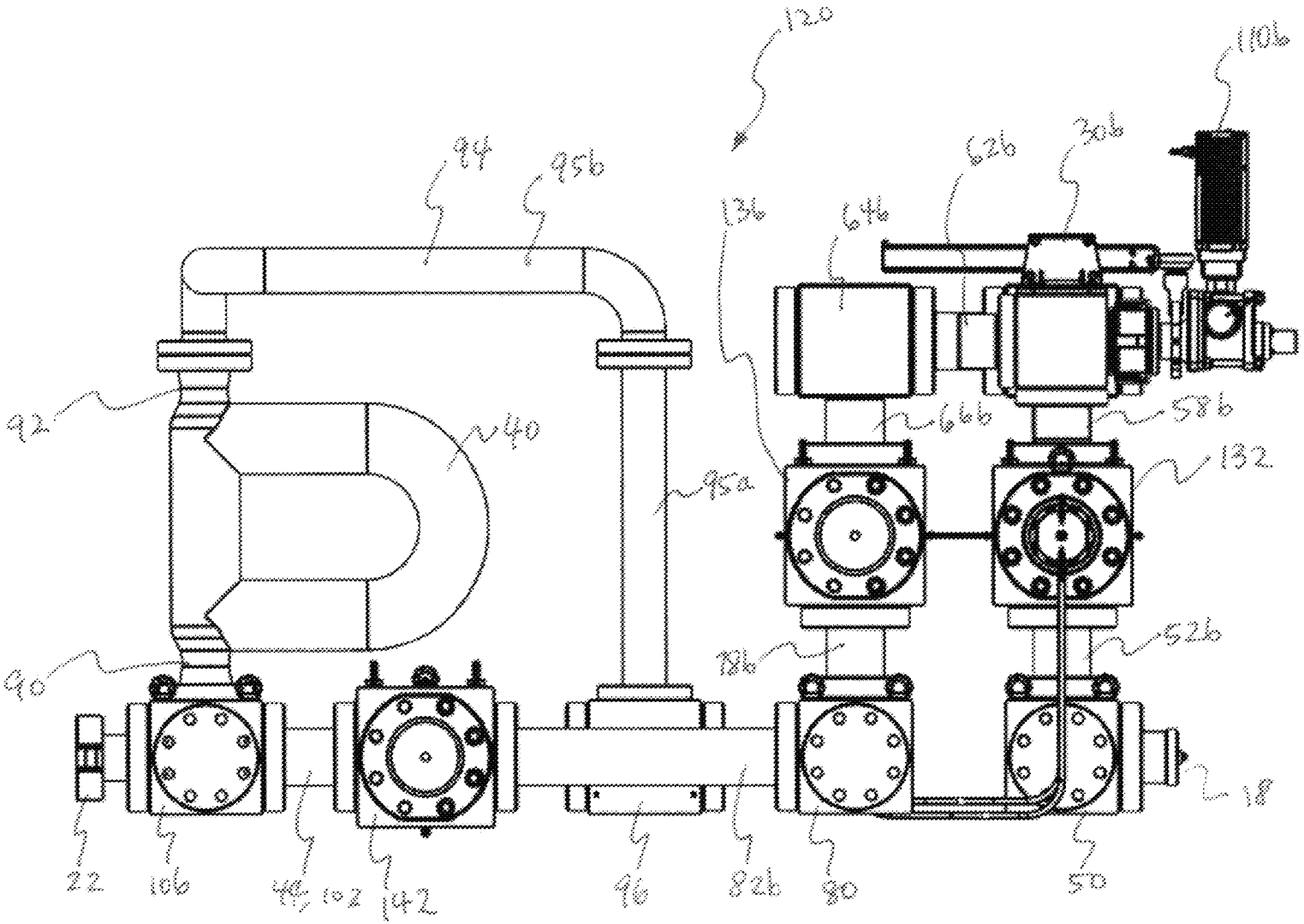
FIG. 6 is a first side plan view of the MPD manifold shown in FIG. 3.
Figure 1:
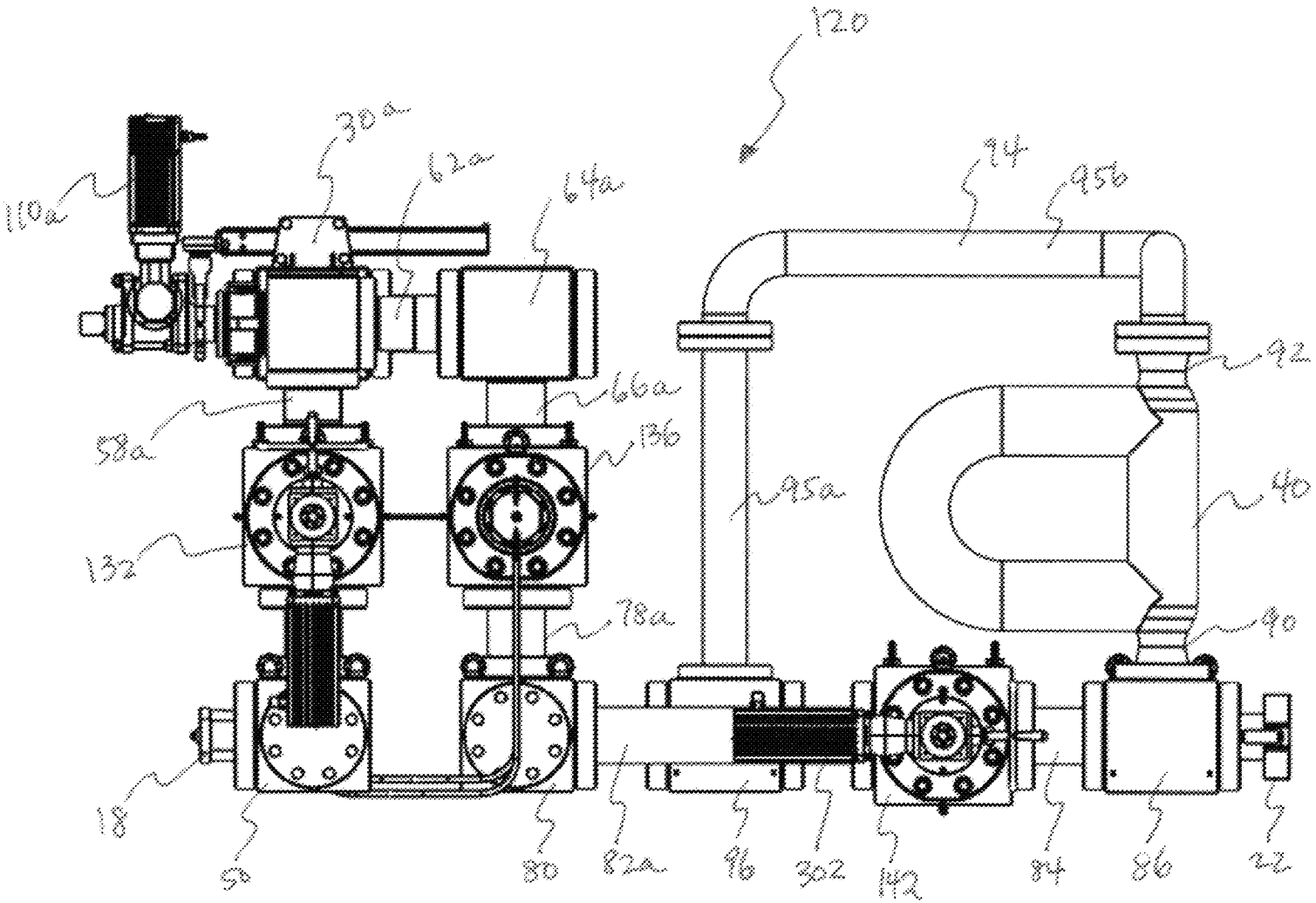
Figure 8:
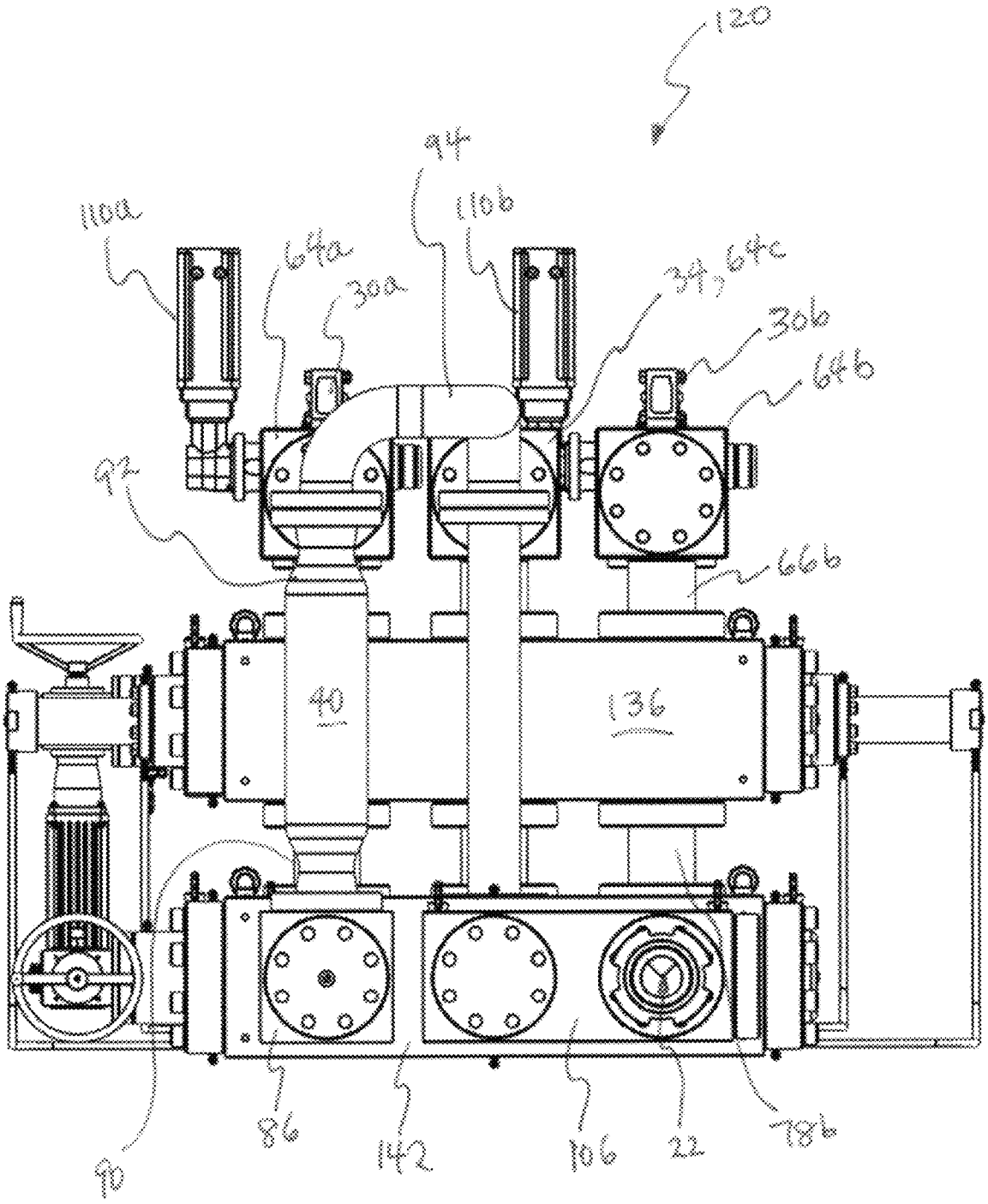
FIG. 8 is a rear plan view of the MPD manifold shown in FIG. 3.
Figure 9:
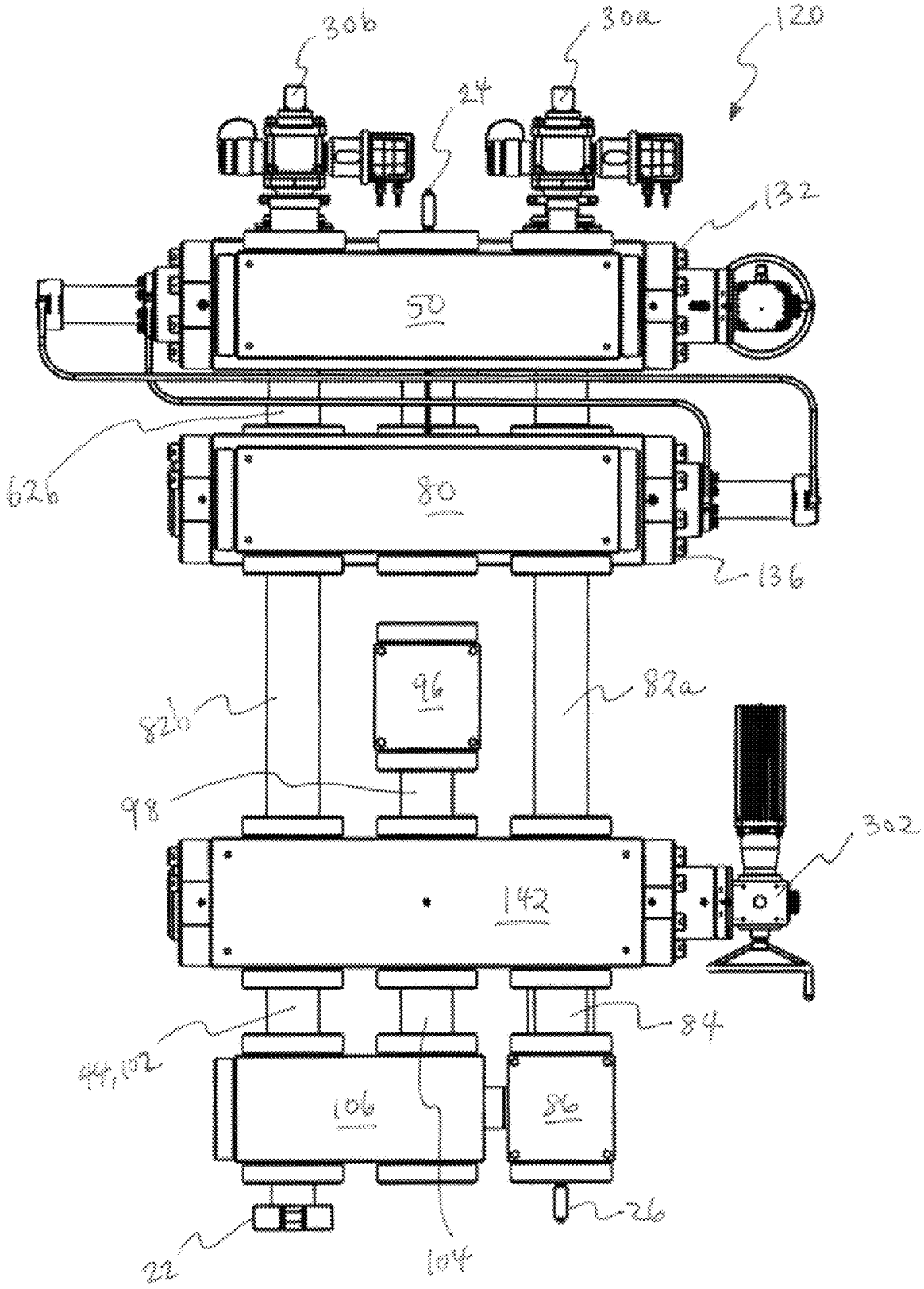
FIG. 9 is a bottom plan view of the MPD manifold shown in FIG. 3.

FIG. 2 illustrates an MPD manifold 20 according to one embodiment of the present disclosure. Manifold 20 generally comprises at least one pressure sensor 24, a choke section C2, and a flowmeter section F2, all between an inlet 18 and an outlet 22. The manifold 20 may further comprise at least one second pressure sensor 26 in some embodiments. The choke section C2 is operably coupled to, and adapted to be in fluid communication with, the flowmeter section F2. The choke section C2 comprises one or more drilling chokes 30*a*,30*b*, a choke gut line 34, a first block valve 132, and a second block valve 136. In the illustrated embodiment, the first drilling choke 30*a*, the second drilling choke 30*b*, and the choke gut line 34 are each fluidly connected in parallel to the first block valve 132 and the second block valve 136. The first and second block valves 132,136, together, form a choke section valve assembly.

During the operation of manifold 20, one or both of the drilling chokes 30*a*,30*b* can be adjusted to account for changes in the flow rate of the drilling mud flowing therethrough so that the desired backpressure within the wellbore is maintained. The backpressure applied by the one or more drilling chokes 30*a*,30*b* may be adjusted based on data collected by the at least one pressure sensor 24. In some embodiments, only one of the chokes is in operation at any given time to maintain the desired backpressure within the wellbore. In other embodiments, by allowing fluid in the drilling system to flow through two or more chokes simultaneously, the two or more chokes can operate together to maintain the desired backpressure within the wellbore. While the illustrated embodiment shows two drilling chokes 30*a*,30*b*, fewer or more drilling chokes may be included in other embodiments. It may be desirable to have at least two drilling chokes in manifold 20 since one of the drilling chokes may be bypassed in case of failure or blockage of same and/or to allow the drilling choke to be inspected, serviced, repaired, or replaced during drilling operations while the other of the drilling chokes remains in service.

The flowmeter section F2 comprises a flowmeter section valve assembly, a flowmeter 40, and a flowmeter gut line 44. In the illustrated embodiment, the flowmeter section valve assembly comprises a third block valve 142. The flowmeter 40 and the flowmeter gut line 44 are fluidly connected to the third block valve 142. While the illustrated embodiment shows one flowmeter, more flowmeters may be included in other embodiments. In may be desirable to have additional flowmeter(s) in manifold 20 since one of the flowmeters may be bypassed in case of failure or blockage of same and/or to allow the flowmeter to be inspected, serviced, repaired, or replaced during drilling operations while another flowmeter remains in service. In some embodiments, manifold 20 may comprise at least two flowmeters 40 and be configured such that, when desired, two or more of the flowmeters can operate simultaneously in parallel. Having two or more flowmeters in operation at the same time may be useful when the fluid flow rate in the manifold is high, in order to reduce or minimize the rate of erosion of the flowmeter components, as the fluid flowing through the manifold often contains abrasive materials. In some embodiments, where the fluid flow rate is high, having two or more flowmeters operating simultaneously may provide more accurate flowmeter measurements.

In an optional embodiment, the manifold 20 comprises at least one second pressure sensor 26 positioned between the choke section C2 and the flowmeter section F2 for measuring the pressure of fluids entering the flowmeter section F2. In other embodiments, the second pressure sensor 26 may be positioned upstream of the flowmeter 40 to measure the pressure of fluids entering the flowmeter 40 to detect, for example, clogging or other failures of the flowmeter 40. In some embodiments, one or both of pressure sensors 24,26 may comprise one or more digital pressure sensors and/or one or more analog pressure sensors (such as a mechanical pressure gauge). In addition to pressure sensors 24,26, one or more instruments (not shown) such as, for example, a temperature sensor, a densitometer, etc. can be operably coupled to the manifold 20. In some embodiments, the temperature sensor and/or the densitometer comprises one or more pressure sensors.

In some embodiments, first block valve 132 and second block valve 136 work together to control the flow of fluids through the choke section C2 such that fluid can generally only flow through one of the first choke 30*a*, the second choke 30*b*, and the choke gut line 34. In some embodiments, as illustrated in FIGS. 3 to 9, the first and second block valves 132,136 are controllable by the same actuator. In other embodiments, each of the first and second block valves is controllable by a respective actuator so that the first and second block valves can operate independently from one another. In some embodiments, the first and second block valves 132,136 are configured to operate in a synchronized manner with respect to one another, i.e., such that the first and second block valves 132,136 are "synced". In some embodiments, the first and second block valves 132,136 are mechanically synced, hydraulically synced, electronically synced, pneumatically synced, or a combination thereof, or otherwise synced by methods known to those skilled in the art.

In some embodiments, the first and second block valves 132,136 each have a respective first position, a second position, and a third position. In some embodiments, the first and second block valves are synced so that when the first block valve 132 is in its first, second, or third position, the second block valve 136 is also in its first, second, or third position, respectively.

In some embodiments, when the first and second block valves 132,136 are both in the first position, fluid can flow through the first choke 30*a* but cannot flow through the choke gut line 34 or the second choke 30*b*. When the first and second block valves 132,136 are both in the second position, fluid can flow through the second choke 30*b* but cannot flow through the choke gut line 34 or the first choke 30*a*. When the first and second block valves 132,136 are both in the third position, fluid can flow through the choke gut line 34 but cannot flow through the first choke 30*a* or the second choke 30*b*. Thus, when the block valves 132,136 are synced, the flow of fluids can be directed or rerouted as desired through the choke section C2 by changing the position of either one of the block valves 132,136. Accordingly, unlike the prior art manifold 10 where five valves need to be automatically or manually actuated in order to reroute the flow path in the choke section C1, the MPD manifold 20 requires the actuation of only one of the two block valves 132,136 to change the fluid flow path through the choke section C2.

The third block valve 142 is operable to control the flow of fluids through the flowmeter section F2 such that fluid can generally only flow through one of the flowmeter 40 and the flowmeter gut line 44. In some embodiments, the third block valve 142 has a first position and a second position. In the first position, the third block valve 142 allows fluid to flow through the flowmeter 40 but not the flowmeter gut line 44. In the second position, the third block valve 142 allows fluid to flow through the flowmeter gut line 44 but not the flowmeter. Accordingly, unlike the prior art manifold 10 where three valves need to be actuated in order to reroute the flow path in the flowmeter section F1, the MPD manifold 20 requires the actuation of only one block valve 142 to change the fluid flow path through the flowmeter section F2.

In operation, fluid from the wellbore enters the MPD manifold 20 via inlet 18 and the pressure of the incoming fluid is measured by the pressure sensor 24. The data collected from pressure sensor 24 may be used to monitor the fluid pressure near the inlet 18 to provide feedback for controlling the position of one or both of chokes 30*a*,30*b* to maintain the desired backpressure in the wellbore and/or to detect, for example, plugging or other failures of the chokes 30*a*,30*b*. In some embodiments, other properties such as temperature, density, etc. of the incoming fluid are may also be measured at or near the inlet 18. The fluid then enters the choke section C2 where, depending on the positions of the first and second block valves 132,136, the fluid flows through one of three flow paths. For example, if the first and second block valves 132,136 are in the first position, the fluid only flows through the choke section C2 via the first choke 30*a*; if the first and second block valves 132,136 are in the second position, the fluid only flows through the choke section C2 via the second choke 30*b*; and if the first and second block valves 132,136 are in the third position, the fluid only flows through the choke section C2 via the choke gut line 34. Accordingly, the choke section valve assembly formed by block valves 132,136 can control the flow of fluids through the inlet and outlet of each of the first and second chokes 30*a*,30*b* and through the choke gut line 34.

After exiting the choke section C2, the fluid flows downstream to the flowmeter section F2 where, depending on the position of the third block valve 142, the fluid flows through one of two flow paths. For example, if the third block valve is in the first position, the fluid only flows through the flowmeter section F2 via the flowmeter 40; and if the third block valve is in the second position, the fluid only flows through the flowmeter section F2 via the flowmeter gut line 44. From the flowmeter section F2, the fluid exits the manifold 20 at outlet 22. Accordingly, the flowmeter section valve assembly formed by block valve 142 can control the flow of fluids through the inlet and outlet of the flowmeter 40 and through the flowmeter gut line 44.

Accordingly, the first and second block valves 132,136 of manifold 20 of the present disclosure can replace the choke valves 32*a*,32*b* and choke gut line valve 36 of the prior art manifold 10 and the third block valve 142 can replace the flowmeter valves 42 and flowmeter gut line valve 46 of the prior art manifold 10. The first, second, and third block valves 132,136,142 are described in more detail below.

In some embodiments, all or part of the manifold 20 can be mounted to a skid (not shown). The one or more instruments may also be mounted to the skid. In other embodiments, rather than being mounted to the skid, the manifold 20 may be freestanding on the ground or mounted to a trailer (not shown) that can be towed between operational sites. In further embodiments, the manifold 20 may be mounted on an onshore or offshore rig platform (not shown).

The drilling chokes 30*a*,30*b*, the choke gut line 34, the first, second, and third block valves 132,136,142, the flowmeter 40, and the flowmeter gut line 44 may be coupled to one another by one or more flow blocks and/or one or more spools. FIGS. 3 to 9 show a sample configuration of the MPD manifold 120 in accordance with the embodiment shown in FIG. 2. As a skilled person in the art can appreciate, other configurations are possible.

In the illustrated embodiment as shown in FIGS. 3 to 9, the MPD manifold 120 comprises inlet 18, pressure sensor 24, first and second block valves 132,136, first and second chokes 30*a*,30*b*, choke gut line 34, flowmeter 40, third block valve 142, flowmeter gut line 44, and outlet 22, which are interconnected by various flow blocks and spools. In some embodiment, first and second block valves 132,136 are each a three-port block valve. In some embodiments, third block valve 142 is a three-port block valve.

In the sample embodiment shown in FIGS. 3 to 9, inlet 18 is positioned in one of the fluid passageways of a flow block 50. The pressure sensor 24 may be positioned in another fluid passageway of the flow block 50. With reference to FIGS. 3 to 9 and further reference to FIGS. 10 to 12, flow block 50 is coupled to, and in fluid communication with, the first block valve 132 via spools 52*a*,52*b*,52*c*. The inlet 18 is in fluid communication with spools 52*a*,52*b*,52*c*. The first block valve 132 has a first fluid passageway 54*a*, a second fluid passageway 54*b*, and a third fluid passageway 54*c* extending therethrough. In the illustrated embodiment, spools 52*a*,52*b*,52*c* are operably connected to the first block valve 132 such that spools 52*a*,52*b*,52*c* can fluidly communicate with the first, second, and third passageways 54*a*, 54*b*,54*c*, respectively.

In some embodiments, the choke gut line 34 comprises a flow block 60 coupled to, and in fluid communication with, a flow block 64*c* via a spool 62*c*. In some embodiments, first choke 30*a*, second choke 30*b*, and flow block 60 of the choke gut line 34 are operably coupled to the first block valve 132 via spools 58*a*,58*b*,58*c*, respectively, such that first choke 30*a*, second choke 30*b*, and flow block 60 of the choke gut line 34 can fluidly communicate with the first, second, and third passageways 54*a*,54*b*,54*c*, respectively. In some embodiments, first choke 30*a* is coupled to, and in fluid communication with, a flow block 64*a* via a spool 62*a*; and second choke 30*b* is coupled to, and in fluid communication with, a flow block 64*b* via a spool 62*b*.

Figure 10:
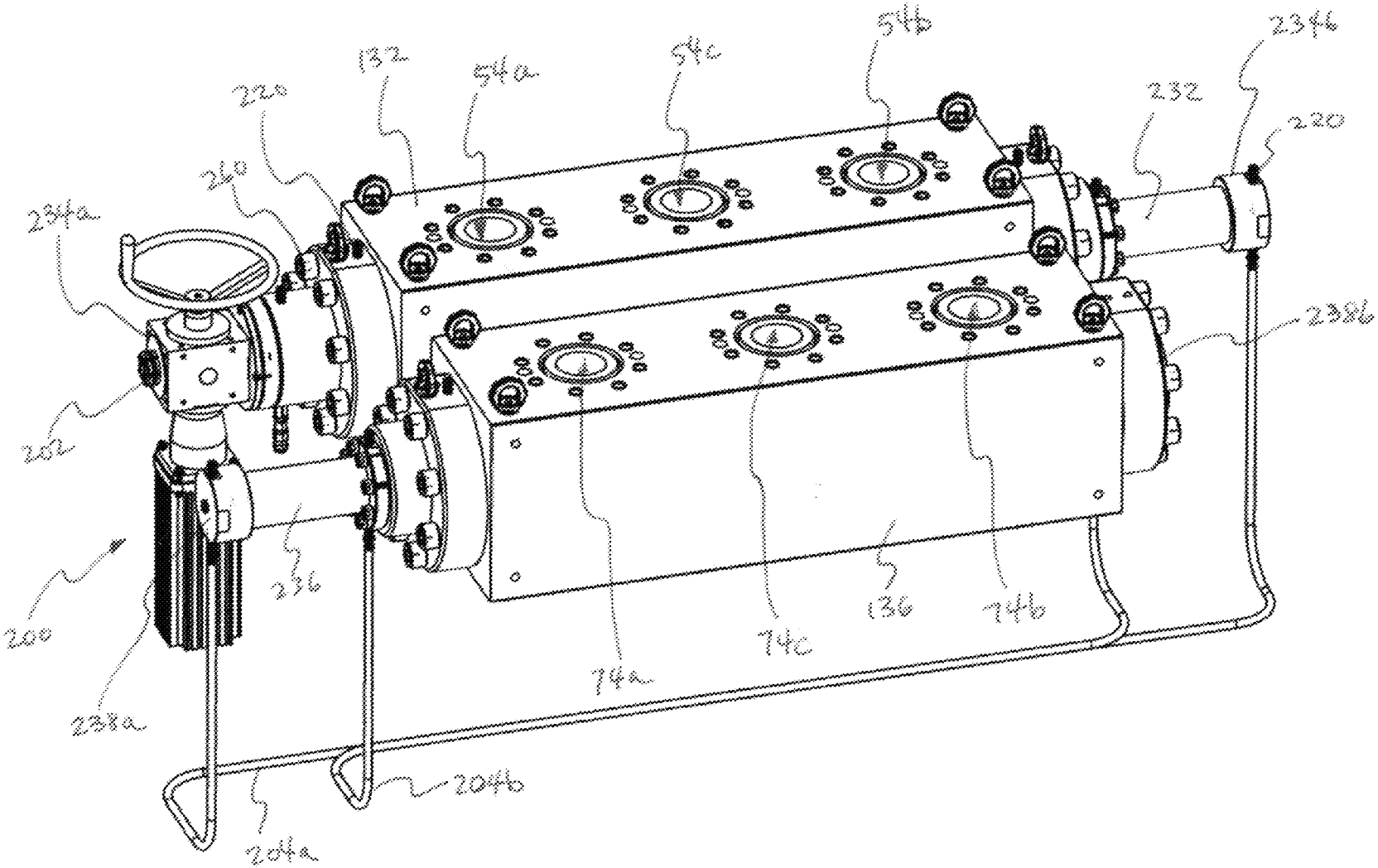
FIG. 10 is a perspective view of a first block valve and a second block valve of the MPD manifold shown in FIG. 3, according to one embodiment of the present disclosure.
Figure 11:
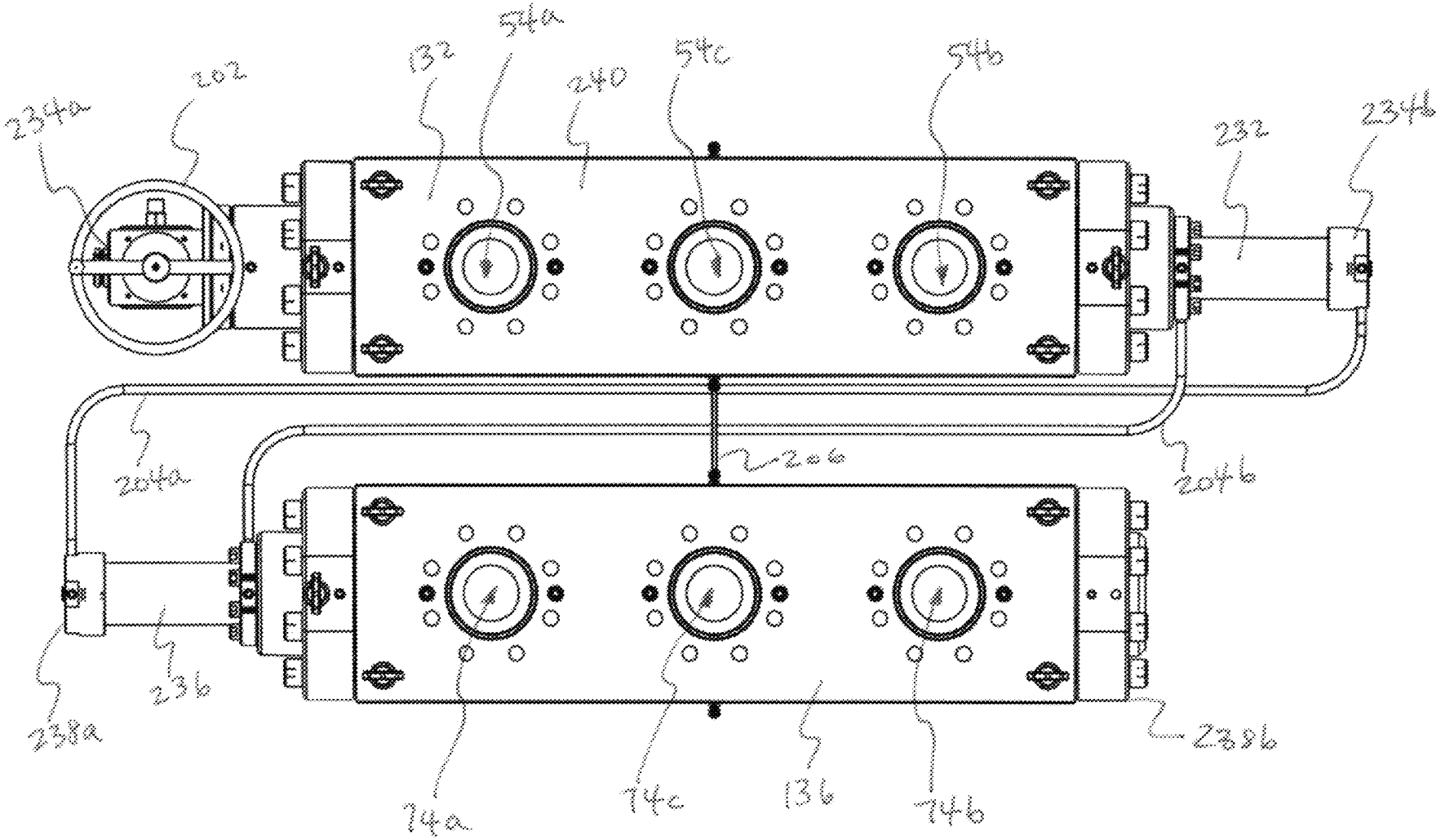
FIG. 11 is a top plan view of the first and second block valves shown in FIG. 10.
Figure 12:
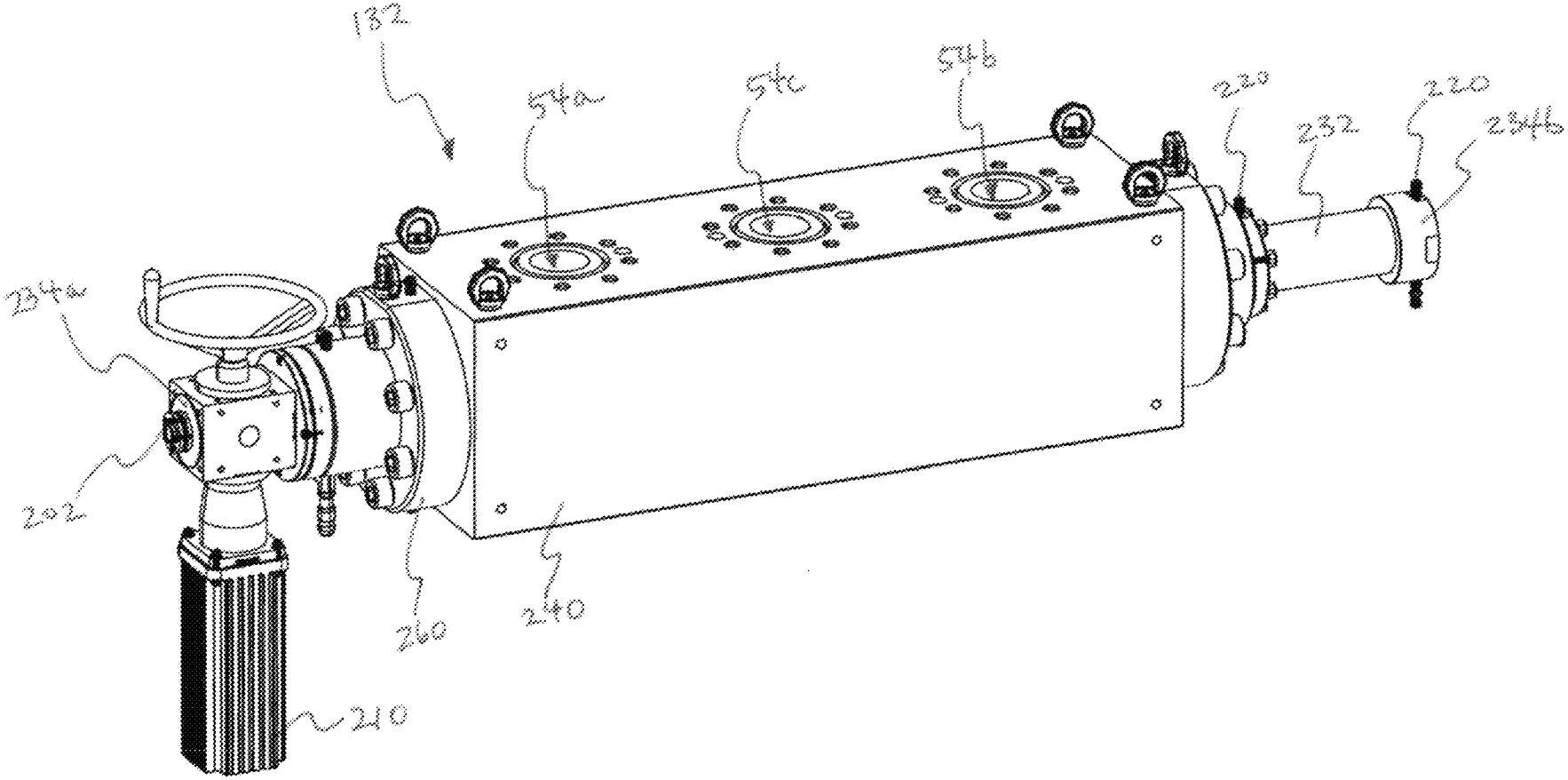
FIG. 12 is a perspective view of the first block valve shown in FIG. 10.

With reference to FIGS. 3 to 9 and further reference to FIGS. 10 to 12, the second block valve 136 has a first fluid passageway 74*a*, a second fluid passageway 74*b*, and a third fluid passageway 74*c* extending therethrough. In the illustrated embodiment, flow blocks 64*a*,64*b*,64*c* are operably connected to the second block valve 136 via spools 66*a*, 66*b*,66*c*, respectively, such that first choke 30*a*, second choke 30*b*, and flow block 64*c* of the choke gut line 34 can fluidly communicate with the first, second, and third passageways 74*a*,74*b*,74*c*, respectively.

Second block valve 136 is coupled to, and in fluid communication with, a flow block 80 via spools 78*a*,78*b*, 78*c*. In the illustrated embodiment, spools 78*a*,78*b*,78*c* operably connect the second block valve 136 with the flow block 80 such that flow block 80 can fluidly communicate with the first, second, and third passageways 74*a*,74*b*,74*c* via 78*a*,78*b*,78*c*, respectively. In the illustrated embodiment, flow block 80 is coupled to the third block valve 142 via spools 82*a*,82*b* so flow block 80 can fluid communicate with the third block valve 142. With specific reference to FIG. 18, the third block valve 142 has first, second, and third passageways 154*a*,154*b*,154*c* extending therethrough. Referring back to FIGS. 3 to 9 and with further reference to FIG. 18, spools 82*a*,82*b* are operably connected to the third block valve 142 such that spools 82,82*b* can fluidly communicate with the first and third passageways 154*a*,154*b*, respectively. An inlet 90 of the flowmeter 40 is coupled to, and in fluid communication with, the third block valve 142 via a flow block 86 and a spool 84. In the illustrated embodiment, spool 84 is operably coupled to, and in fluid communication with, passageway 154*a* so that flowmeter 40 can receive incoming fluid from passageway 154*a* of block valve 142. In the illustrated embodiment, pressure sensor 26 is positioned at flow block 86, for measuring the pressure of fluid entering the flowmeter 40. An outlet 92 of the flowmeter 40 is coupled to, and in fluid communication with, the third block valve 142 via a tubing 94, a flow block 96, and a spool 98, respectively. In the illustrated embodiment, spool 98 is operably coupled to, and in fluid communication with, passageway 154*c* of the third block valve 142 so that fluid exiting the flowmeter 40 can flow through passageway 154*c*.

The flowmeter gut line 44 is operably connected to the third block valve 142. In some embodiments, the flowmeter gut line 44 comprises a spool 102 that is coupled to, and in fluid communication with, the third block valve 142. In the illustrated embodiment, spool 102 is coupled to, and in fluid communication with, passageway 154*b* of block valve 142. Spool 102 is coupled to, and in fluid communication with, a flow block 106 so that flow block 106 can fluidly communicate with passageway 154*b*. Another spool 104 also connects the third block valve 142 and the flow block 106 to allow fluid communication therebetween. In the illustrated embodiment, spool 104 is coupled to, and in fluid communication with, passageway 154*c* of block valve 142 so that flow block 106 can fluidly communicate with passageway 154*c*. Outlet 22 is positioned in a passageway of flow block 106 and is in fluid communication with both of spools 102 and 104 via flow block 106.

In some embodiments, the manifold 120 is configured to reduce or minimize its footprint and/or to fit into a particular space, for example a skid. In some embodiments, manifold 120 is configured to reduce or minimize empty space between its components. In some embodiments, manifold 120 is configured to reduce the number of fluid couplings, and thus potential leak paths, required to make up the manifold 120.

Hereafter, in reference to the orientation of the various components of manifold 120, the relative orientation may refer to the structure of the component itself (e.g. the body and/or the inner bore of the spool) or the passageway of the flow block or block valve to which the component is connected. In a sample embodiment, as illustrated in FIGS. 3 to 9, inlet 18 (or the passageway of block 50 in which inlet 18 is situated) is substantially perpendicular to one or more of spools 52*a*,52*b*,52*c* (or the respective passageways of block 50 to which spools 52*a*,52*b*,52*c* are connected). In some embodiments, inlet 18 is positioned adjacent to spool 52*b*. In some embodiments, one or more of spools 52*a*,52*b*, 52*c* are parallel to one or more of the other spools 52*a*,52*b*, 52*c*. In some embodiments, one or more of spools 52*a*,52*b*, 52*c* are substantially parallel to one or more of spools 58*a*,58*b*,58*c*. In a further embodiment, spools 52*a*,52*b*,52*c* are substantially co-axial with spools 58*a*,58*b*,58*c*, respectively. In some embodiments, one or more of spools 58*a*, 58*b*,58*c* are parallel to one or more of the other spools 58*a*,58*b*,58*c*.

In some embodiments, one or more of spools 62*a*,62*b*,62*c* are substantially perpendicular to one or more of spools 58*a*,58*b*,58*c*. In some embodiments, one or more of spools 62*a*,62*b*,62*c* are parallel to one or more of the other spools 62*a*,62*b*,62*c*. In some embodiments, one or more of spools 66*a*,66*b*,66*c* are substantially perpendicular to spools one or more of 62*a*,62*b*,62*c*. In some embodiments, one or more of spools 66*a*,66*b*,66*c* are substantially parallel to spools one or more of 58*a*,58*b*,58*c*. In some embodiments, one or more of spools 66*a*,66*b*,66*c* are parallel to one or more of the other spools 66*a*,66*b*,66*c*. In some embodiments, one or more of spools 66*a*,66*b*,66*c* are substantially parallel to one or more of spools 78*a*,78*b*,78*c*. In a further embodiment, spools 66*a*,66*b*,66*c* are substantially co-axial with spools 78*a*,78*b*, 78*c*, respectively. In some embodiments, one or more of spools 78*a*,78*b*,78*c* are parallel to one or more of the other spools 78*a*,78*b*,78*c*.

In some embodiments, one or more of spools 82*a*,82*b* are substantially perpendicular to one or more of spools 78*a*, 78*b*,78*c*. In the illustrated embodiment, spool 82*a* is adjacent to spool 78*a* while spool 82*b* is adjacent to spool 78*b*. In some embodiments, spools 82*a*,82*b* are parallel to one another. In some embodiments, spool 84 is substantially parallel to one or more of spools 82*a*,82*b*. In a further embodiment, spool 84 is substantially co-axial with spool 82*a*. In some embodiments, spool 98 is substantially parallel to one or more of spools 82*a*,82*b*,84,102,104. In a further embodiment, spool 98 is substantially co-axial with spool 104. In some embodiments, tubing 94 comprises a first portion 95*a* that is substantially vertical and perpendicular to spool 98; and a second portion 95*b* that is substantially horizontal. In some embodiments, the second portion 95*b* may oriented at an angle relative to one or more of spools 84,98 when the manifold 120 is viewed from the top.

In some embodiments, spool 102 is substantially parallel to one or more of spools 82*a*,82*b*. In a further embodiment, spool 102 is substantially co-axial with spool 82*b*. In some embodiments, spools 102,104 are parallel to one another. In some embodiments, outlet 22 (or the passageway of block 106 in which inlet 22 is situated) is substantially parallel to one or more of spools 102,104 (or the respective passageways of block 106 to which spools 102,104 are connected).

In some embodiments, two or more of flow blocks 50,80 and the third block valve 142 are substantially on the same plane. In a further embodiment, one or more of flow blocks 86,96,106 are substantially on the same plane as the third block valve 142. In some embodiments, the first and second block valves 132,136 are substantially on the same plane. In some embodiments, two or more of chokes 30*a*,30*b* and flow blocks 60,64*a*,64*b*,64*c* are substantially on the same plane. In some embodiments, one or both of the first and second block valves 132,136 are on a different plane than that of one or more of flow blocks 50,80, the third block valve 142, chokes 30*a*,30*b* and flow blocks 60,64*a*,64*b*,64*c*. In some embodiments, one or more of chokes 30*a*,30*b* and flow blocks 60,64*a*,64*b*,64*c* are on a different plane than that of one or more of flow blocks 50,80, the third block valve 142, and the first and second block valves 132,136.

While choke gut line 34 is shown in the illustrated embodiment to be positioned in parallel in between the first and second chokes 30*a*,30*b*, choke gut line 34 may be positioned elsewhere in other embodiments. For example, choke gut line 34 may be placed near one end of the first and/or second block valve 132,136 and the first and second chokes 30*a*,30*b* are adjacent to one another.

In the illustrated embodiment, the flowmeter 40 is shown to be in a substantially vertical orientation. In other embodiments, the flowmeter 40 may be positioned in a substantially horizontal orientation.

In alternative embodiments of the MPD manifold, any of the abovementioned flow blocks and/or spools may be rearranged or omitted; and/or additional flow blocks and/or spools may be included.

In some embodiments, one or both of the chokes 30*a*,30*b* are manual chokes, thus enabling an operator to manually adjust a handwheel of the chokes to control the backpressure within the drilling system. In some embodiments, one or both of the chokes 30*a*,30*b* are semi-automated chokes where the operator can adjust the choke positions via a computer. In other embodiments, one or both of the chokes 30*a*,30*b* are automated chokes that can be monitored and controlled automatically by a computer. In the illustrated embodiment, chokes 30*a*,30*b* each have a motor 110*a*,110*b*, respectively, for electronically controlling the backpressure.

In some embodiments, as shown for example in FIGS. 10 to 12, each of the first block valve 132 and the second block valve 136 is actuatable among the first position, the second position, and the third position by a hydraulic system 200. In some embodiments, the hydraulic system 200 comprises an actuator 202, a first hydraulic assembly 232 in the first block valve 132, a second hydraulic assembly 236 in the second block valve 136, hydraulic lines 204*a*,204*b*, an equalizer line 206. In some embodiments, the actuator 202 comprises a flange 260 and a motor 210. Hydraulic lines 204*a*,204*b* can allow fluid communication between the first hydraulic assembly 232 and the second hydraulic assembly 236.

Figure 13:
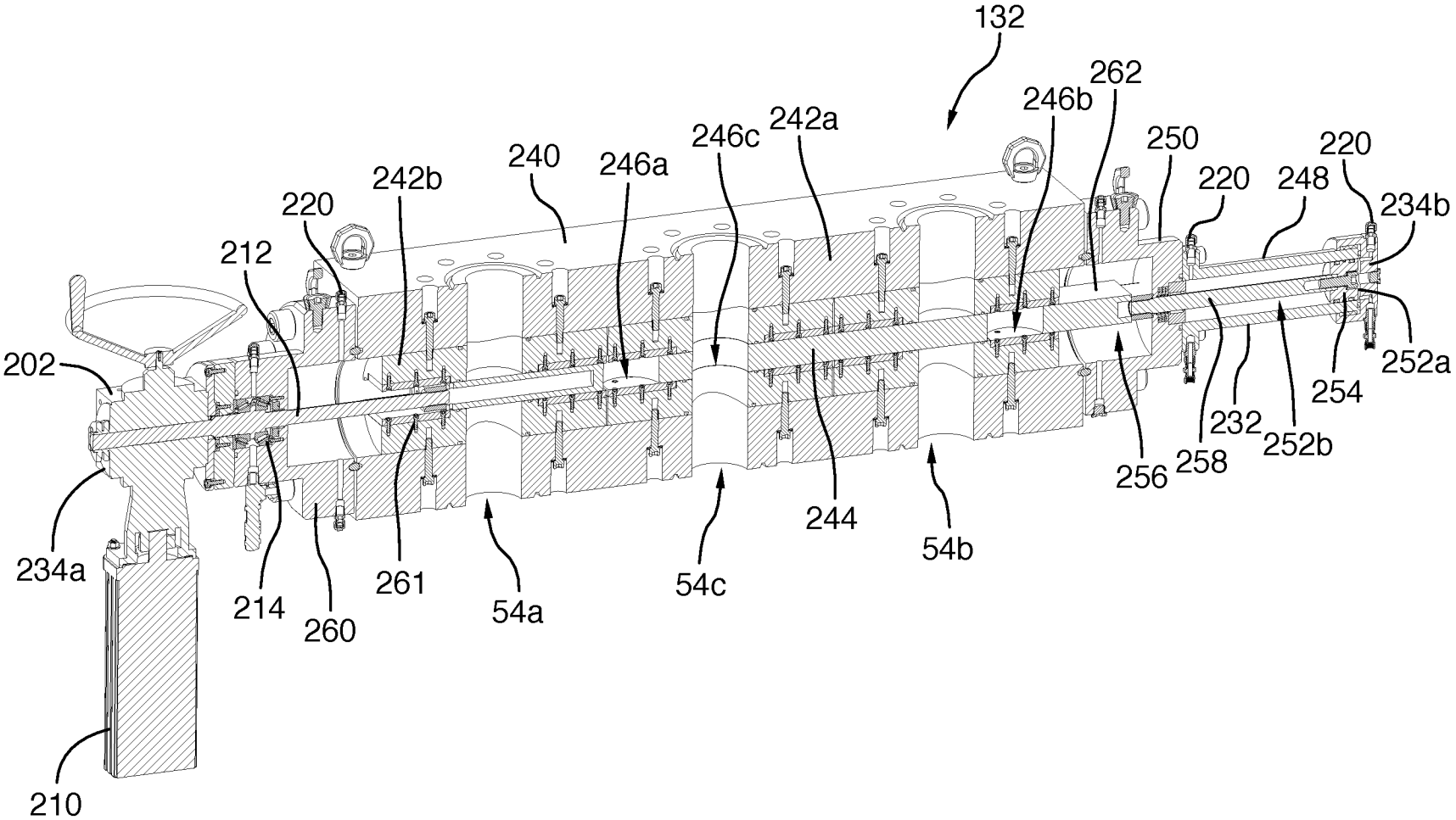
FIG. 13 is a perspective cross-sectional view of the first block valve shown in FIG. 10.

According to a sample embodiment shown in FIGS. 12 and 13, the first block valve 132 comprises a housing 240 having an outer housing 242*a* and an inner housing 242*b*, each extending between a first end 234*a* and a second end 234*b* of the first hydraulic assembly 232. While the illustrated embodiment shows inner housing 242*b* as a separate component positioned inside outer housing 242*a*, outer housing 242*a* and inner housing 242*b* may be integrally formed as a single component in other embodiments. Outer housing 242*a* and inner housing 242*b* have aligned apertures to define the first fluid passageway 54*a*, second fluid passageway 54*b*, and third fluid passageway 54*c* of the first block valve 132.

The first block valve 132 further comprises a valve control mechanism. In the illustrated embodiment, with specific reference to FIGS. 10 to 15, the valve control mechanism is a gate valve comprising a slab gate 244 that has an elongated body 245 extending axially in inner housing 242*b*, between ends 234*a*,234*b*. A first opening 246*a*, a second opening 246*b*, and a third opening 246*c* are defined in the body 245. The actuator 202 is operable to move the slab gate 244 axially within the inner housing 242*b* among a first, second, and third positions, and any other axial position between the first and second ends 234*a*,234*b*. In some embodiments, a first end 261 of the slab gate 244 is coupled to the actuator 202 to allow the actuator 202 to exert axial force on the slab gate 244. In a sample embodiment, as shown in FIG. 13, the actuator 202 comprises a rod 212, one end of which is threadedly coupled to the first end 261 of slab gate 244. Motor 210 can operate to rotate the rod 212 and the rotation of the rod 212 can, in turn, move the slab gate 244 axially relative to the rod. The direction of movement of slab gate 244 depends on the direction of rotation of the rod 212. For example, when the rod 212 is rotated clockwise (when viewed facing end 261), the slab gate 244 moves axially towards the actuator 202; likewise, when rod 212 is rotated counter-clockwise, the slab gate 44 moves axially away from the actuator 202. In some embodiments, flange 260 comprises bearings 214 to facilitate the rotation of rod 212. The bearings 214 may be, for example, high capacity thrust bearings. In some embodiments, a sensor (not shown) may be used to track the rotation of the rod 212 and the position of the slab gate 244 can be determined based on the rotation of the rod 212. Alternative configurations and/or forms of the valve control mechanism and the actuator-valve control mechanism interface are possible. For example, instead of the gate valve, the valve control mechanism may comprise a plug valve that is rotatable to transition between two or more valve positions.

Figure 14A:
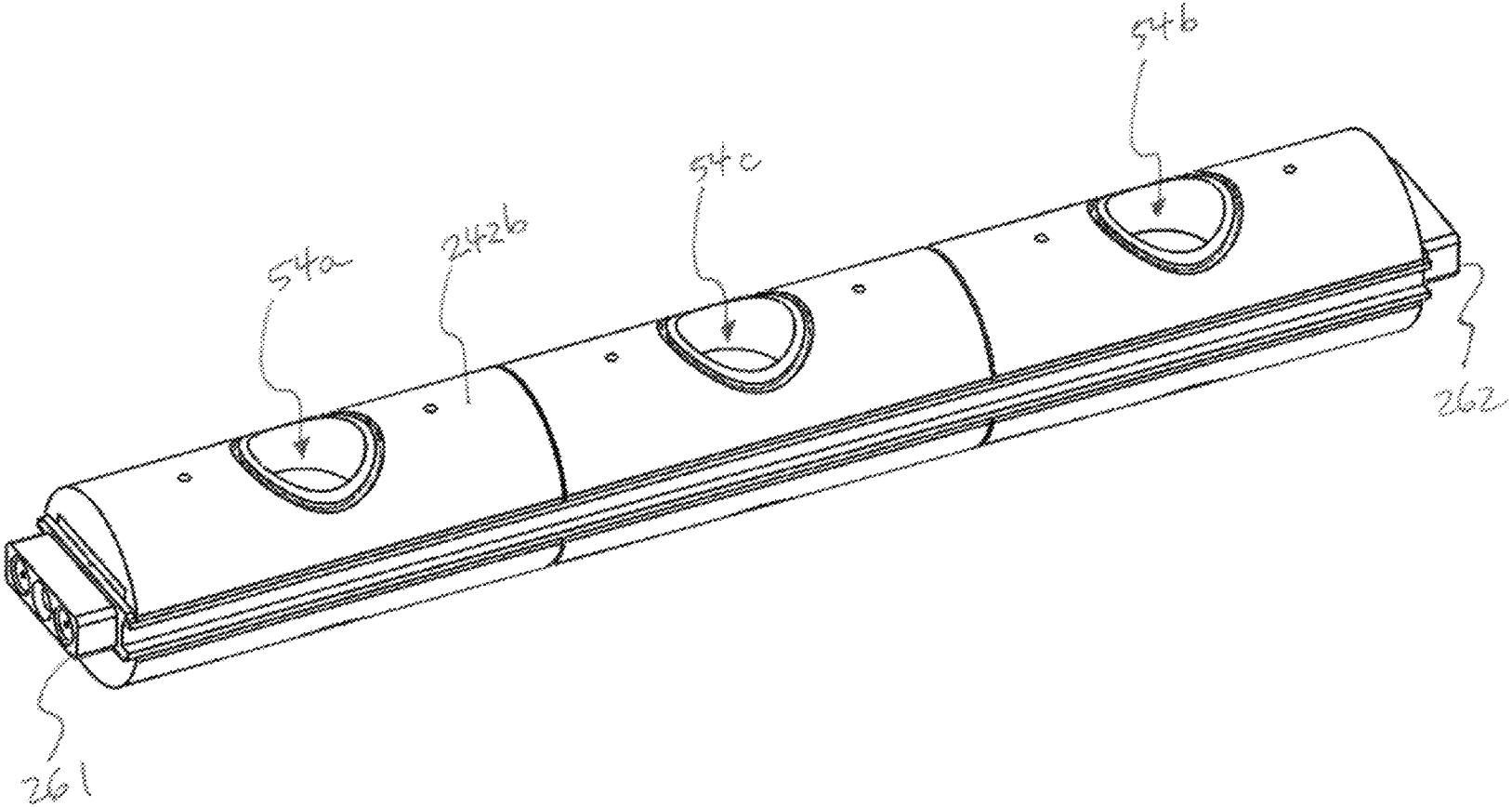
FIG. 14A is a perspective view of exemplary internal components of the first block valve shown in FIG. 10, according to one embodiment of the present disclosure.

With reference to FIGS. 13, 14, and 16, the first, second, and third openings 246*a*,246*b*,246*c* are spaced apart and positioned relative to the first, second, and third passageways 54*a*,54*b*,54*c* between the first and second ends 234*a*, 234*b* such that when one of the openings 246*a*,246*b*,246*c* is aligned (i.e. substantially co-axial) with one of the passageways 54*a*,54*b*,54*c*, the remaining openings are not aligned (or "misaligned") with the remaining passageways. When one of the openings 246*a*,246*b*,246*c* is aligned with one of the passageways 54*a*,54*b*,54*c*, the aligned passageway is in an open position in which fluid flow is permitted therethrough. When a passageway 54*a*,54*b*,54*c* is misaligned with the openings 246*a*,246*b*,246*c* and is thus blocked by the body 245 of the slab gate 244, the blocked passageway is in a closed position in which fluid flow therethrough is restricted (or at least reduced).

Figure 14B:
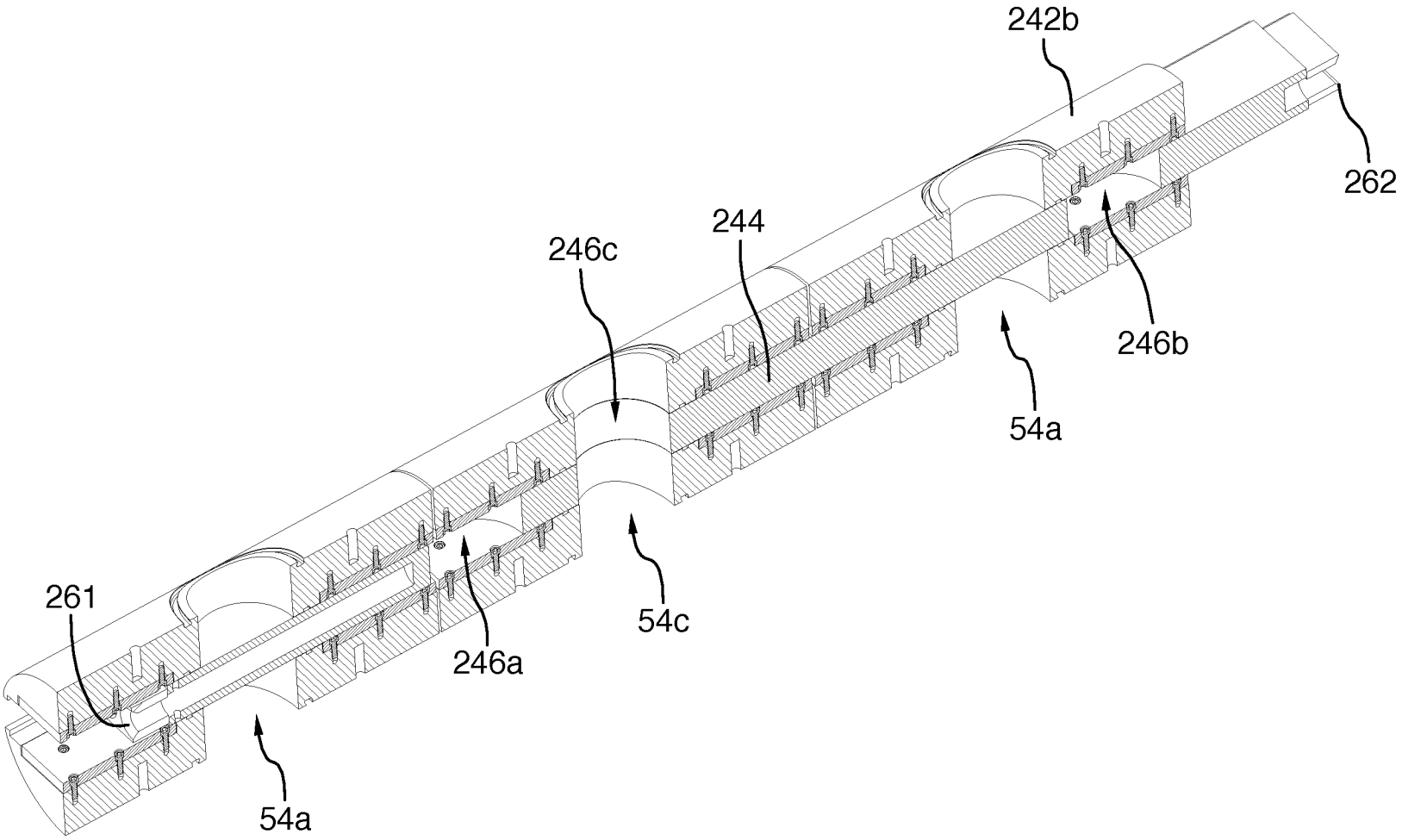
FIG. 14B is a cross-sectional view of the internal components shown in FIG. 14A.
Figure 15A:
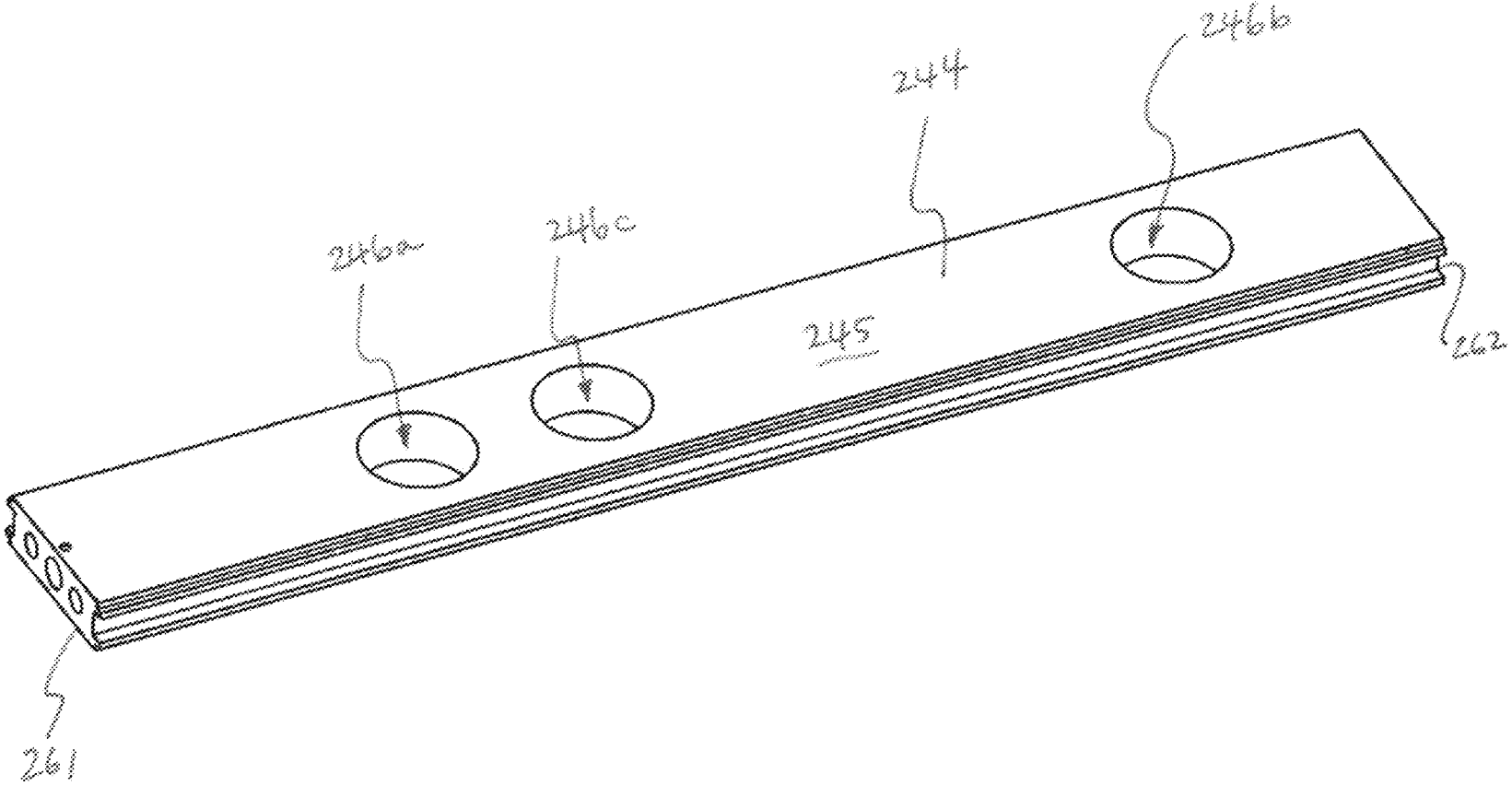
FIG. 15A is a perspective view of an exemplary valve control mechanism of the first block valve shown in FIG. 10, according to one embodiment of the present disclosure.
Figure 15B:
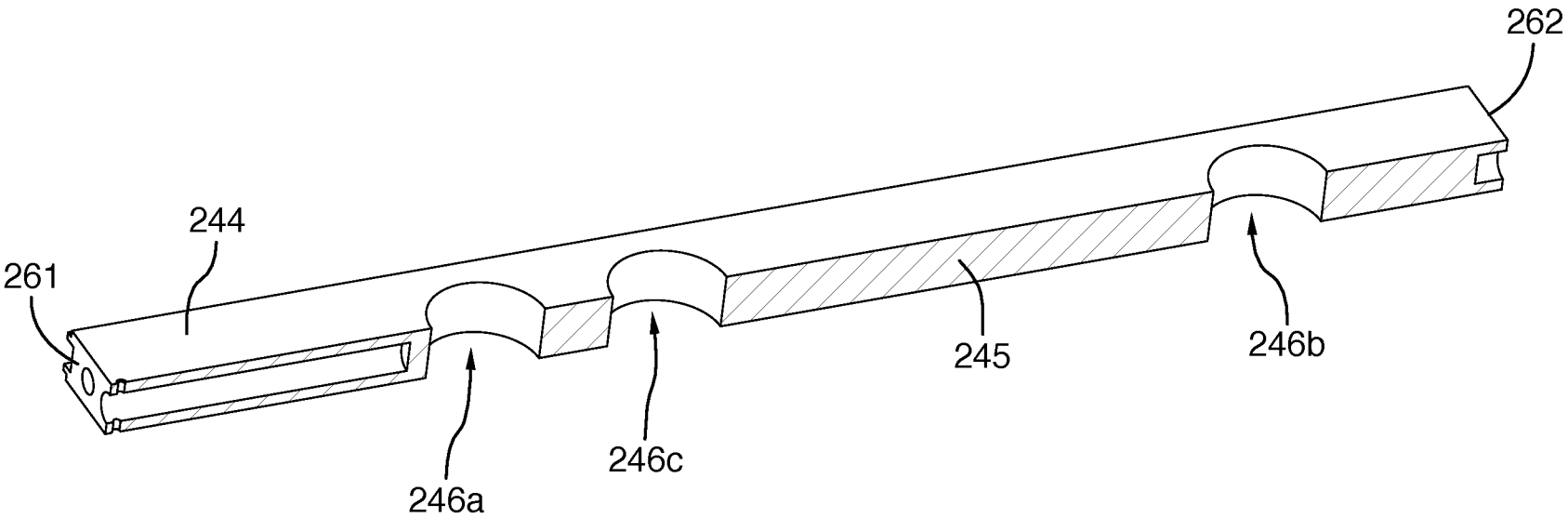
FIG. 15B is a cross-sectional view of the valve control mechanism shown in FIG. 15A.
Figure 16A:
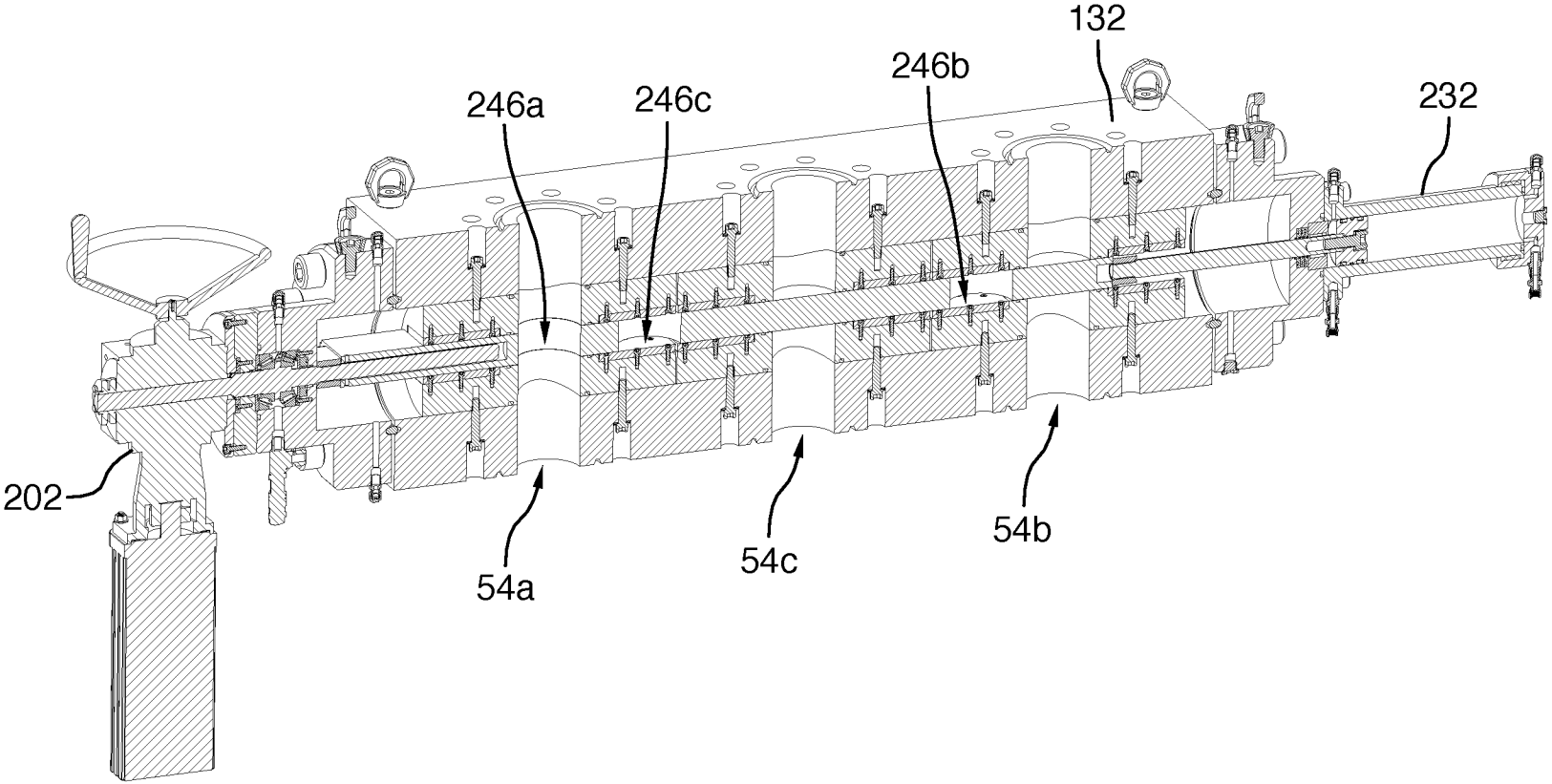
FIGS. 16A, 16B, and 16C are perspective cross-sectional views of the first block valve of FIG. 10, shown in a first position, a second position, and a third position, respectively.
Figure 16B:
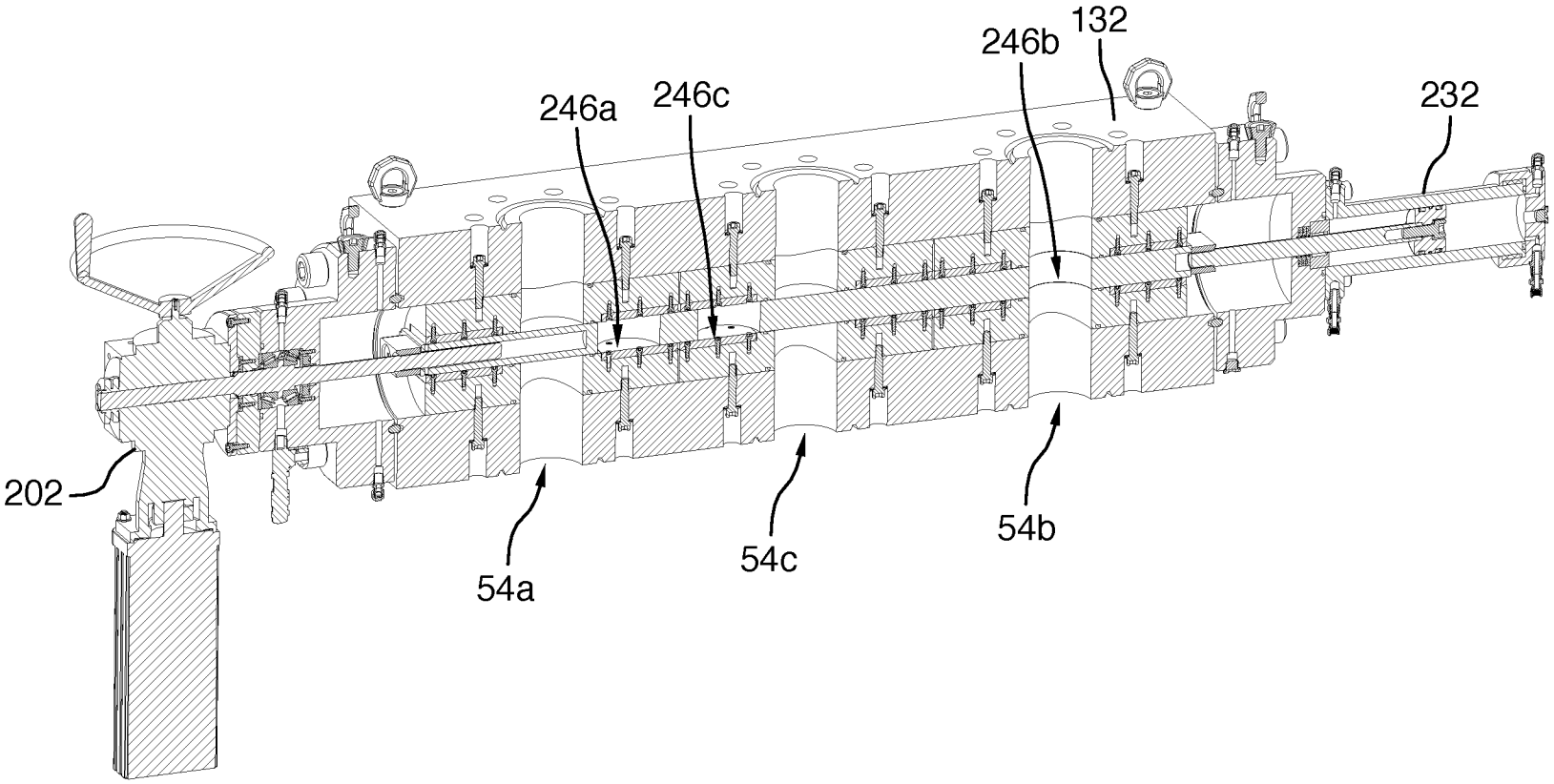
Figure 16C:
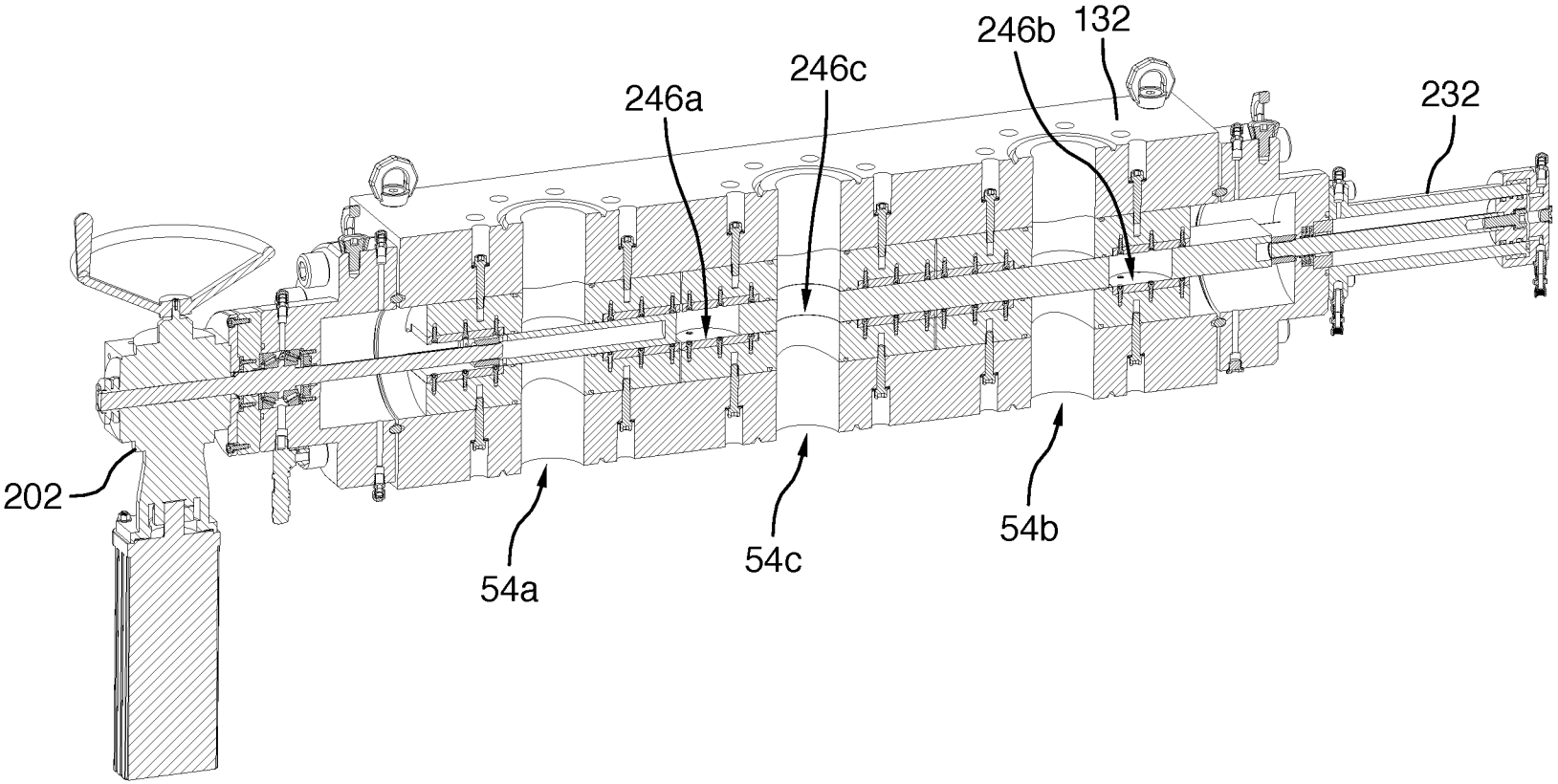

FIGS. 13, 14B, and 16C show a sample embodiment where the first block valve 132 is in the third position, in which openings 246*a*,246*b* are misaligned with passageways 54*a*,54*b*, respectively, such that passageways 54*a*,54*b* are blocked by the body 245 of the slab gate 244, and opening 246*c* is aligned with passageway 54*c*. As a result, in this embodiment, passageway 54*c* is open and passageways 54*a*,54*b* are closed so fluid can flow through passageway 54*c* but not passageways 54*a*,54*b*. FIG. 16A shows a sample embodiment where the first block valve 132 is in the first position, in which openings 246*b*,246*c* are misaligned with passageways 54*b*,54*c*, respectively, and opening 246*a* is aligned with passageway 54*a*. As a result, in this embodiment, fluid can flow through passageway 54*a* but not passageways 54*b*,54*c*. FIG. 16B shows a sample embodiment where the first block valve 132 is in the second position, in which openings 246*a*,246*c* are misaligned with passageways 54*a*,54*c*, respectively, and opening 246*b* is aligned with passageway 54*b*. As a result, in this embodiment, fluid can flow through passageway 54*b* but not passageways 54*a*,54*c*.

In some embodiments, the axial movement of slab gate 244, which is controllable by actuator 202, can operate the first hydraulic assembly 232, which will be discussed in more detail below.

In some embodiments, the second block valve 136 has a similar configuration as the first block valve 132. In the sample embodiment shown in FIG. 17 the second block valve 136 comprises a housing 280 having an outer housing 282*a* and an inner housing 282*b*, each extending between a first end 238*a* and a second end 238*b* of the second hydraulic assembly 236. While the illustrated embodiment shows inner housing 282*b* as a separate component positioned inside outer housing 282*a*, outer housing 282*a* and inner housing 282*b* may be integrally formed as a single component in other embodiments. Outer housing 282*a* and inner housing 282*b* have aligned apertures to define the first fluid passageway 74*a*, second fluid passageway 74*b*, and third fluid passageway 74*c* of the second block valve 136.

The second block valve 136 further comprises a valve control mechanism. In the illustrated embodiment, the valve control mechanism of block valve 136 is a slab gate 284 having an elongated body 285 extending axially in inner housing 282*b*, between ends 238*a*,238*b*. A first opening 286*a*, a second opening 286*b*, and a third opening 286*c* are defined in the body 285. In this sample embodiment, the movement of the slab gate 284 of the second block valve 136 is not driven by an actuator. Instead, the second hydraulic assembly 236, in cooperation with the first hydraulic assembly 232, is operable to move the slab gate 284 axially within the inner housing 282*b* among a first, second, and third positions, and any other axial position between the first and second ends 238*a*,238*b*. Alternative configurations and/or forms of the valve control mechanism in block valve 136 are possible.

The first, second, and third openings 286*a*,286*b*,286*c* are spaced apart and positioned relative to the first, second, and third passageways 74*a*,74*b*,74*c* between the first and second ends 238*a*,238*b* such that when one of the openings 286*a*, 286*b*,286*c* is aligned (i.e. substantially co-axial) with one of the passageways 74*a*,74*b*,74*c*, the remaining openings are not aligned (or "misaligned") with the remaining passageways. When one of the openings 286*a*,286*b*,286*c* is aligned with one of the passageways 74*a*,74*b*,74*c*, the aligned passageway is in an open position in which fluid flow is permitted therethrough. When a passageway 74*a*,74*b*,74*c* is blocked by the body 285 of the slab gate 284, the blocked passageway is in a closed position in which fluid flow therethrough is restricted (or at least reduced).

Figure 17:
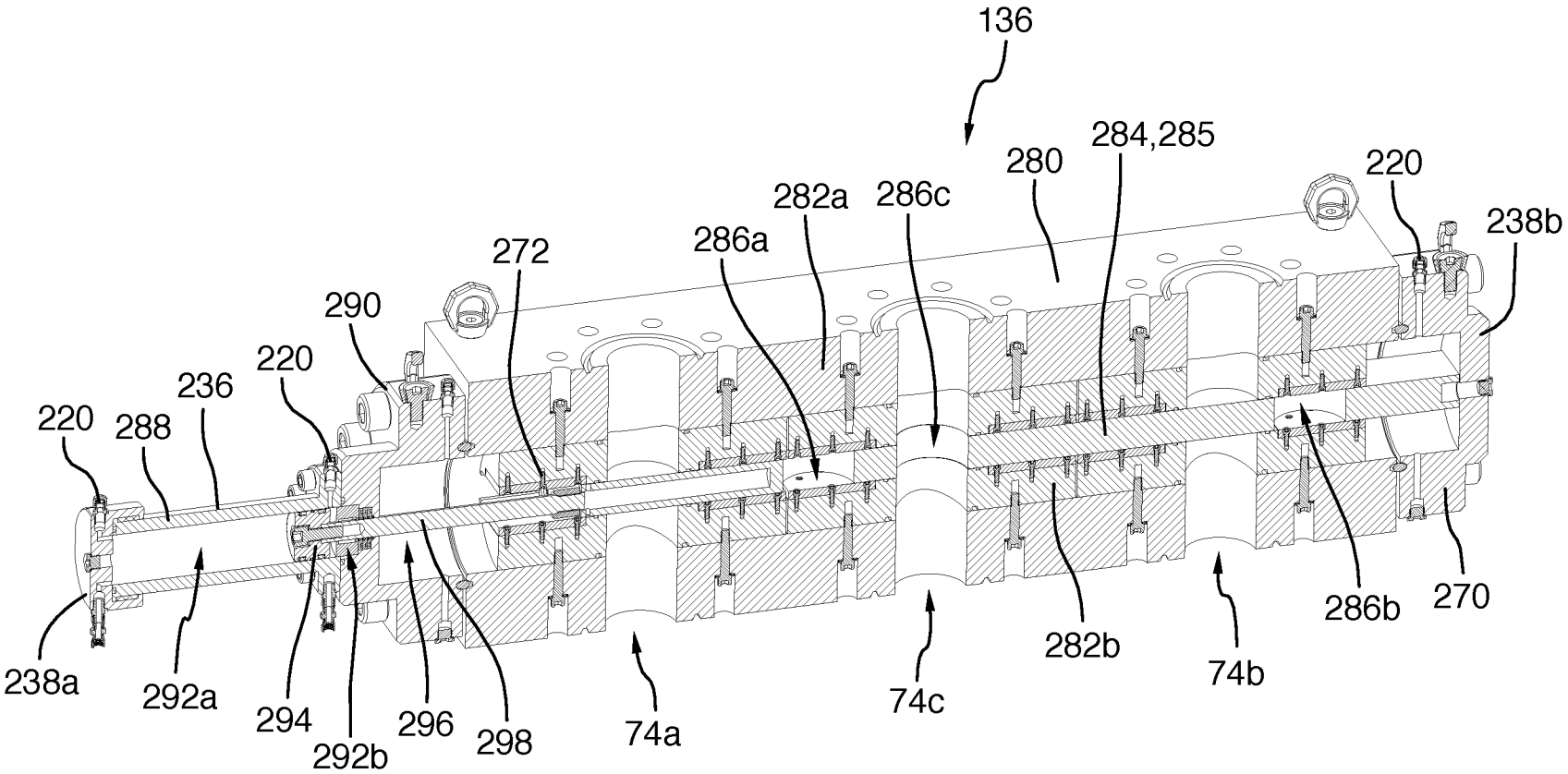
FIG. 17 is a cross-sectional view of the second block valve shown in FIG. 10.

FIG. 17 shows a sample embodiment where the second block valve 136 is in the third position, in which openings 286*a*,286*b* are misaligned with passageways 74*a*,74*b*, respectively, such that passageways 74*a*,74*b* are blocked by the body 285 of the slab gate 284, and opening 286*c* is aligned with passageway 74*c*. As a result, in this embodiment, passageway 74*c* is open and passageways 74*a*,74*b* are closed so fluid can flow through passageway 74*c* but not passageways 74*a*,74*b*. While not shown but can be appreciated by the skilled person, when the second block valve 136 is in the first position, openings 286*b*,286*c* are misaligned with passageways 74*b*,74*c*, respectively, and opening 286*a* is aligned with passageway 74*a*. As a result, when the second block valve 136 is in the first position, fluid can flow through passageway 74*a* but not passageways 74*b*,74*c*. Further, when the second block valve 136 in the second position, openings 286*a*,286*c* are misaligned with passageways 74*a*,74*c*, respectively, and opening 286*b* is aligned with passageway 74*b*. As a result, when the second block valve 136 is in the second position, fluid can flow through passageway 74*b* but not passageways 74*a*,74*c*.

In some embodiments, the valve control mechanisms of the first and second block valves 132,136 are controllable by separate actuators such that the first and second block valves are independently operable. In other embodiments, the first and second block valves 132,136 are configured to operate together such that the respective slab gates 244,284 can move in a synchronized manner. In some embodiments, for example as shown in FIGS. 10, 11, 13, and 17, the first and second block valves 132,136 are controllable by a single actuator 202 and the first and second hydraulic assemblies 232,236 are interconnected such that axial movement of the slab gate 244 of the first block valve 132 can translate to substantially equal axial movement of the slab gate 284 of the second block valve 136, and vice versa.

With reference to FIG. 13, the first hydraulic assembly 232 has a hydraulic cylinder 248 at its second end 234*b*. Hydraulic cylinder 248 has a hydraulic chamber defined therein and a piston 254 movable axially within the chamber. The hydraulic chamber has a piston-front portion 252*a* and a piston-back portion 252*b*. The piston-front portion 252*a* is between the inner surface of the hydraulic cylinder 248 and a front face of the piston 254; the piston-back portion 252*b* is defined between the inner surface of the hydraulic cylinder 248 and a rear face of the piston 254. In the illustrated embodiment, the front face of the piston 254 faces the second end 234*b* and the rear face of the piston 254 faces away from the second end 234*b*. In alternative embodiments, the rear face faces the second end 234*b* and the front face faces away from the second end 234*b*. Thus, axial movement of the piston 254 increases or decreases the volume of the piston-front portion 252*a* while correspondingly decreases or increases, respectively, the volume of the piston-back portion 252*b*.

The piston 254 is operably coupled to the slab gate 244 such that axial movement of the slab gate 244 translates to a substantially equal axial movement of the piston 254. In the illustrated embodiment, the piston 254 comprises a rod 258 extending from the rear face of the piston and an end of the rod 258 is connected to one end of the slab gate 244.

The first hydraulic assembly 232 comprises the first flange 260 disposed at a first end of the housing 240, and a second flange 250 positioned between a second end of the housing 240 and the hydraulic cylinder 248. The slab gate 244 is thus movable between the inner surface of flanges 250,260. A hydraulic chamber 256 is defined between the inner surface of flanges 250,260, the ends of housing 240, and the ends of the slab gate 244.

In one embodiment, the flange 250 is connected to the second end of housing 240 and the hydraulic cylinder 248 is connected to the flange 250. The flange 250 has an opening through which the rod 258 of the piston 254 extends to connect and engage with slab gate 244. In the illustrated embodiment, a second end 262 of the slab gate 244 is coupled to the piston rod 258. The volume of chamber 256 may increase or decrease depending on the axial position of the slab gate 244. The interface between the opening in flange 250 and the piston 254 may be fluidly sealed by one or more seals. In some embodiments, the piston-front portion 252*a*, the piston-back portion 252*b*, and the hydraulic chamber 256 are filled with hydraulic fluid. In further embodiments, the hydraulic fluid is substantially incompressible.

With reference to FIG. 17, the second hydraulic assembly 236 has a hydraulic cylinder 288 at its first end 238*a*. Hydraulic cylinder 288 has a hydraulic chamber defined therein and a piston 294 movable axially within the chamber. The hydraulic chamber has a piston-front portion 292*a* and a piston-back portion 292*b*. The piston-front portion 292*a* is between the inner surface of the hydraulic cylinder 288 and a front face of the piston 294; the piston-back portion 292*b* is defined between the inner surface of the hydraulic cylinder 288 and a rear face of the piston 294. In the illustrated embodiment, the front face faces the first end 238*a* and the rear face faces away from the first end 238*a*. In alternative embodiments, the rear face faces the first end 238*a* and the front face faces away from the first end 238*a*. Thus, axial movement of the piston 294 increases or decreases the volume of the piston-front portion 292*a* while correspondingly decreases or increases, respectively, the volume of the piston-back portion 292*b*.

The piston 294 is operably coupled to the slab gate 284 such that axial movement of the piston 294 can translate to substantially equal axial movement of the slab gate 284. In the illustrated embodiment, the piston 294 comprises a rod 298 extending from the rear face of the piston 294 and an end of the rod 298 is connected to one end of the slab gate 294.

The second hydraulic assembly 236 comprises a first flange 290 positioned between a first end of the housing 280 and the hydraulic cylinder 288 and a second flange 270 disposed at a second end of the housing 280. The slab gate 294 is thus movable between the inner surface of flanges 270,290. A hydraulic chamber 296 is defined between the inner surface of flanges 270,290, the ends of housing 280, and the ends of the slab gate 284.

In one embodiment, the flange 290 is connected to the first end of housing 280 and the hydraulic cylinder 288 is connected to the flange 290. The flange 290 has an opening through which the rod 298 of the piston 294 extends to connect and engage with slab gate 284. In the illustrated embodiment, a second end 272 of the slab gate 284 is coupled to the piston rod 298. The volume of chamber 296 may increase or decrease depending on the axial position of the slab gate 284. The interface between the opening in flange 290 and the piston 294 may be fluidly sealed by one or more seals. In some embodiments, the piston-front portion 292*a*, the piston-back portion 252*b*, and the hydraulic chamber 296 are filled with hydraulic fluid. In further embodiments, the hydraulic fluid is substantially incompressible.

With reference to FIGS. 10, 11, 13, and 17, hydraulic lines 204*a*,204*b* fluidly connect the first hydraulic assembly 232 to the second hydraulic assembly 236. The equalizer line 206 can allow fluid communication between the space inside block 132 (i.e. chamber 256) and the space inside block 136 (i.e. chamber 296). In some embodiments, chambers 256, 259 contain lubrication fluid. The movement of internal components, for example the valve control mechanisms, within blocks 132,136 may increase or decrease the volume of chambers 256,296 inside the blocks 132,136 so equalizer line 206 can allow the lubrication fluid to flow between the blocks 132,136 as the internal components move. For example, if axial movement of slab gate 244 decreases the volume inside block 132, lubrication fluid will be urged to flow from block 132 to block 136 via equalizer line 206. Chambers 256,296 and equalizer line 206 can thus form a closed system in which a fixed amount of lubrication fluid can flow back and forth between the blocks 132,136.

In the illustrated embodiment, hydraulic line 204*a* fluidly connects the piston-front portions 252*a*,292*a* of hydraulic assemblies 232,236, respectively, such that piston-front portions 252*a*,292*a* and hydraulic line 204*a* form a closed system in which a fixed amount of hydraulic fluid can flow back and forth between piston-front portions 252*a*,292*a*. Thus, if axial movement of the piston 254 decreases the volume of the piston-front portion 252*a*, hydraulic fluid will be urged flow from piston-front portion 252*a* to the piston-front portion 292*a* via hydraulic line 204*a*. The hydraulic fluid transferred to the piston-front portion 292*a* in turn urges the piston 294 to move axially, expanding the volume of the piston-front portion 292*a* by the same amount as the volume decrease in piston-front portion 252*a*. Accordingly, a decrease in volume of the piston-front portion 252*a* translates to a corresponding increase of the same volume in the piston-front portion 292*a*, and vice versa.

In the illustrated embodiment, hydraulic line 204*b* fluidly connects the piston-back portions 252*b*,292*b* of hydraulic assemblies 232,236, respectively, such that piston-back portions 252*b*,292*b* and hydraulic line 204*b* form a closed system in which a fixed amount of hydraulic fluid can flow back and forth between piston-back portions 252*b*,292*b*. Thus, if axial movement of the piston 254 decreases the volume of the piston-back portion 252*b*, hydraulic fluid will be urged flow from piston-back portion 252*b* to the piston-back portion 292*b* via hydraulic line 204*b*. The hydraulic fluid transferred to the piston-back portion 292*b* in turn urges the piston 294 to move axially, expanding the volume of the piston-back portion 292*b* by the same (or substantially the same) amount as the volume decrease in piston-back portion 252*b*. Accordingly, a decrease in volume of the piston-back portion 252*b* translates to a corresponding increase of the same (or substantially the same) volume in the piston-back portion 292*b*, and vice versa. Therefore, if the hydraulic cylinders 248,288 are the same size and the pistons 254,294 are the same size, axial movement of piston 254 by a certain distance can effect an equal axial movement of piston 294 by the same distance, and vice versa.

The corresponding axial movement of the pistons 254,294 may be in the same, different, or opposite direction, depending on the orientation of the block valves 132,136, the hydraulic assemblies 232,236, and the angle from which the block valves 132,136 are viewed. In the illustrated embodiment, as best shown in FIG. 11, the first and second block valves 132,136 are oriented so that the pistons 254,294 can move in sync in the same direction, when viewed from the top. For example, if the piston 254 moves towards the second end 234*b* of the first hydraulic assembly 232, the piston 294 can also move towards the second end 238*b* of the second hydraulic assembly, which is adjacent to second end 234*b*.

For example, with reference to FIGS. 10, 11, 13, 16, and 17, when it is desirable to move the first and second block valves 132,136 from the third position (as shown in FIGS. 13, 16C, and 17) to the second position (as shown in FIG. 16B), the slab gate 244 of the first block valve 132 can be driven by the actuator 202 to move axially towards the first end 234*a* until the opening 246*b* of slab gate 244 aligns with passageway 54*b*. As slab gate 244 moves axially towards the first end 234*a*, the volume of chamber 256 increases, thereby drawing hydraulic fluid from chamber 296 into chamber 256 via equalizer line 206, which in turn decreases the volume of chamber 296. At the same time, the axial movement of slab gate 244 also moves the piston 254 of the first hydraulic assembly 232 axially towards the first end 234*a*, thereby increasing the volume of the piston-front portion 252*a*, and in turn drawing hydraulic fluid from the piston-front portion 292*a* into piston-front portion 252*a* via hydraulic line 204*a*. The transfer of hydraulic fluid from piston-front portion 292*a* to piston-front portion 252*a* urges the piston 294 to move axially towards the first end 238*a*, which in turn pulls the slab gate 284 axially towards the first end 238*a*. Since the axial movement of piston 254 translates to the same (or substantially the same) amount of axial movement of piston 294 (and provided that the openings 246*a*,246*b*,246*c* and 286*a*,286*b*,286*c* of the slab gates 244,284, respectively, and the passageways 54*a*,54*b*,54*c* and 74*a*,74*b*,74*c* have the same or similar spacing), when opening 246*b* of slab gate 244 is aligned with passageway 54*b* of block valve 132, opening 286*b* of slab gate 284 is correspondingly aligned with passageway 74*b* of block valve 136, and the first and second block valves 132,136 are in the second position.

With reference to FIGS. 3 to 9, 13, and 17, when the first and second block valves 132,136 are in the first position, fluid is permitted to flow through the first choke 30*a*, with passageway 54*a* receiving fluid from spool 52*a* and supplying the fluid to the first choke 30*a* via spool 58*a*, and passageway 74*a* receiving fluid from the first choke 30*a* via spool 66*a*; in the second position, fluid is permitted to flow through the second choke 30*b*, with passageway 54*b* receiving fluid from spool 52*b* and supplying the fluid to the second choke 30*b* via spool 58*b*, and passageway 74*b* receiving fluid from the second choke 30*a* via spool 66*b*; and in the third position, fluid is permitted to flow through the choke gut line 34, with passageway 54*c* receiving fluid from spool 52*c* and supplying the fluid to the choke gut line 34 via spool 58*c*, and passageway 74*c* receiving fluid from the choke gut line 34 via spool 66*c*. In the first position, fluid is permitted to exit the block valve 136 via passageway 74*a* and into spool 78*a*. In the second position, fluid is permitted to exit the block valve 136 via passageway 74*b* and into spool 78*b*. In the third position, fluid is permitted to exit the block valve 136 via passageway 74*c* and into spool 78*c*.

In some embodiments, the hydraulic system 200 may further comprise evacuation ports 220 for releasing air in the hydraulic system 200 to minimize or eliminate any compliance in the hydraulic communication between the first and second hydraulic assemblies 232,236. In some embodiments, it may be desirable to discard any air in the hydraulic system 200 such that the first and second hydraulic assemblies 232,236 may rigidly sync, such that axial movement of one of the slab gates 244,284 may translates to an equal axial movement of the other slab gate, and the movements of the slab gates 244,284 are can be substantially simultaneous.

In some embodiments, the hydraulic system 200 may further comprise one or more position sensors as part of a monitoring system to monitor the syncing of the first and second hydraulic assemblies 232,236 to ensure that the positions of the respective slab gates 244,284 are substantially the same at any given time. In some embodiments, the one or more position sensors may be placed on one or both of slab gates 244,284 or elsewhere in the first and/or second hydraulic assemblies 232,236. In some embodiments, the position sensors may be paired with a pressure sensor to help detect leakage of hydraulic fluid in the first and/or second hydraulic assemblies.

In some embodiments, the third block valve 142 may have a similar configuration as the first block valve 132. In the sample embodiment shown in FIGS. 3 and 18, the third block valve 142 comprises a housing 340 having an outer housing 342*a* and an inner housing 342*b*, each extending between a first end 334*a* and a second end 334*b* of the third block valve 142. While the illustrated embodiment shows inner housing 342*b* as a separate component positioned inside outer housing 342*a*, outer housing 342*a* and inner housing 342*b* may be integrally formed as a single component in other embodiments. Outer housing 342*a* and inner housing 342*b* have aligned apertures to define the first fluid passageway 154*a*, second fluid passageway 154*b*, and third fluid passageway 154*c* of the third block valve 142.

The third block valve 142 further comprises a valve control mechanism. In the illustrated embodiment, the valve control mechanism of block valve 142 comprises a gate valve having a slab gate 344 that has an elongated body 345 extending axially in inner housing 342*b*, between ends 334*a*,334*b*. A first opening 346*a*, a second opening 346*b*, and a third opening 346*c* are defined in the body 345. The actuator 302 is operable to move the slab gate 344 axially within the inner housing 342*b* between a first position, a second position, and any other axial position between the first and second ends 334*a*,334*b*. In some embodiments, a first end of the slab gate 344 is coupled to the actuator 302 to allow the actuator 302 to exert axial force on the slab gate 344. Alternative configurations and/or forms of the valve control mechanism of block valve 142 are possible.

The first, second, and third openings 346*a*,346*b*,346*c* are spaced apart and positioned relative to the first, second, and third passageways 154*a*,154*b*,154*c* between the first and second ends 334*a*,334*b* such that when openings 346*a*,346*c* are aligned with passageways 154*a*,154*c*, respectively, opening 346*b* is not aligned with passageway 154*b*; when opening 346*b* is aligned with passageways 154*b*, openings 346*a*,346*c* are not aligned with passageways 154*a*,154*c*, respectively; and when opening 346*a* is aligned with passageway 154*a*, opening 346*c* is also aligned with passageway 154*c*. When one of the openings 346*a*,346*b*,346*c* is aligned with one of the passageways 154*a*,154*b*,154*c*, the aligned passageway is in an open position in which fluid flow is permitted therethrough. When a passageway 154*a*, 154*b*,154*c* is blocked by the body 345 of the slab gate 344, the blocked passageway is in a closed position in which fluid flow therethrough is restricted (or at least reduced).

Figure 18:
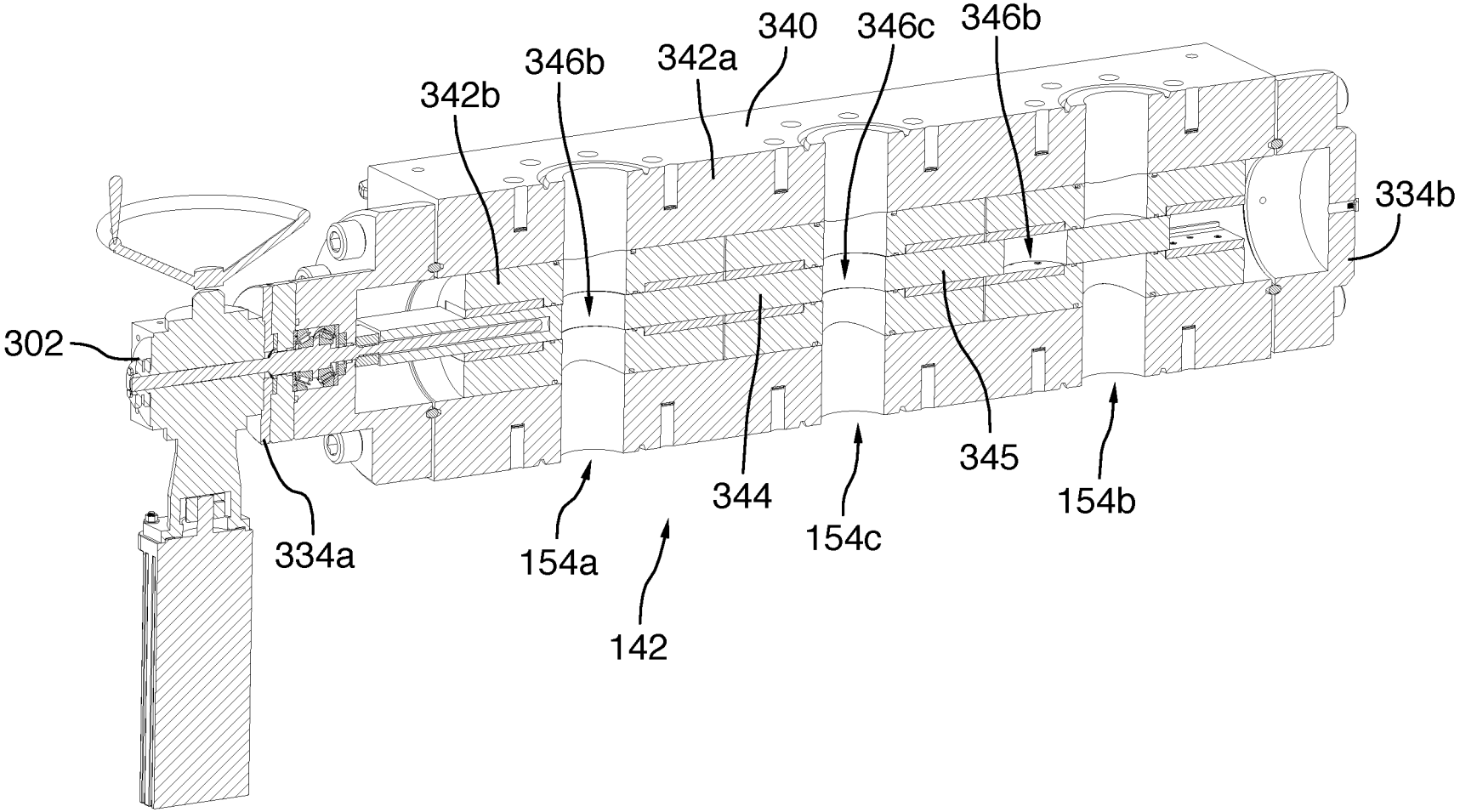
FIG. 18 is a cross-sectional view of a third block valve of the MPD manifold of the present disclosure, according to one embodiment.

FIG. 18 shows a sample embodiment where the third block valve 142 is in the first position, in which opening 346*b* is misaligned with passageway 154*b*, such that passageway 154*b* is blocked by the body 345 of the slab gate 344, and openings 346*a*,346*c* are aligned with passageways 154*a*,154*c*, respectively. As a result, in this embodiment, passageway 154*b* is closed and passageways 154*a*,154*c* are open so fluid can flow through passageways 154*a*,154*c* but not passageway 154*b*. While not shown but can be appreciated by the skilled person, when the third block valve 142 is in the second position, openings 346*a*,346*c* are misaligned with passageways 154*a*,154*c*, respectively, and opening 346*b* is aligned with passageway 154*b*. As a result, when the third block valve 142 is in the second position, fluid can flow through passageway 154*b* but not passageways 154*a*,154*c*.

Accordingly, with reference to FIGS. 3 to 9 and 18, when the third block valve is in the first position, fluid is permitted to flow through the flowmeter 40, with passageway 154*a* receiving fluid from spool 82*a* and supplying the fluid to the inlet 90 of the flowmeter 40, and passageway 154*c* receiving fluid from the outlet 92 of the flowmeter via tubing 94; in the second position, passageway 154*b* can receive fluid from spool 82*b* and can supply the fluid to the flowmeter gut line 44. In the first position, fluid is permitted to exit the block valve 142 via passageway 154*c*. In the second position, fluid is permitted to exit the block valve 142 via passageway 154*b*.

In some embodiments, one or both of actuator 202 of the first block valve 132 and actuator 302 of the third block valve 142 are drivable by an electric motor that can be controlled remotely. In further embodiments, one or both of actuators 202,302 may include a handwheel to allow an operator to manually control the block valves 132,142 in case of motor failure and/or power outage. In further embodiments, one or both of actuators 202, 302 are an electrical actuator, a hydraulic actuator, a pneumatic actuator, or a combination thereof. In some embodiments, one or both of actuators 202,302 are actuatable directly with an electric motor, by hydraulic force, or by pneumatic force (e.g. compressed gas pressure).

Figure 19:
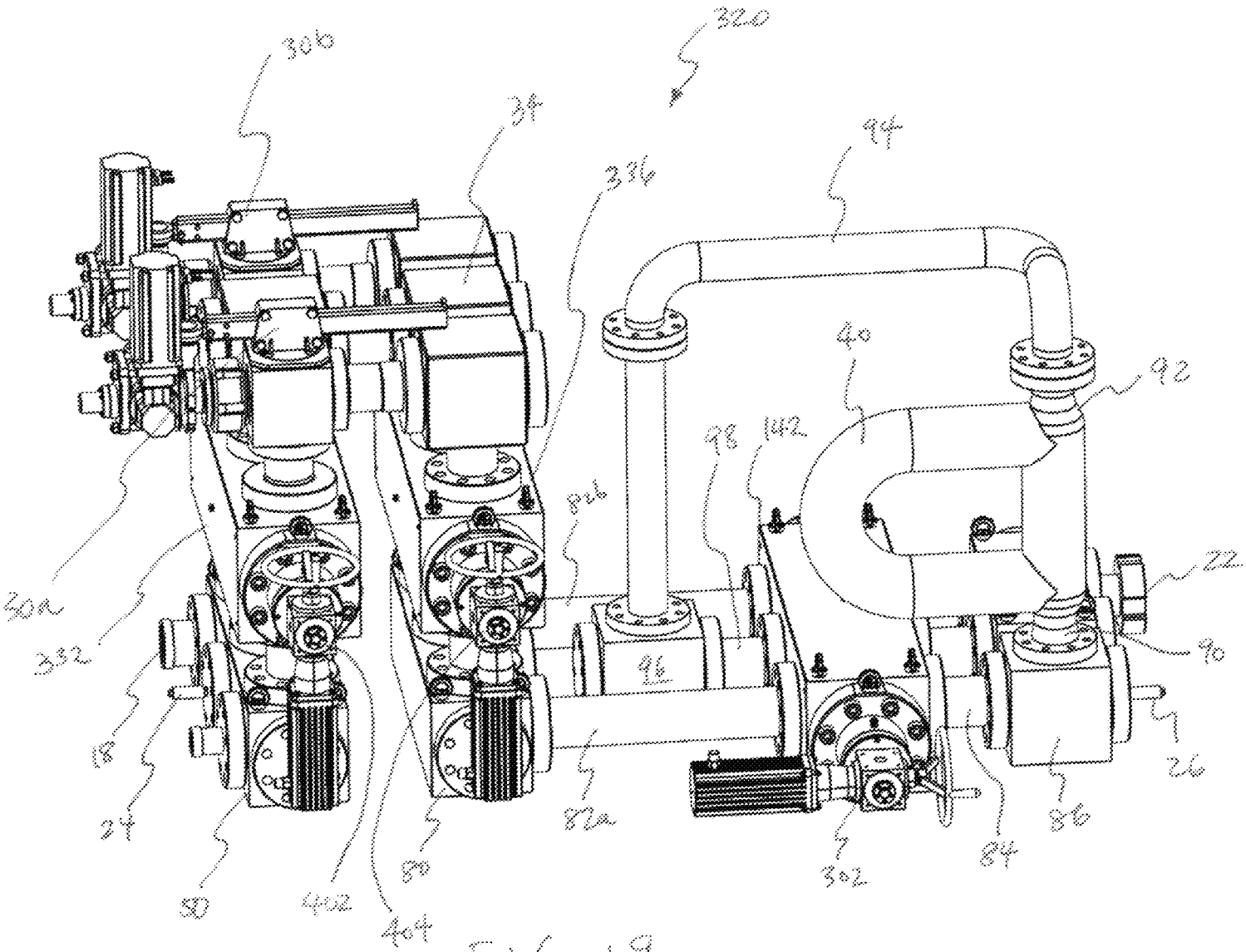
FIG. 19 is a perspective view of a sample configuration of the MPD manifold of FIG. 2 according to another embodiment of the present disclosure.

FIG. 19 shows an alternative MPD manifold 320 wherein the first and second block valves are not hydraulically connected but are independently controllable by respective actuators. In the illustrated embodiment, the manifold 320 comprises the same components as manifold 120, except another embodiment of a first block valve 332 and a second block valve 336 are included instead of block valves 132, 136. The first block valve 332 is controllable by an actuator 402 and the second block valve 336 is controllable by a second actuator 404. In some embodiments, the actuators 402,404 can actuate the block valves 332,336 electrically. The actuator 402 is configured to place the first block valve 332 in different positions (e.g. a first position, a second position, and a third position). The second actuator 404 is configured to place the second block valve 336 in different positions (e.g. a first position, a second position, and a third position). In some embodiments, the actuators 402,404 are independently operable. In some embodiments, the actuators 402,404 are controllable by a control unit such that the operation of the actuators 402,404 can be synchronized electrically. In some embodiments, each of actuators 402, 404 may have a position sensor for monitoring the position of the valve control mechanism, the position of the valve, and/or the synchronization of the actuators. In the illustrated embodiment, the first and second block valves 332,336 are substantially the same so only the first block valve 332 will be described in detail.

Figure 20A:
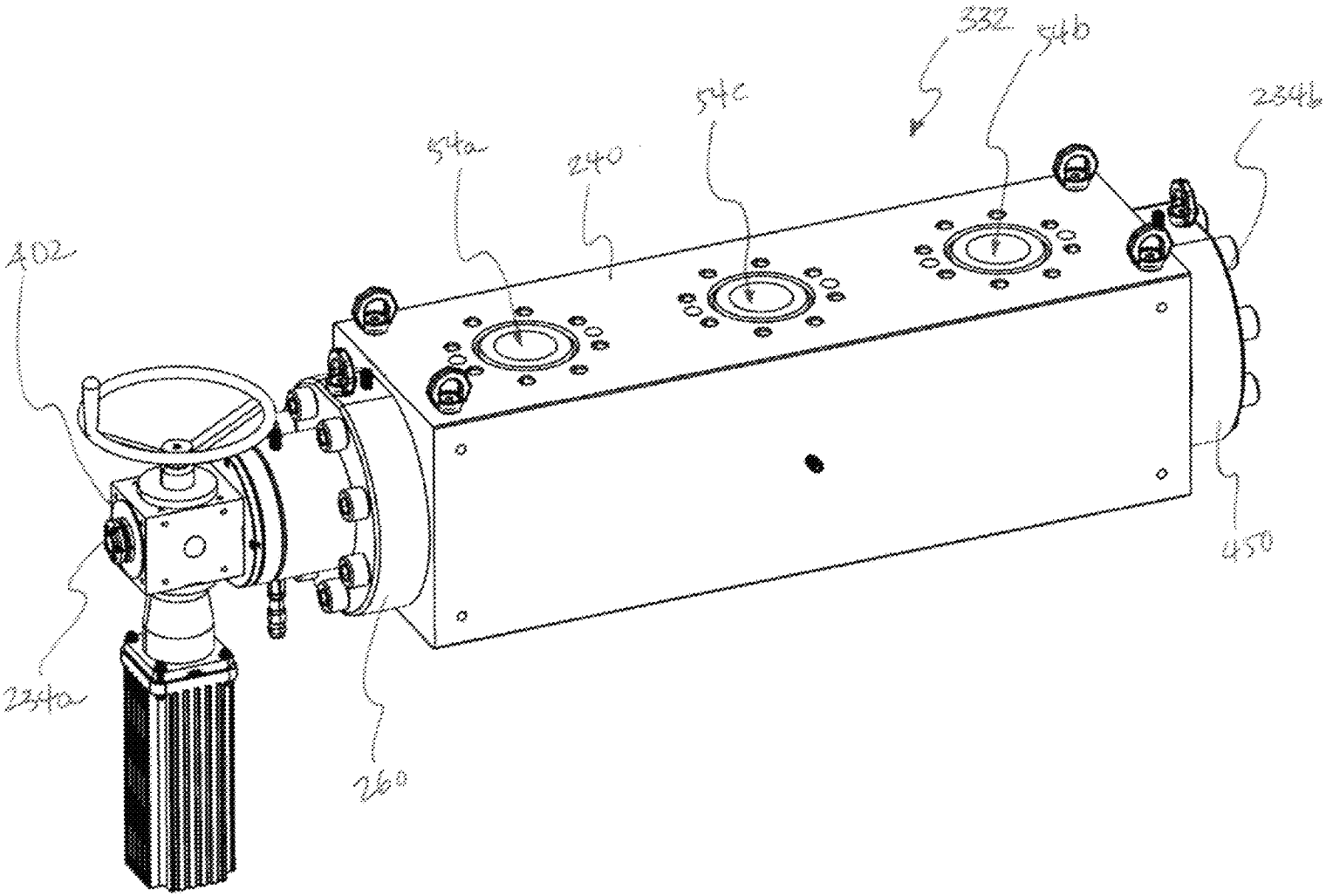
FIGS. 20A and 20B are a perspective view and a perspective cross-sectional view, respectively, of the first block valve shown in FIG. 19.

With reference to the sample embodiment shown in FIG. 20, the first block valve 332 comprises a housing 240 having an outer housing 242*a* and an inner housing 242*b*, each extending between a flange 260 of the actuator 402 positioned at a first end 234*a* of the first block valve 332 and a flange 450 at a second end 234*b* of the first block valve 332. Housing 240 is as described above with respect to the first block valve 132 and has defined therein the first fluid passageway 54*a*, second fluid passageway 54*b*, and third fluid passageway 54*c* of the first block valve 132.

The first block valve 332 further comprises a valve control mechanism. In the illustrated embodiment shown in FIG. 20, the valve control mechanism is a slab gate 244, which is as described above with respect to the first block valve 132 and has defined therein a first opening 246*a*, a second opening 246*b*, and a third opening 246*c*. The actuator 402 is operable to move the slab gate 244 axially within the inner housing 242*b* among a first, second, and third positions, and any other axial position between the first and second ends 234*a*,234*b*. Alternative configurations and/or forms of the valve control mechanism are possible.

Figure 20B:
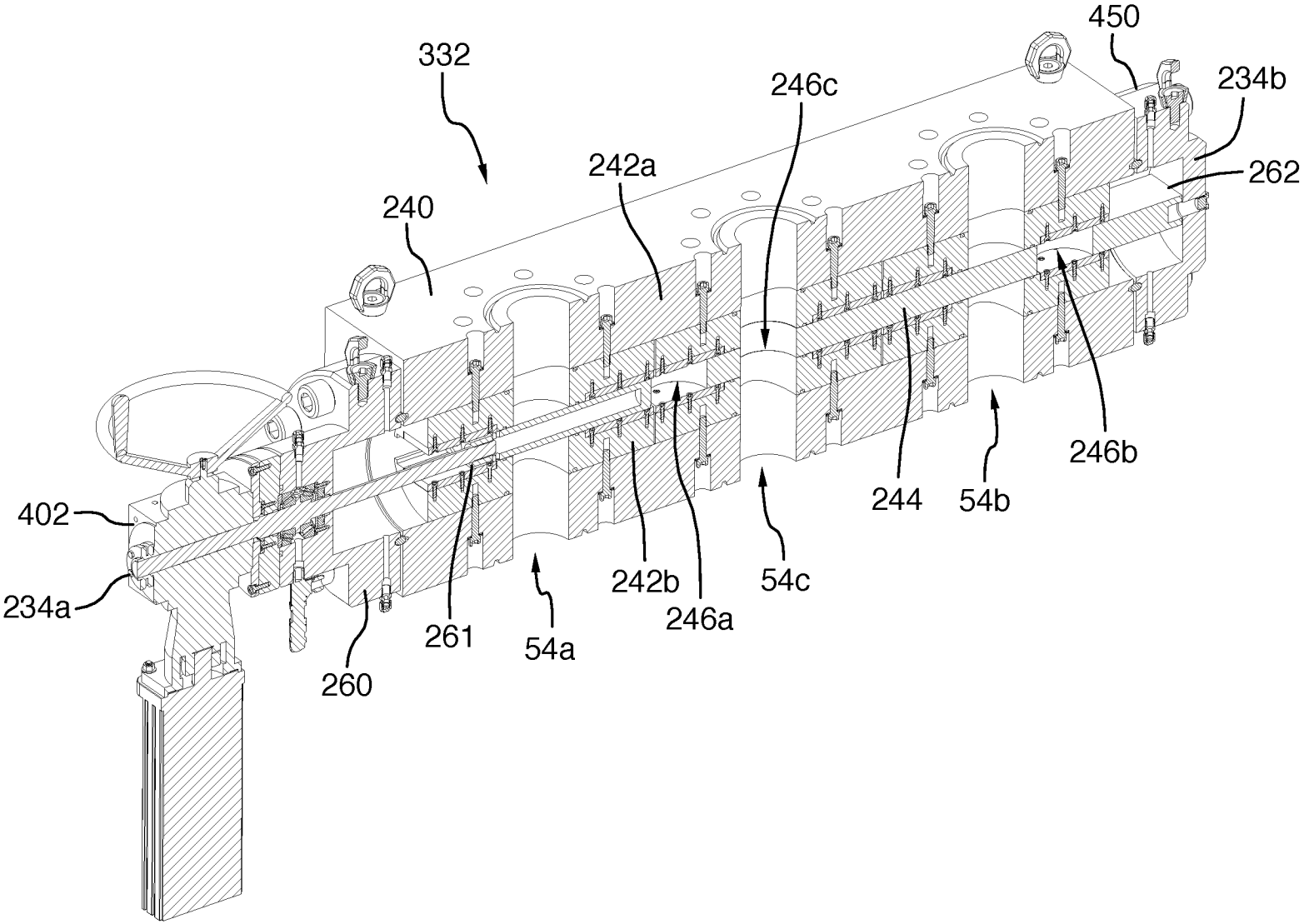

The first, second, and third openings 246*a*,246*b*,246*c* are spaced apart and positioned relative to the first, second, and third passageways 54*a*,54*b*,54*c* as describe above with respect to the first block valve 132. In FIG. 20B, the first block valve 332 is shown in the third position, in which openings 246*a*,246*b* are misaligned with passageways 54*a*, 54*b*, respectively, such that passageways 54*a*,54*b* are blocked by the body 245 of the slab gate 244, and opening 246*c* is aligned with passageway 54*c*. As a result, in this embodiment, passageway 54*c* is open and passageways 54*a*,54*b* are closed so fluid can flow through passageway 54*c* but not passageways 54*a*,54*b*.

In the illustrated embodiment, the first end 261 of the slab gate 244 is operably coupled to the actuator 402 and the second end 262 is free. The actuator 402 is operable to move slab gate 244 axially between the inner surface of flanges 450,260. In some embodiments, the second end 262 may abut against the inner surface of flange 450 when the block valve 332 is in one of the three positions, for example the third position as shown in FIG. 20B.

In some embodiments when the first block valve 132,332 is not in one of the first, second, and third positions (i.e. when the first block valve is in between positions), one or more openings 246*a*,246*b*,246*c* may be partially aligned (i.e. not co-axial) with one or more passageways 54*a*,54*b*,54*c* such that one or more passageways 54*a*,54*b*,54*c*, while not fully open, may be partially open to allow some fluid to flow therethrough. In some embodiments, two or more passageways 54*a*,54*b*,54*c* may be partially open at a given time while the first block valve is in between positions. The second and third block valves 136,336,142 may be similarly configured in this respect in some embodiments. The manifold 120,320 may thus be configured such that not all of the passageways are fully blocked during the transition between any two valve positions, thereby allowing a smoother transition between the valve positions, which may be beneficial in reducing the magnitude and/or frequency of or may substantially prevent sudden spikes or drops in fluid pressure in the wellbore as the manifold 120,320 redirects fluid flow therethrough.

While the illustrated embodiment shows the first and second block valves each having three passageways and three positions, the first and second block valves may be configured to have fewer or more passageways and/or positions in other embodiments, for example by changing the valve control mechanism (e.g. altering the spacing of the openings in the slab gate and/or shortening or lengthening the slab gate); changing the spacing of the passageways in the block valve housing; removing or adding passageways in the block valve housing; and/or shortening or lengthening the length of the block valve housing. In some embodiments, the first and second block valves may each have six passageways. In an additional or alternative embodiment, the first and second block valves have a fourth position wherein two or more of the passageways are open while the remaining passageways are closed. For example, having two or more passageways open at the same time may allow two or more chokes of the manifold to operate simultaneously to maintain backpressure in the wellbore. Likewise, while the illustrated embodiment shows the third block valve having three passageways and three positions, the third block valve may be configured to fewer or more passageways and/or positions in other embodiments.

While in the illustrated embodiment each of the block valves 132,332,136,336,142 comprises a single housing 240,290,340 having defined therein all the passageways, in other embodiments each block valve may comprise more than one housing, each having defined therein one or more passageways. The one or more separate housings of the block valve may be fluidly connected by flow blocks and/or spools. The opening and closing of the passageways in the one or more housings may be synced as described above or by other methods known to those skilled in the art. For example, in one embodiment, instead of housing 240, the first block valve 132 may comprise a first housing having passageway 54*a* defined therein, a second housing having passageway 54*b* defined therein, and a third housing having passageway 54*c* defined therein. In another sample embodiment, the first block valve 132 may comprise a first housing having passageways 54*a*,54*b* defined therein, and a second housing having passageway 54*c* defined therein. Separating the block valve into two or more housings may allow more compact configurations of the manifold. Further, separating the block valve into two or more housings may eliminate the need to use an equalizer line between block valves.

Figure 21B:
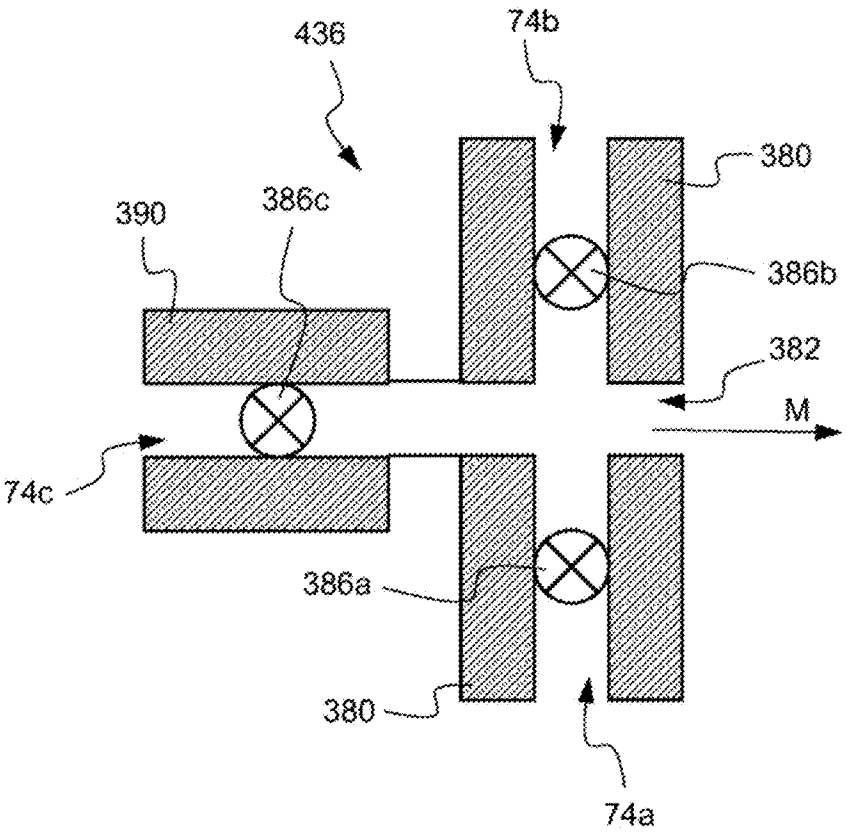
FIGS. 21A and 21B are schematic views of a first block valve and a second block valve, respectively, of the MPD manifold of the present disclosure, according to another embodiment.
Figure 21A:
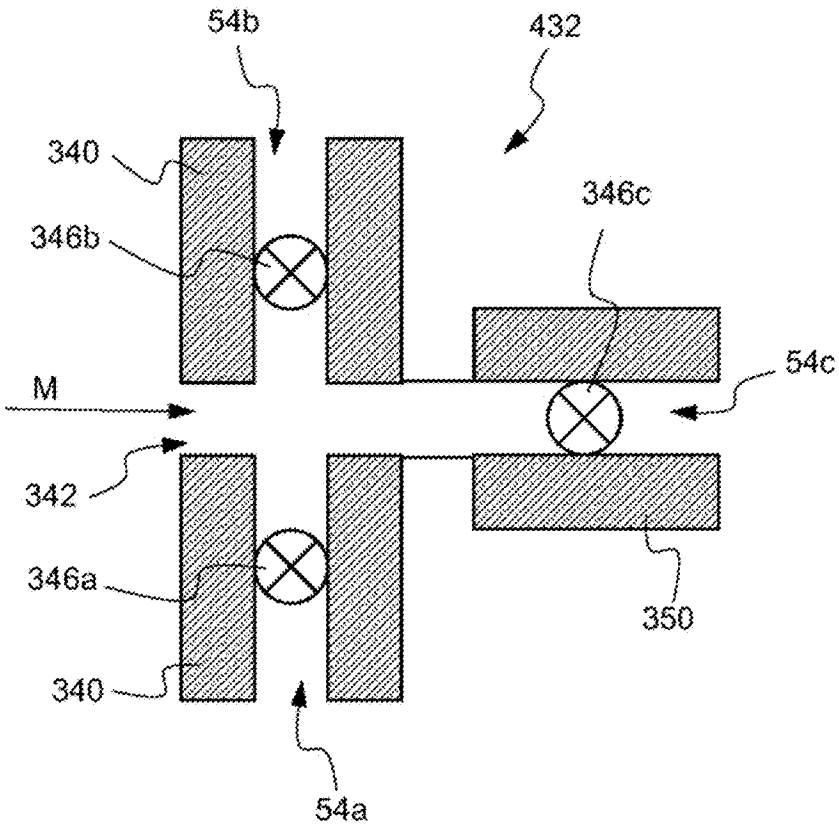

FIG. 21A illustrates an alternative first block valve 432 comprising a first housing 340 and a second housing 350. The first housing 340 has a main passageway 342 and first and second passageways 54*a*,54*b* define therein. Main passageway 342 is in fluid communication with passageways 54*a*,54*b*. Passageways 54*a*,54*b* are in fluid communication with first and second chokes 30*a*,30*b* via one or more spools and/or flow blocks. Each passageway 54*a*,54*b* has a valve 346*a*,346*b*, respectively, for controlling the opening and closing of the passageways 54*a*,54*b*. The second housing 350 has a passageway 54*c* defined therein. The passageway 54*c* has a valve 346*c* for controlling the opening and closing of passageway 54*c* and the passageway 54*c* is in fluid communication with the main passageway 342 and the choke gut line 34 via one or more spools and/or flow blocks. In some embodiments, the opening and closing of two or more valves 346*a*,346*b*,346*c* are synced. For example, valves 346*a*,346*b* are synced such that when passageway 54*a* is open, passageway 54*b* is closed, and vice versa.

FIG. 21B illustrates an alternative second block valve 436 comprising a first housing 380 and a second housing 390. The first housing 380 has a main passageway 382 and first and second passageways 74*a*,74*b* define therein. Main passageway 382 is in fluid communication with passageways 74*a*,74*b*. Passageways 74*a*,74*b* are in fluid communication with first and second chokes 30*a*,30*b* via one or more spools and/or flow blocks. Each passageway 74*a*,74*b* has a valve 386*a*,386*b*, respectively, for controlling the opening and closing of the passageways 74*a*,74*b*. The second housing 390 has a passageway 74*c* defined therein. The passageway 74*c* has a valve 386*c* for controlling the opening and closing of passageway 74*c* and the passageway 74*c* is in fluid communication with the main passageway 382 and the choke gut line 34 via one or more spools and/or flow blocks. In some embodiments, valve 386*c* is omitted and the fluid flow through passageways 54*c*,74*c* is controlled by valve 346*c* alone. In some embodiments, the opening and closing of two or more valves 386*a*,386*b*,386*c* are synced. For example, valves 386*a*,386*b* are synced such that when passageway 74*a* is open, passageway 74*b* is closed, and vice versa. In a further embodiment, the opening and closing of valves 346*a*,346*b* of the first block valve 432 and valves 386*a*,386*b* of the second block valve 436 are synced such that when passageways 54*a*,74*a* are open, passageways 54*b*,74*b* are closed, and vice versa. The syncing of valves may be achieved as described above or by any other method known to those skilled in the art.

In operation, with reference to FIG. 21, fluid enters first block valve 432 via an inlet of main passageway 342. The direction of fluid flow into the first block valve 432 and out of the second block valve 436 is denoted by the letter "M". If the first passageways 54*a*,74*a* are open and passageways 54*b*,54*c*,74*b*,74*c* are closed, fluid can flow through choke 30*a* via passageway 54*a* and exit the second block valve 436 via passageway 74*a* and main passageway 382. If the second passageways 54*b*,74*b* are open and passageways 54*a*,54*c*, 74*a*,74*c* are closed, fluid can flow through choke 30*b* via passageway 54*b* and exit the second block valve 436 via passageway 74*b* and main passageway 382. If the first and second passageways 54*a*,54*b*,74*a*,74*b* are closed and passageways 54*c*,74*c* are open, fluid can bypass both chokes 30*a*,30*b* and flow through choke gut line 34 via main passageway 342 and passageway 54*c* in housing 350, and can exit the second block valve 436 via passageway 74*c* in housing 390 and main passageway 382.

In some embodiments, the opening and closing of passageways 54*a*,74*a* are performed by a first valve control mechanism so that the opening and closing passageways 54*a*,74*b* can occur synchronously. In some embodiments, the opening and closing of passageways 54*b*,74*b* are performed by a second valve control mechanism so that the opening and closing passageways 54*b*,74*b* can occur synchronously. In some embodiments, the opening and closing of passageways 54*c*,74*c* are performed by a third valve control mechanism so that the opening and closing passageways 54*c*,74*c* can occur synchronously.

Figure 22:
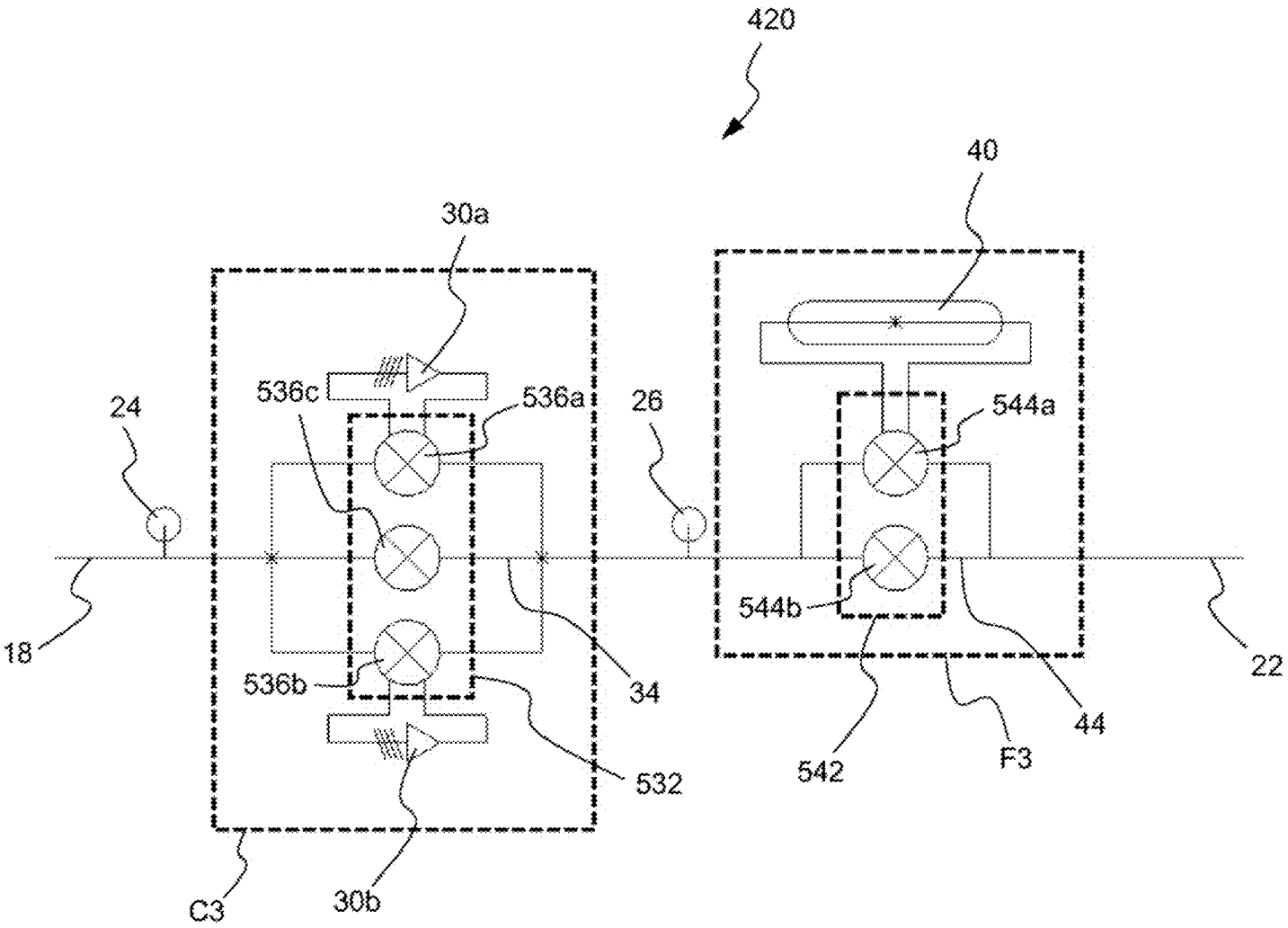
FIG. 22 is a schematic view of an MPD manifold according to another embodiment of the present disclosure.
Figure 23:
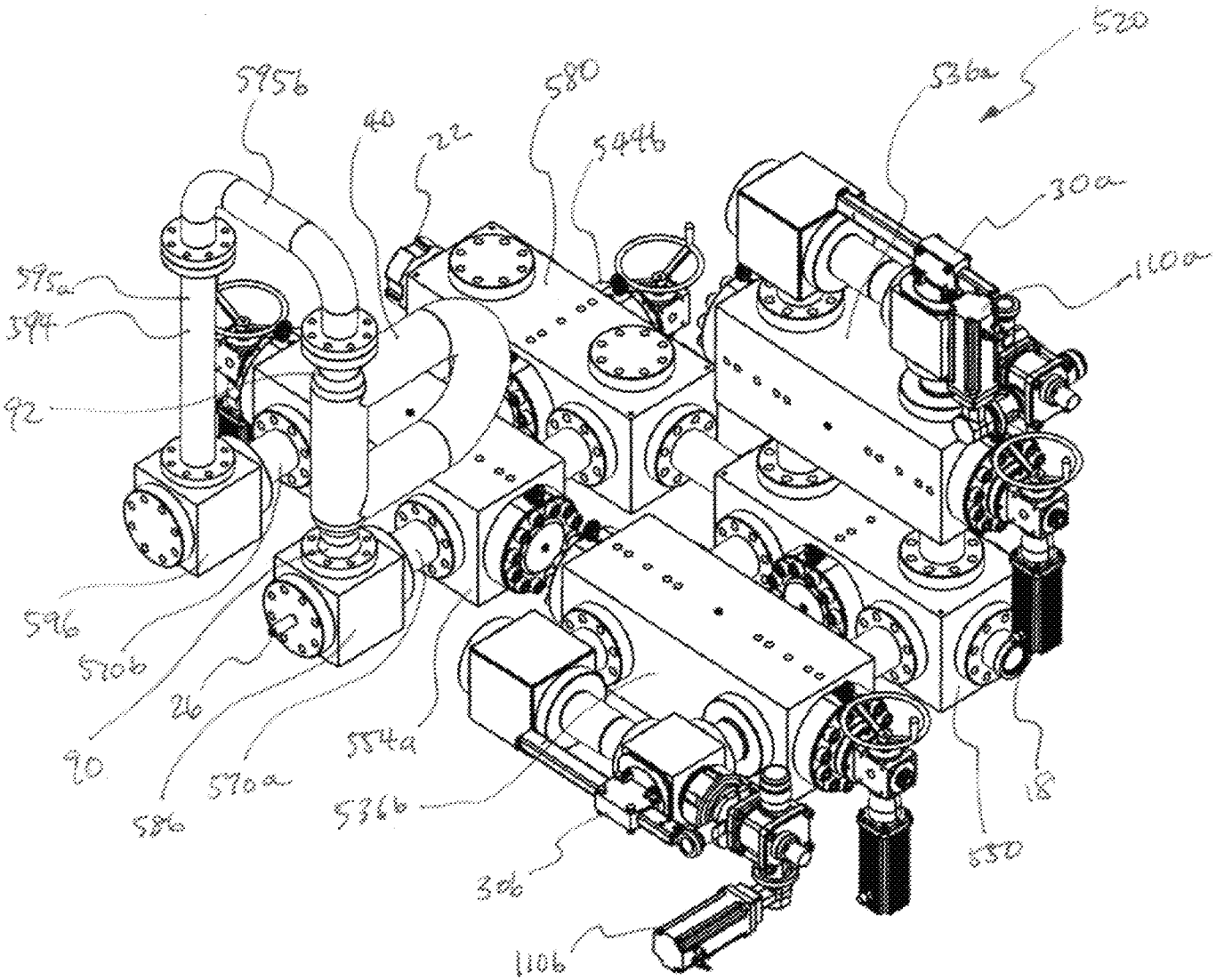
FIG. 23 is a perspective view of a sample configuration of the MPD manifold of FIG. 22 according to one embodiment of the present disclosure.
Figure 24:
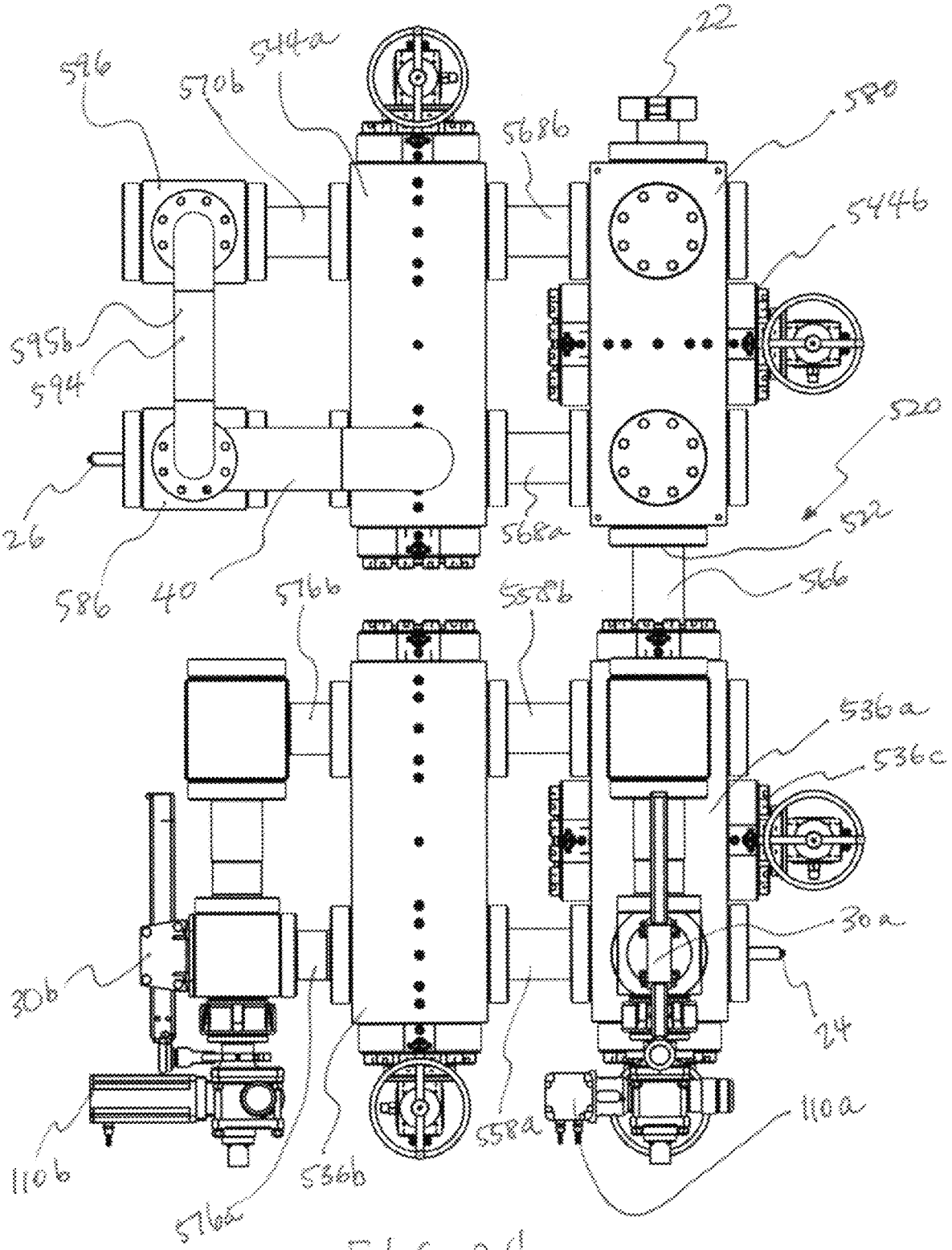
FIG. 24 is a top plan view of the MPD manifold shown in FIG. 23.
Figure 25:
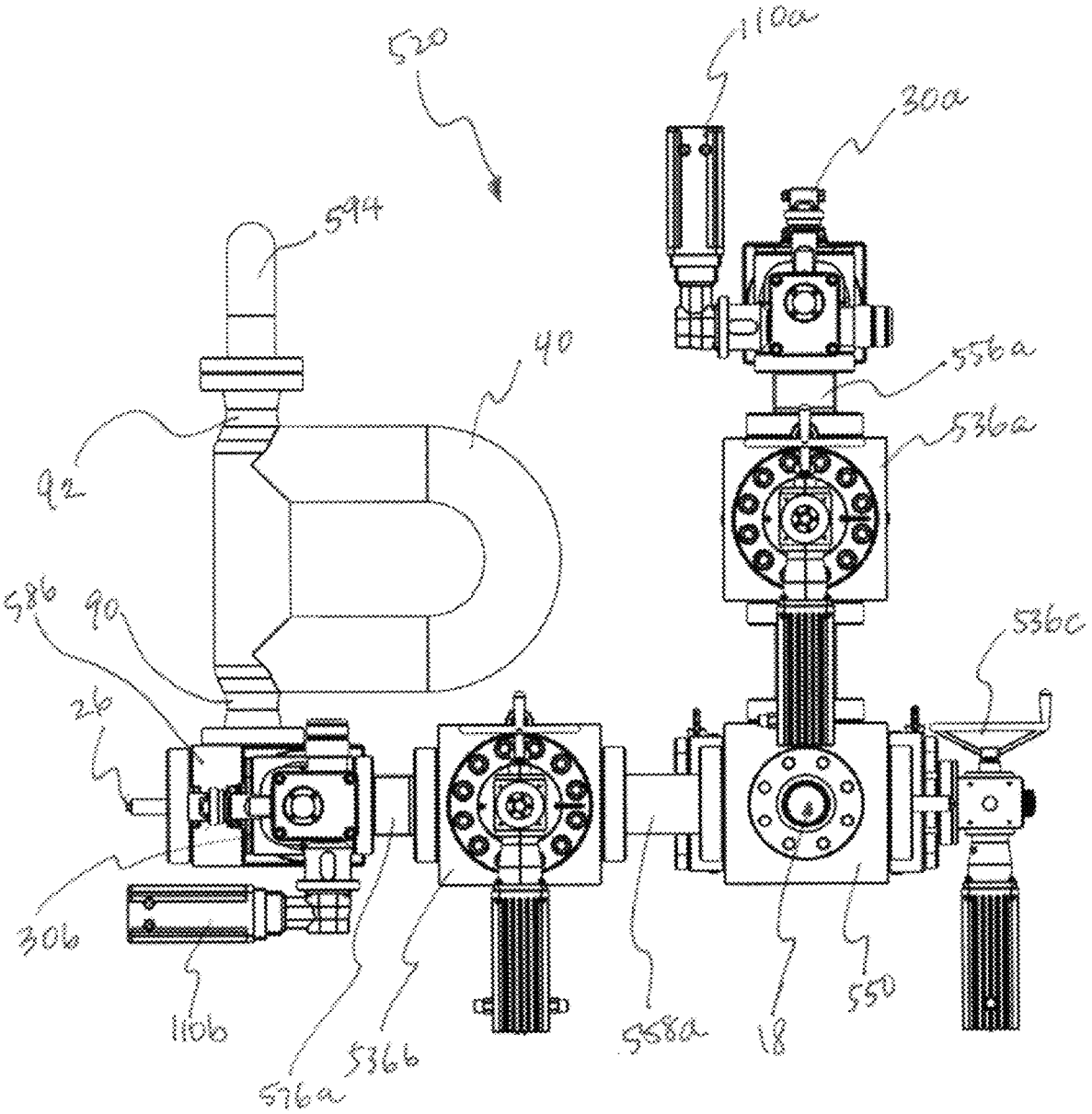
FIG. 25 is a front plan view of the MPD manifold shown in FIG. 23.
Figure 26:
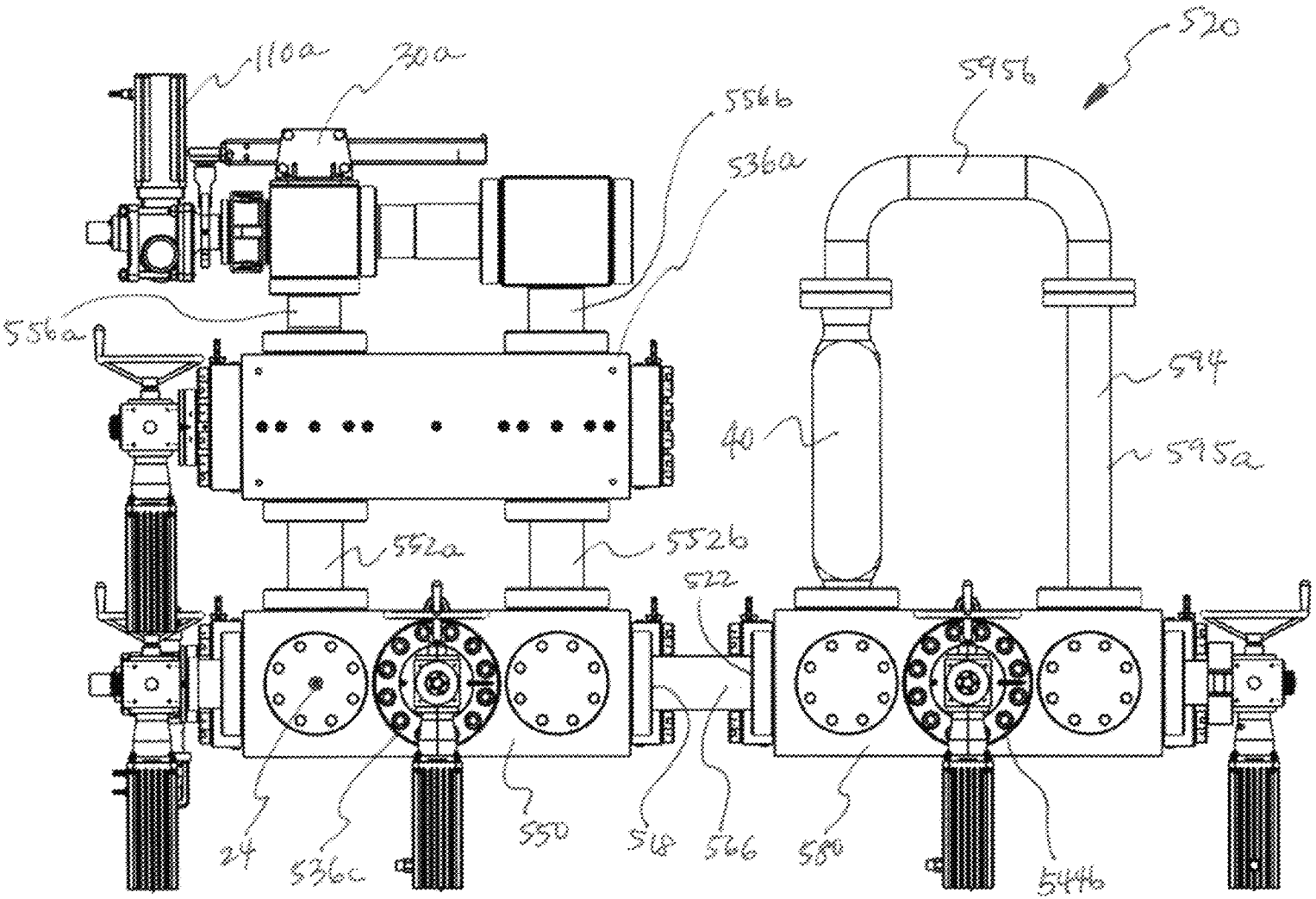
FIG. 26 is a first side plan view of the MPD manifold shown in FIG. 23.
Figure 27:
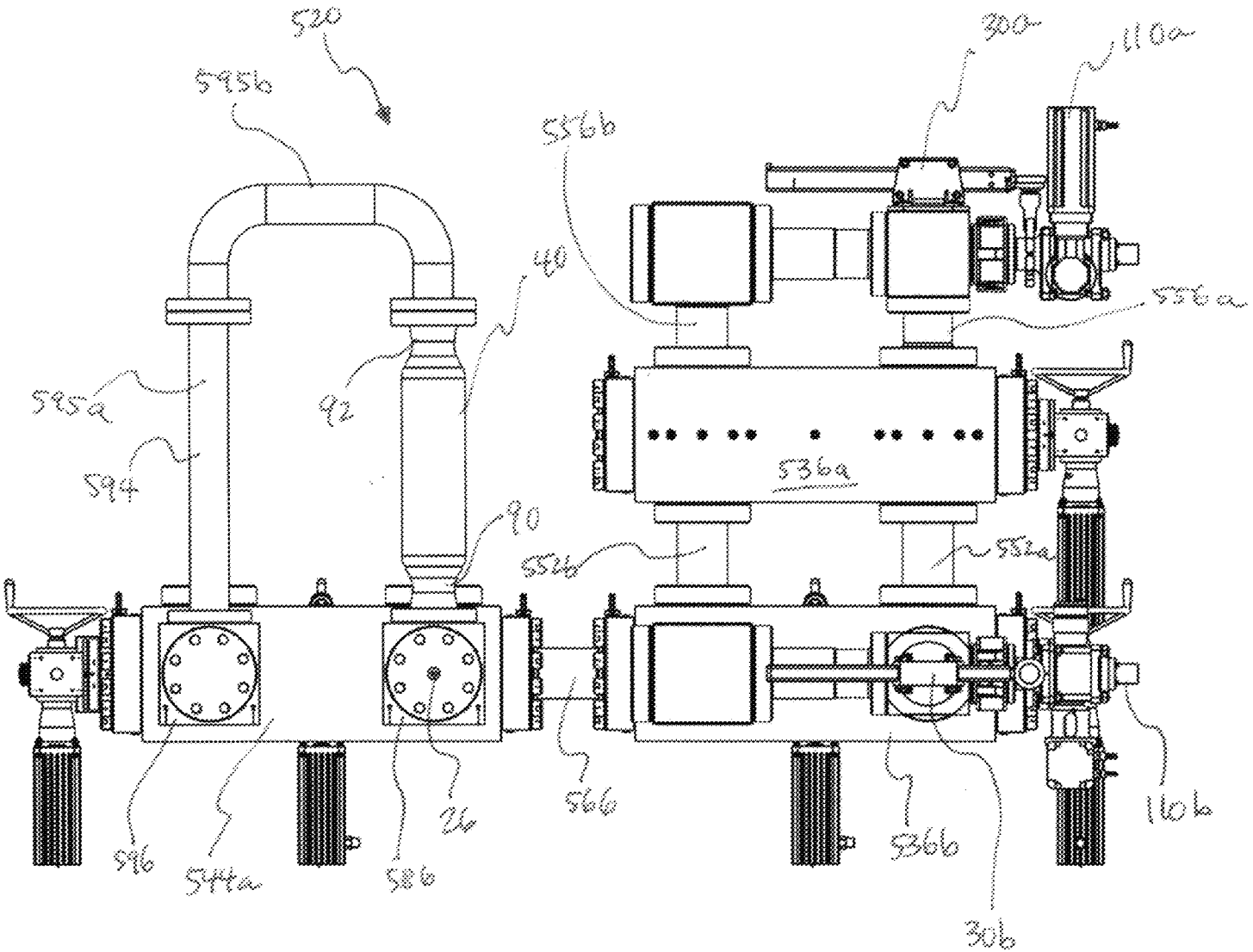
FIG. 27 is a second side plan view of the MPD manifold shown in FIG. 23.
Figure 28:
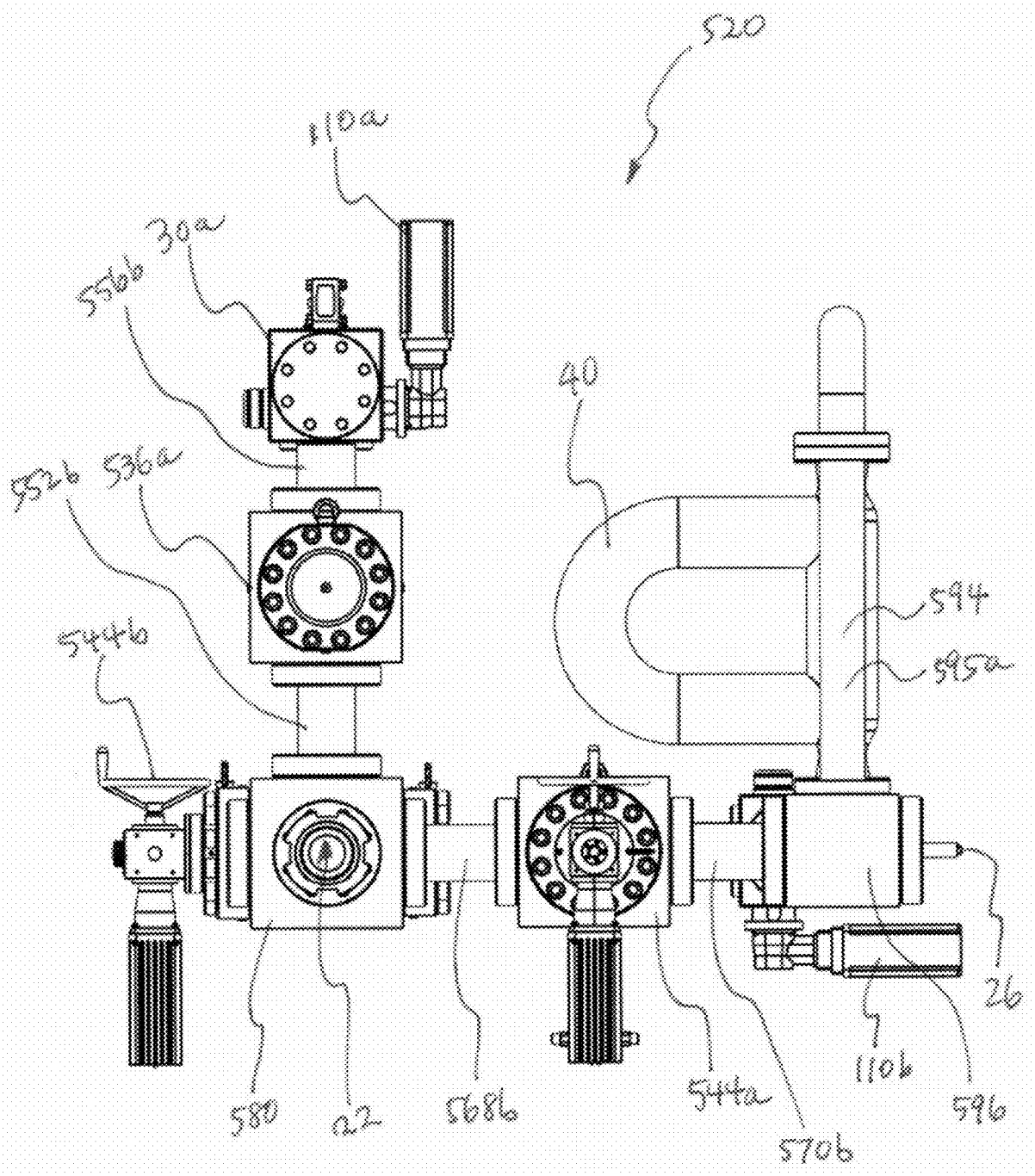
FIG. 28 is a rear plan view of the MPD manifold shown in FIG. 23.
Figure 29:
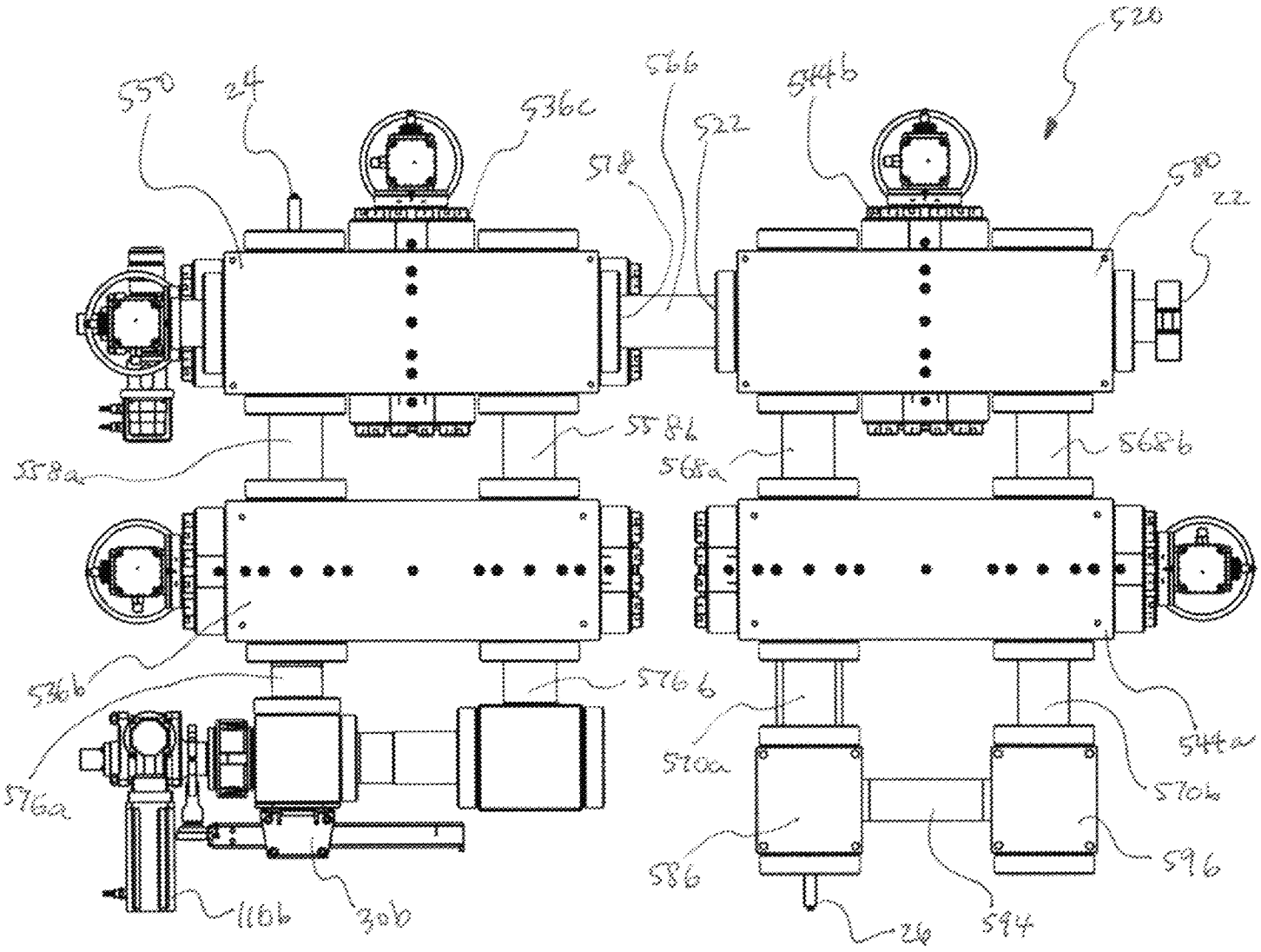
FIG. 29 is a bottom plan view of the MPD manifold shown in FIG. 23.

FIG. 22 illustrates an MPD manifold 420 according to another embodiment of the present disclosure. Manifold 420 generally comprises at least one pressure sensor 24, a choke section C3, and a flowmeter section F3, all between an inlet 18 and an outlet 22. The manifold 420 may further comprise at least one second pressure sensor 26 in some embodiments. The choke section C3 is operably coupled to, and adapted to be in fluid communication with, the flowmeter section F3. The choke section C3 comprises one or more drilling chokes 30*a*,30*b*, a choke gut line 34, and a choke section valve assembly 532 comprising a first choke valve 536*a*, a second choke valve 536*b*, and a choke gut line valve 536*c*. In the illustrated embodiment, the first drilling choke 30*a*, the second drilling choke 30*b*, and the choke gut line 34 are connected in parallel.

The first choke valve 536*a* controls the flow of fluid through the first drilling choke 30*a*; the second choke valve 536*b* controls the flow of fluid through the second drilling choke 30*b*; and the choke gut line valve 536*c* controls the flow of fluid through the choke gut line 34. In some embodiments, when the first choke valve 536*a* is open fluid can flow through the first choke 30*a* and when the first choke valve is closed fluid flow through the first choke 30*a* is restricted (or at least reduced); when the second choke valve 536*b* is open fluid can flow through the second choke 30*b* and when the second choke valve is closed fluid flow through the second choke 30*b* is restricted (or at least reduced); and when the choke gut line valve 536*c* is open fluid can flow through the choke gut line 34 and when the choke gut line valve is closed fluid flow through the choke gut line 34 is restricted (or at least reduced).

The flowmeter section F3 comprises a flowmeter section valve assembly 542, a flowmeter 40, and a flowmeter gut line 44. In the illustrated embodiment, the flowmeter section valve assembly comprises a flowmeter valve 544*a* and a flowmeter gut line valve 544*b*. The flowmeter 40 and the flowmeter gut line 44 are connected in parallel.

The flowmeter valve 544*a* controls the flow of fluid through the flowmeter 40; and the flowmeter gut line valve 544*b* controls the flow of fluid through the flowmeter gut line 44. In some embodiments, when the flowmeter valve 544*a* is open fluid can flow through the flowmeter 40 and when the flowmeter valve is closed fluid flow through the flowmeter is restricted (or at least reduced); and when the flowmeter gut line valve 544*b* is open fluid can flow through the flowmeter gut line 44 and when the flowmeter gut line valve is closed fluid flow through the flowmeter gut line is restricted (or at least reduced).

The inlet 18, outlet 22, pressure sensors 24, 26, drilling chokes 30*a*,30*b*, and flowmeter 40 are all as described above with respect to FIG. 2. In addition to pressure sensors 24 and 26, one or more instruments such as, for example, a temperature sensor, a densitometer, etc. are operably coupled to the manifold 420.

While two drilling chokes are shown, fewer or more drilling chokes may be included in other embodiments. In the embodiment shown in FIG. 22, the choke section valve assembly 532 may be configured to allow fluid in the drilling system to flow through two or more chokes simultaneously, so that the two or more chokes can operate together to maintain the desired backpressure within the wellbore.

The choke section valve assembly is operable to control the flow of fluids through the choke section C3 such that fluid can flow through one or both of the first and second chokes 30*a*,30*b* or through the choke gut line 34. In some embodiments, the choke section valve assembly 532 has three positions. In a first position, fluid can flow through the first choke 30*a* but not the choke gut line 34 or the second choke 30*b*. In a second position, fluid can flow through the second choke 30*b* but not the choke gut line 34 or the first choke 30*a*. In a third position, fluid can flow through the choke gut line 34 but not the first choke 30*a* or the second choke 30*b*. In further embodiments, the choke section valve assembly 532 has a fourth position wherein fluid can flow through both the first and second chokes 30*a*,30*b*, but not the choke gut line 34. Accordingly, the flow of fluids can be directed or rerouted as desired through the choke section C3 by changing the position of the choke section valve assembly 532.

In some embodiments, the first and second choke valves 536*a*,536*b*, and the choke gut line valve 536*c* are operable together to place the choke section valve assembly in a desired position of the four possible positions. For example, the first choke valve 536*a* is opened and the second choke valve 536*b* and the choke gut line valve 536*c* are closed to place the choke section valve assembly 532 in the first position; the second choke valve 536*b* is opened and the first choke valve 536*a* and the choke gut line valve 536*c* are closed to place the choke section valve assembly 532 in the second position; the first choke valve 536*a* and the second choke valve 536*b* are closed and the choke gut line valve 536*c* is opened to place the choke section valve assembly 532 in the third position; the first choke valve 536*a* and the second choke valve 536*b* are opened and the choke gut line valve 536*c* is closed to place the choke section valve assembly 532 in the fourth position.

In some embodiments, two or more of the first and second choke valves 536*a*,536*b*, and the choke gut line valve 536*c* may be controlled by the same actuator. In other embodiments, each of the first and second choke valves 536*a*,536*b*, and the choke gut line valve 536*c* is controllable by a respective actuator so that the valves 536*a*,536*b*,536*c* can operate independently from one another. In some embodiments, the valves 536*a*,536*b*,536*c* are configured to operate in a synchronized manner with respect to one another such that the opening of one or more of the valves 536*a*,536*b*, 536*c* can be synced with the closing of one or more of the other valves. In some embodiments, the valves 536*a*,536*b*, 536*c* are mechanically synced, hydraulically synced, electronically synced, pneumatically synced, or a combination thereof, or otherwise synced by methods known to those skilled in the art. Accordingly, unlike the prior art manifold 10 where five valves need to be automatically or manually actuated in order to reroute the flow path in the choke section C1, the MPD manifold 420 advantageously requires the actuation of a maximum of three valves 536*a*,536*b*,536*c* to change the fluid flow path through the choke section C3.

The flowmeter section valve assembly 542 is operable to control the flow of fluids through the flowmeter section F3 such that fluid can generally only flow through one of the flowmeter 40 and the flowmeter gut line 44. In some embodiments, the flowmeter section valve assembly 542 is movable between a first position and a second position. In the first position, the flowmeter section valve assembly 542 can allows fluid to flow through the flowmeter 40 but not the flowmeter gut line 44. In the second position, the flowmeter section valve assembly 542 can allow fluid to flow through the flowmeter gut line 44 but not the flowmeter. In some embodiments, the flowmeter section valve assembly 542 has a third position wherein the flowmeter section valve assembly 542 can restrict fluid flow through both the flowmeter 40 and the flowmeter gut line 44. The flowmeter valve 544*a* and the flowmeter gut line valve 544*b* are operable together to place the flowmeter section valve assembly in a desired position of the three possible positions. For example, the flowmeter valve 544*a* is opened and the flowmeter gut line valve 544*b* is closed to place the flowmeter section valve assembly 542 in the first position; the flowmeter valve 544*a* is closed and the flowmeter gut line valve 544*b* is opened to place the flowmeter section valve assembly 542 in the second position; the flowmeter valve 544*a* is closed and the flowmeter gut line valve 544*b* is closed to place the flowmeter section valve assembly 542 in the third position.

In some embodiments, the flowmeter valve 544*a* and the flowmeter gut line valve 544*b* may be controlled by the same actuator. In other embodiments, the flowmeter valve 544*a* and the flowmeter gut line valve 544*b* is controlled by a respective actuator so that the valves 544*a*,544*b* can operate independently from one another. In some embodiments, the valves 544*a*,544*b* are configured to operate in a synchronized manner with respect to one another such that the opening of the flowmeter valve 544*a* is synced with the closing of the flowmeter gut line valve 544*b*, and vice versa. In some embodiments, the valves 544*a*,544*b* are mechanically synced, hydraulically synced, electronically synced, pneumatically synced, or a combination thereof, or otherwise synced by methods known to those skilled in the art. Accordingly, unlike the prior art manifold 10 where three valves need to be actuated in order to reroute the flow path in the flowmeter section F1, the MPD manifold 420 advantageously requires the actuation of a maximum of two valves 544*a*,544*b* to change the fluid flow path through the flowmeter section F3.

In operation, fluid from the wellbore enters the MPD manifold 420 via inlet 18 and the pressure of the incoming fluid is measured by the pressure sensor 24. The fluid then enters the choke section C3 where, depending on the position of the choke section valve assembly 532, the fluid flows through: (i) the choke gut line 34; (ii) the first choke 30*a*; (iii) the second choke 30*b*; or (iv) both the first and second chokes 30*a*,30*b*. Accordingly, the choke section valve assembly 532 controls the flow of fluids through the inlet and outlet of each of the first and second chokes 30*a*,30*b* and through the choke gut line 34.

After exiting the choke section C3, the fluid flows downstream to the flowmeter section F3 where, depending on the position of the flowmeter section valve assembly 542, the fluid flows through either the flowmeter 40 or the flowmeter gut line 44. Accordingly, the flowmeter section valve assembly 542 controls the flow of fluids through the inlet and outlet of the flowmeter 40 and through the flowmeter gut line 44.

Accordingly, the choke section valve assembly 532 of manifold 420 of the present disclosure replaces the choke valves 32*a*,32*b* and choke gut line valve 36 of the prior art manifold 10 and the flowmeter section valve assembly 542 replaces the flowmeter valves 42 and flowmeter gut line valve 46 of the prior art manifold 10.

The drilling chokes 30*a*,30*b*, the choke gut line 34, the choke section valve assembly 532, the flowmeter section valve assembly 542, the flowmeter 40, and the flowmeter gut line 44 may be coupled to one another by one or more flow blocks and/or one or more spools.

Any of the flowmeter sections described herein can be configured to connect and operate with any of the choke sections. For example, with reference to FIGS. 2 and 22, the flowmeter section F2 is interchangeable with the flowmeter section F3 such that flowmeter section F3 can be combined with choke section C2 to form an MPD manifold. Likewise, flowmeter section F2 can be combined with choke section C3 to form an MPD manifold.

FIGS. 23 to 29 show a sample configuration of an MPD manifold 520 in accordance with the embodiment shown in FIG. 22. In the illustrated embodiment, the MPD manifold 520 comprises pressure sensor 24, first and second chokes 30*a*,30*b*, first choke valve 536*a*, second choke valve 536*b*, flowmeter 40, flowmeter valve 544*a*, choke gut line valve 536*c*, flowmeter gut line valve 544*b*, inlet 18 at a flow block 550 having defined therein the choke gut line, and outlet 22 at a flow block 580 having defined therein the flowmeter gut line, all of which are interconnected by various spools. In some embodiments, the first and second choke valves 536*a*, 536*b* and the flowmeter valve 544*a* are each a two-port block valve.

Figure 32:
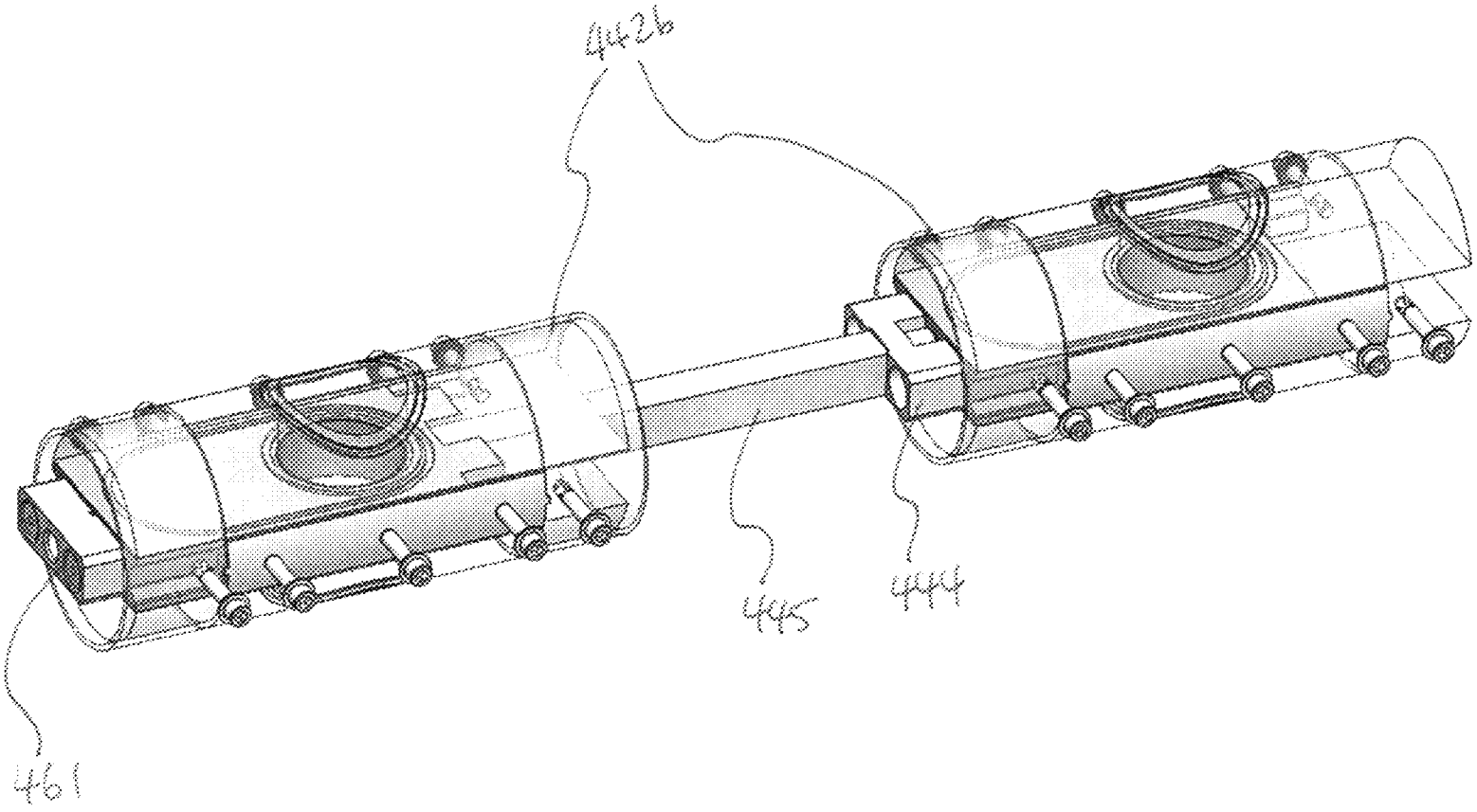
FIG. 32 is a semi-transparent perspective view of exemplary internal components of the first choke valve shown in FIG. 31, according to one embodiment of the present disclosure.

In the sample embodiment shown in FIGS. 23 to 39, inlet 18 is positioned in one of the fluid passageways of the flow block 550 and flow block 550 has an outlet 518 positioned in one of its fluid passageways. The pressure sensor 24 may be positioned in another fluid passageway of the flow block 550 near inlet 18. In the illustrated embodiment, the choke gut line is defined within the flow block 550 and, in some embodiments, the choke gut line may be an axial fluid passageway extending between a first end and a second end of the flow block 550. The inlet 18 and outlet 518 are in fluid communication with the choke gut line. With further reference to FIG. 32, at least a portion of the choke gut line valve 536*c* is positioned in flow block 550 to control fluid flow through the choke gut line.

Figure 31A:
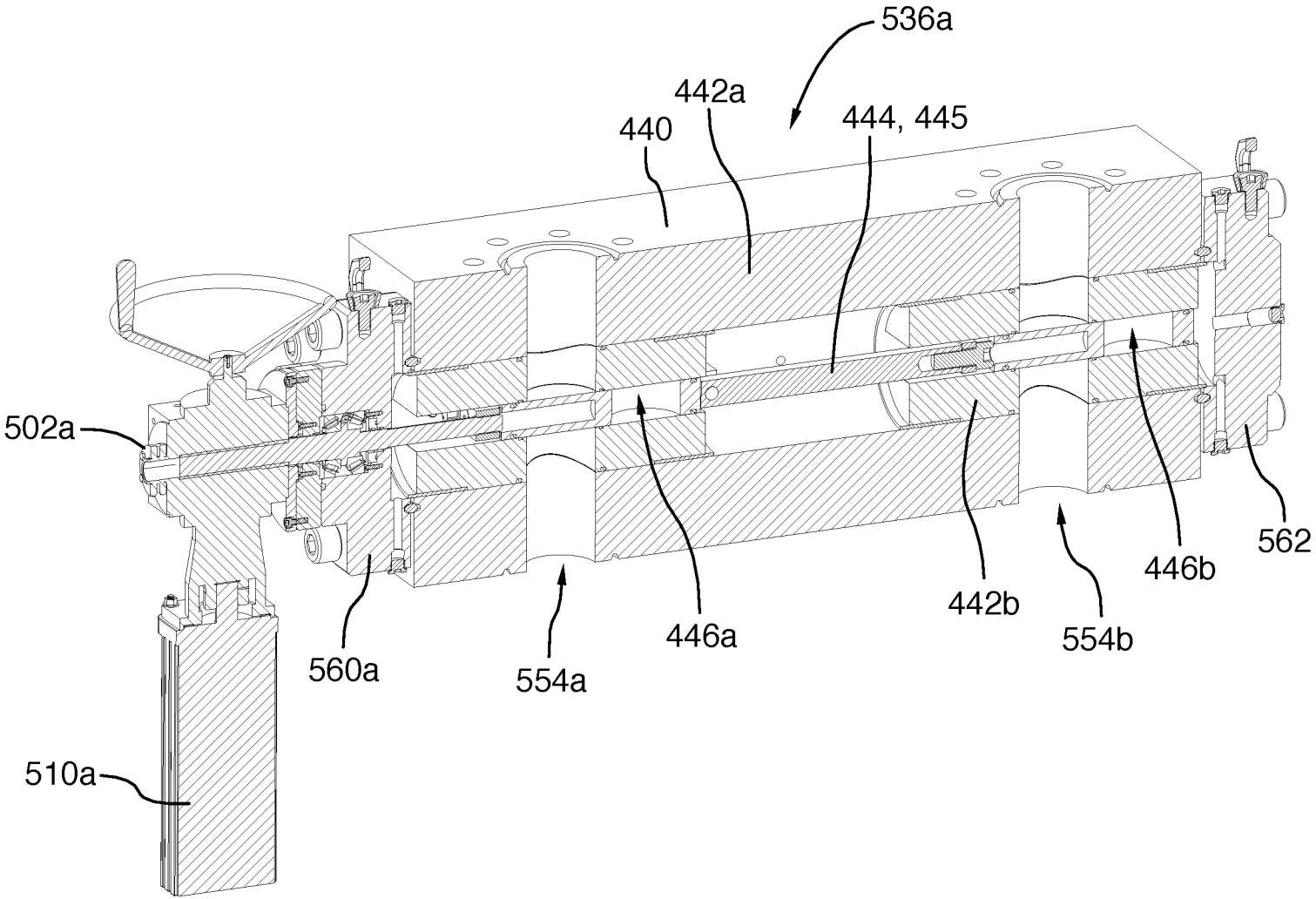
FIGS. 31A and 31B are perspective cross-sectional views of a first choke valve of the MPD manifold of FIG. 23, shown in a closed position and an open position, respectively.
Figure 31B:
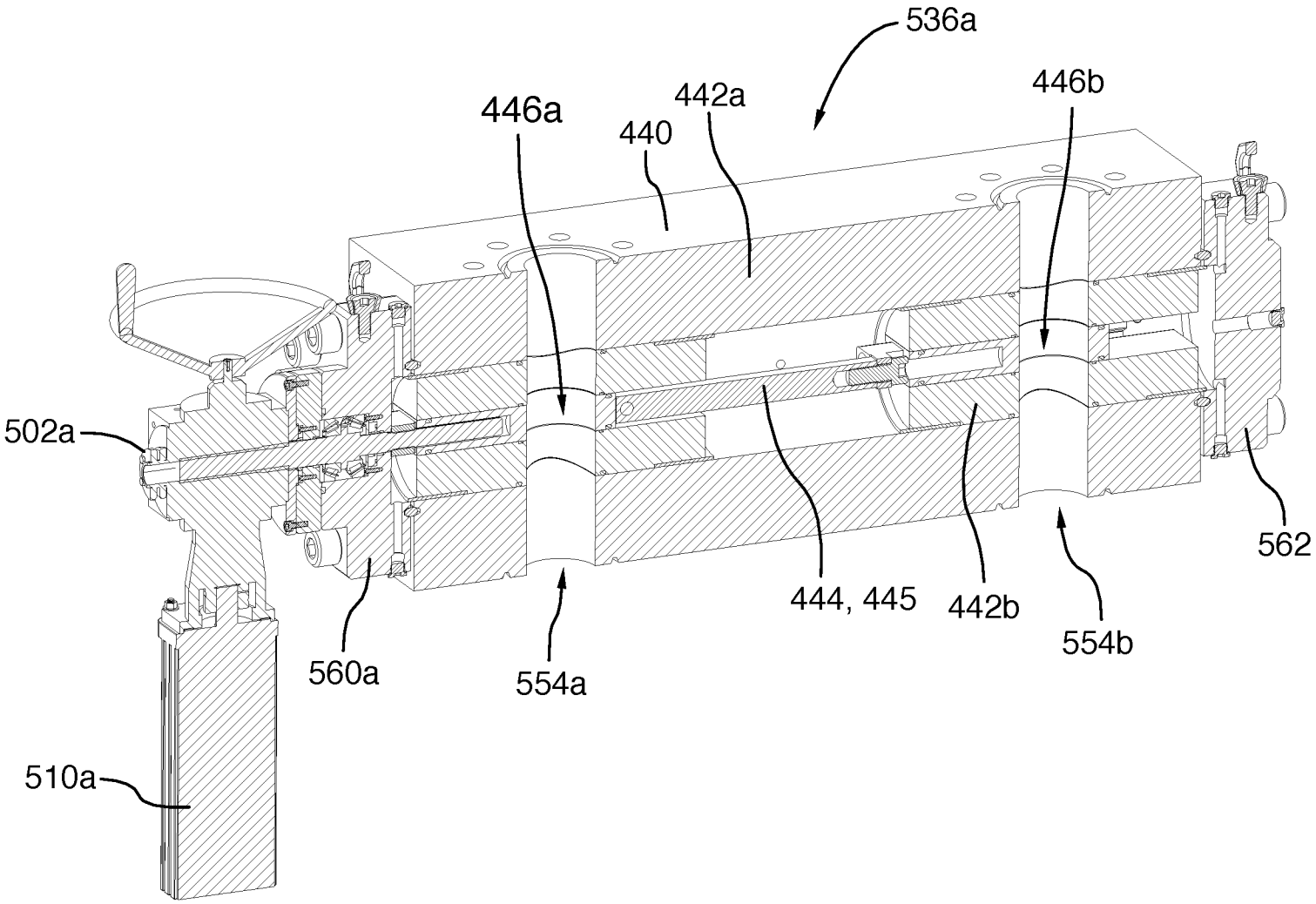
Figure 31:
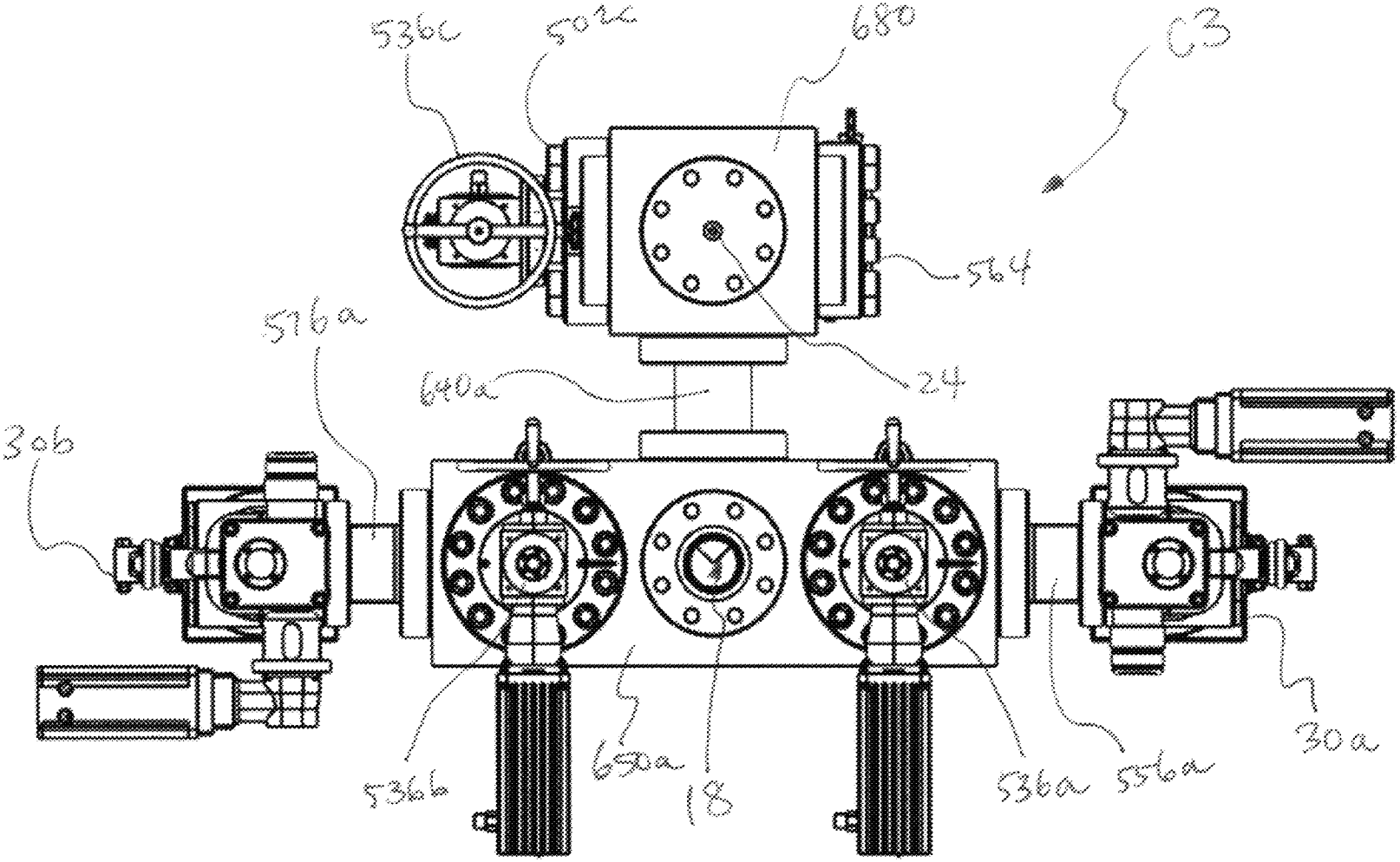
Figure 38:
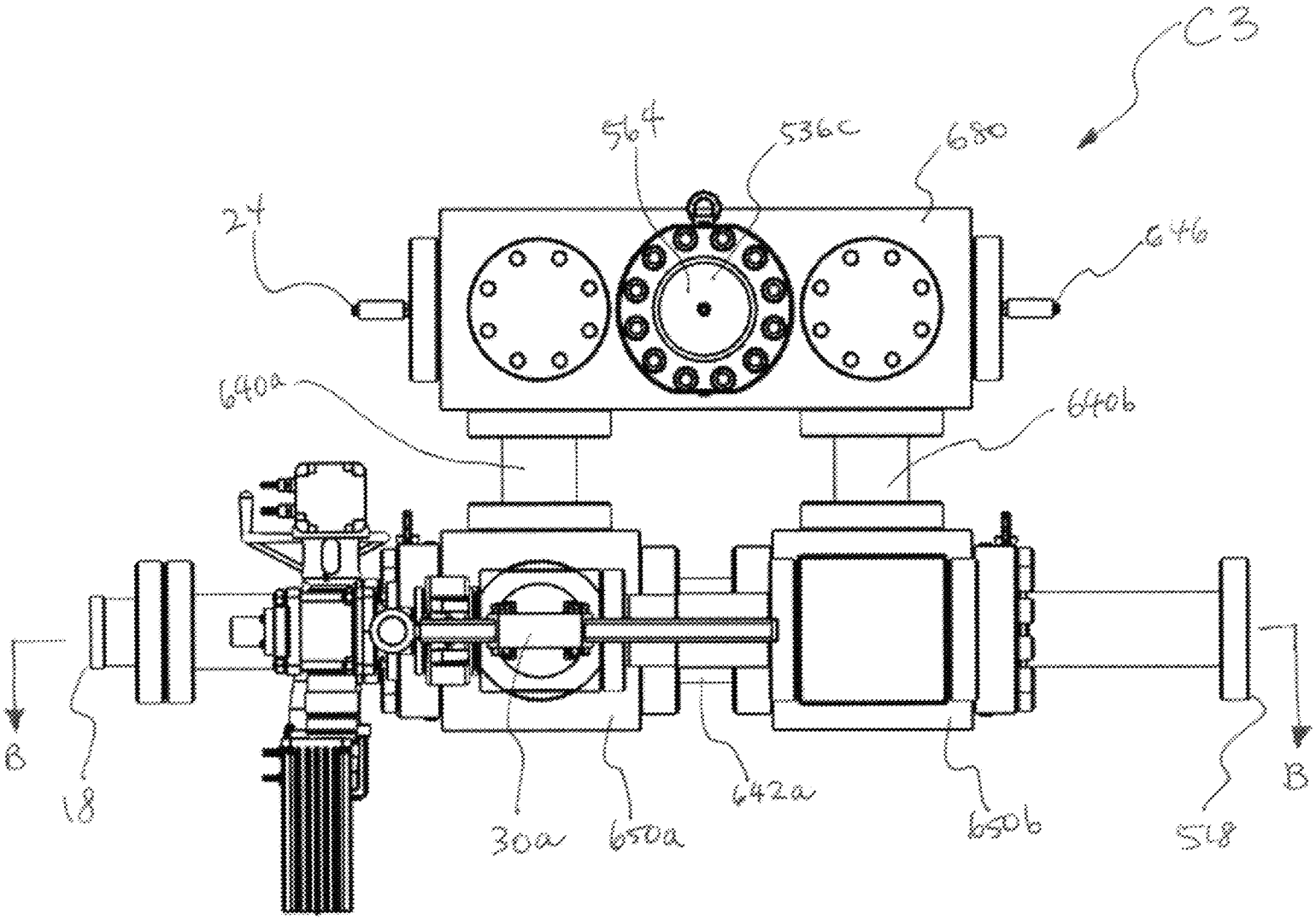
FIG. 38 is a first side plan view of the choke section shown in FIG. 35.
Figure 39:
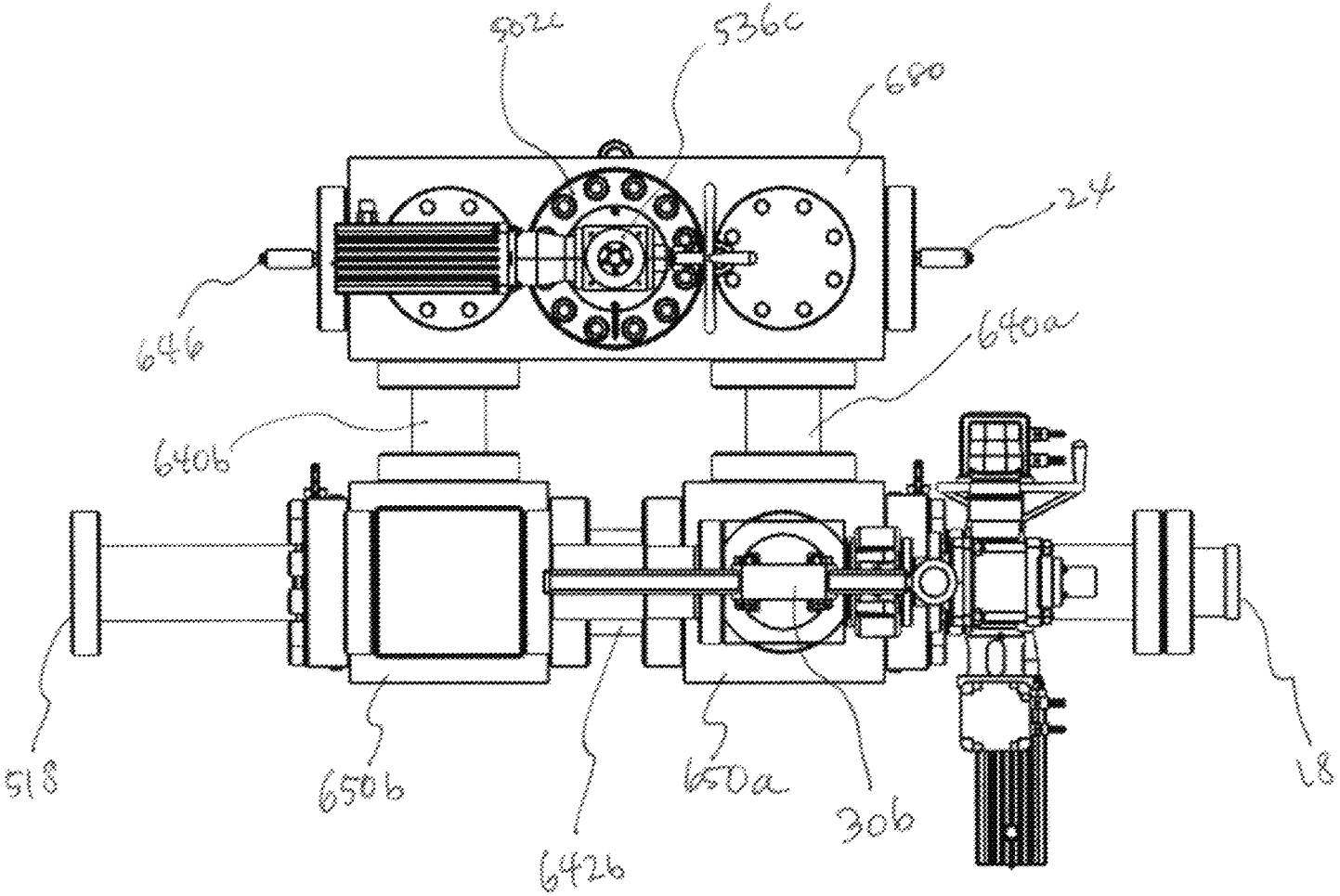
FIG. 39 is a second side plan view of the choke section shown in FIG. 35.
Figure 40:
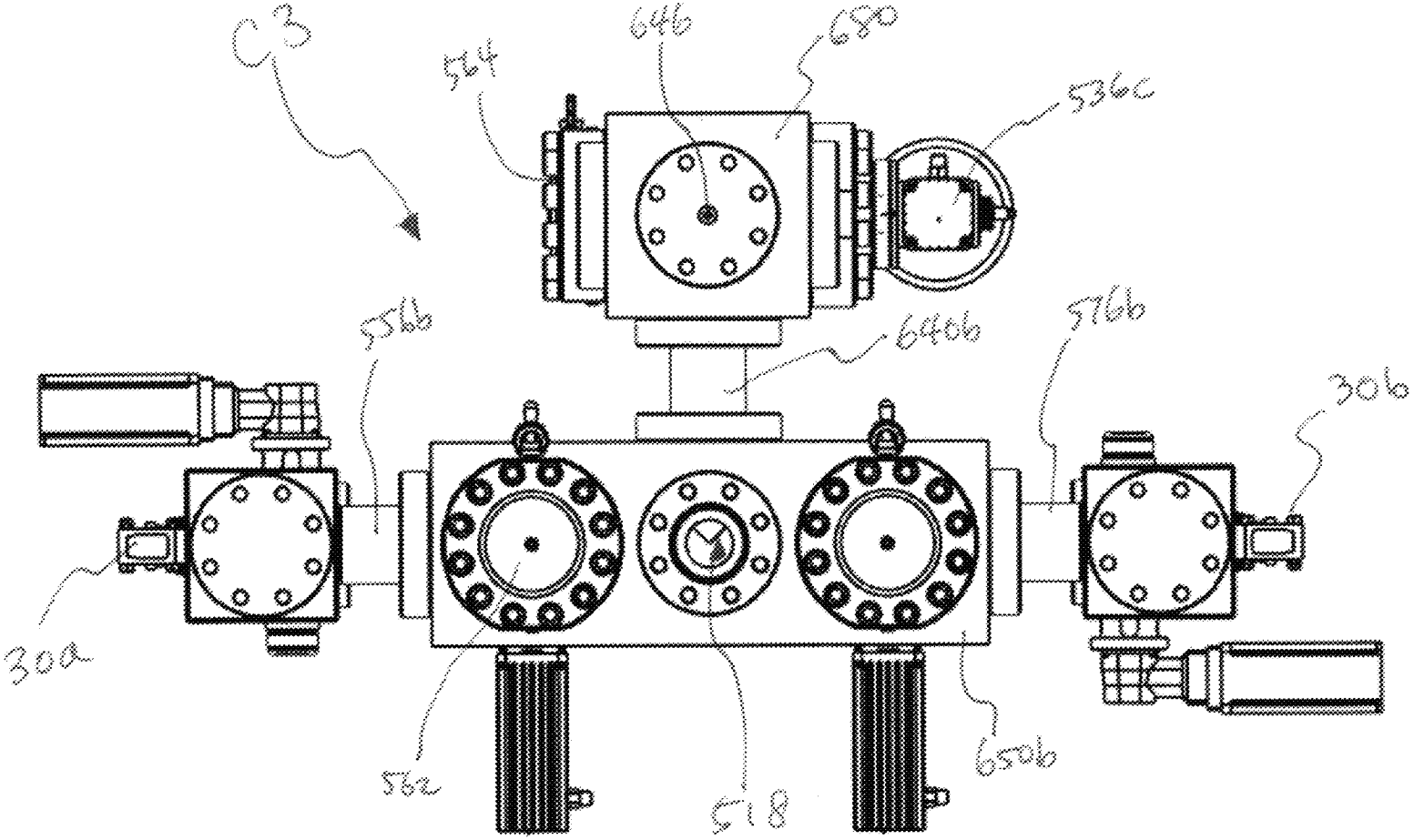
FIG. 40 is a rear plan view of the choke section shown in FIG. 35.
Figure 41:
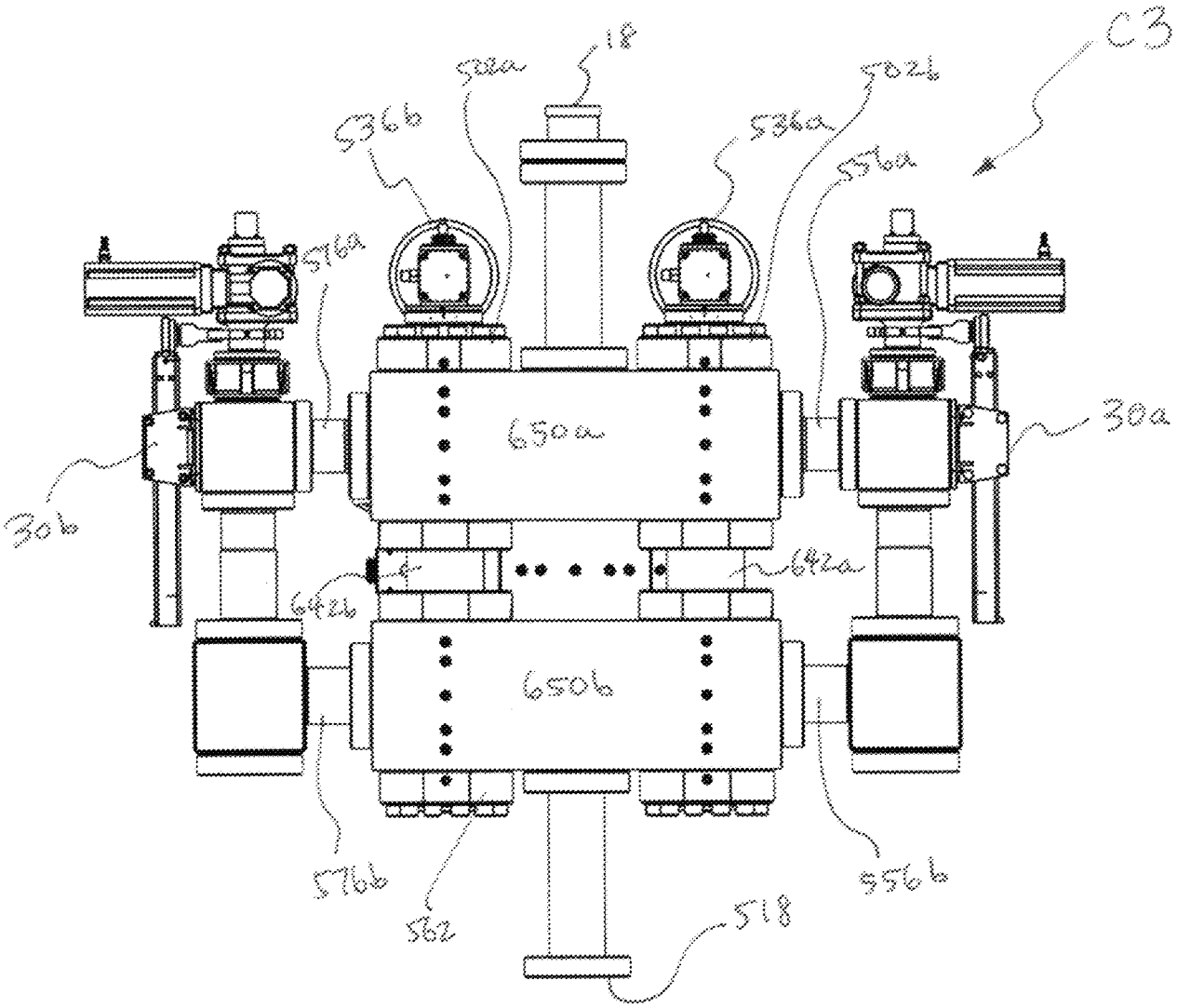
FIG. 41 is a bottom plan view of the choke section shown in FIG. 35.
Figure 49:
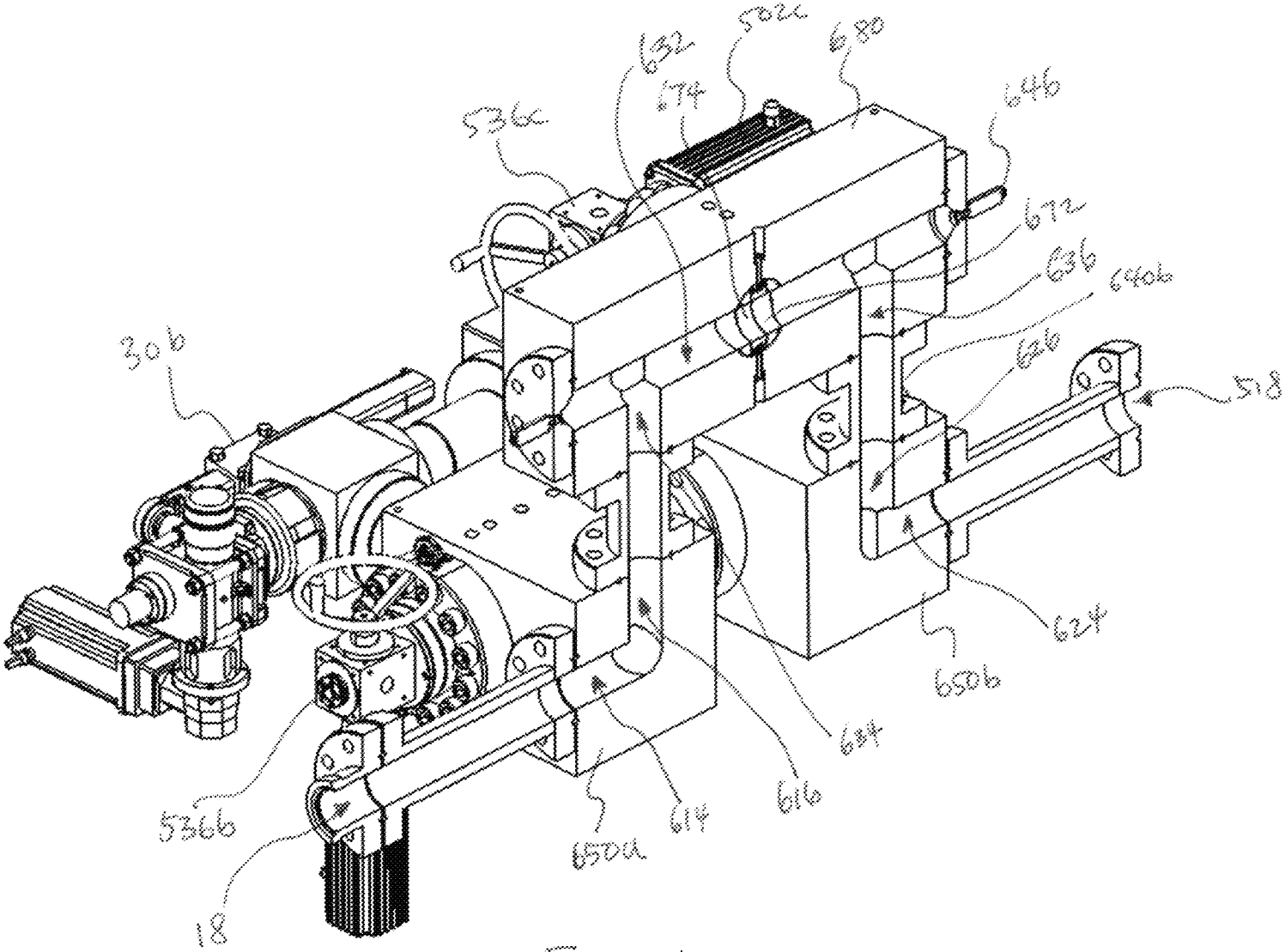

With reference to FIGS. 23 to 29 and further reference to FIG. 31, flow block 550 is coupled to, and in fluid communication with, the first choke valve 536*a* via spools 552*a*, 552*b*. In some embodiments, the inlet 18 is in fluid communication with spool 552*a* and the outlet 518 is in fluid communication with spool 552*b*. The first choke valve 536*a* has a first fluid passageway 554*a* and a second fluid passageway 554*b* extending therethrough. In the illustrated embodiment, spools 552*a*,552*b* are operably connected to the first choke valve 536*a* such that spools 552*a*,552*b* can fluidly communicate with the first and second passageways 554*a*,554*b*, respectively. The first fluid passageway 554*a* is in fluid communication with an inlet 556*a* of the first choke 30*a* and the second fluid passageway 554*b* is in fluid communication with an outlet 556*b* of the first choke 30*a*, such that fluid can enter the first choke 30*a* via passageway 554*a* and can exit via passageway 554*b*.

Figure 30:
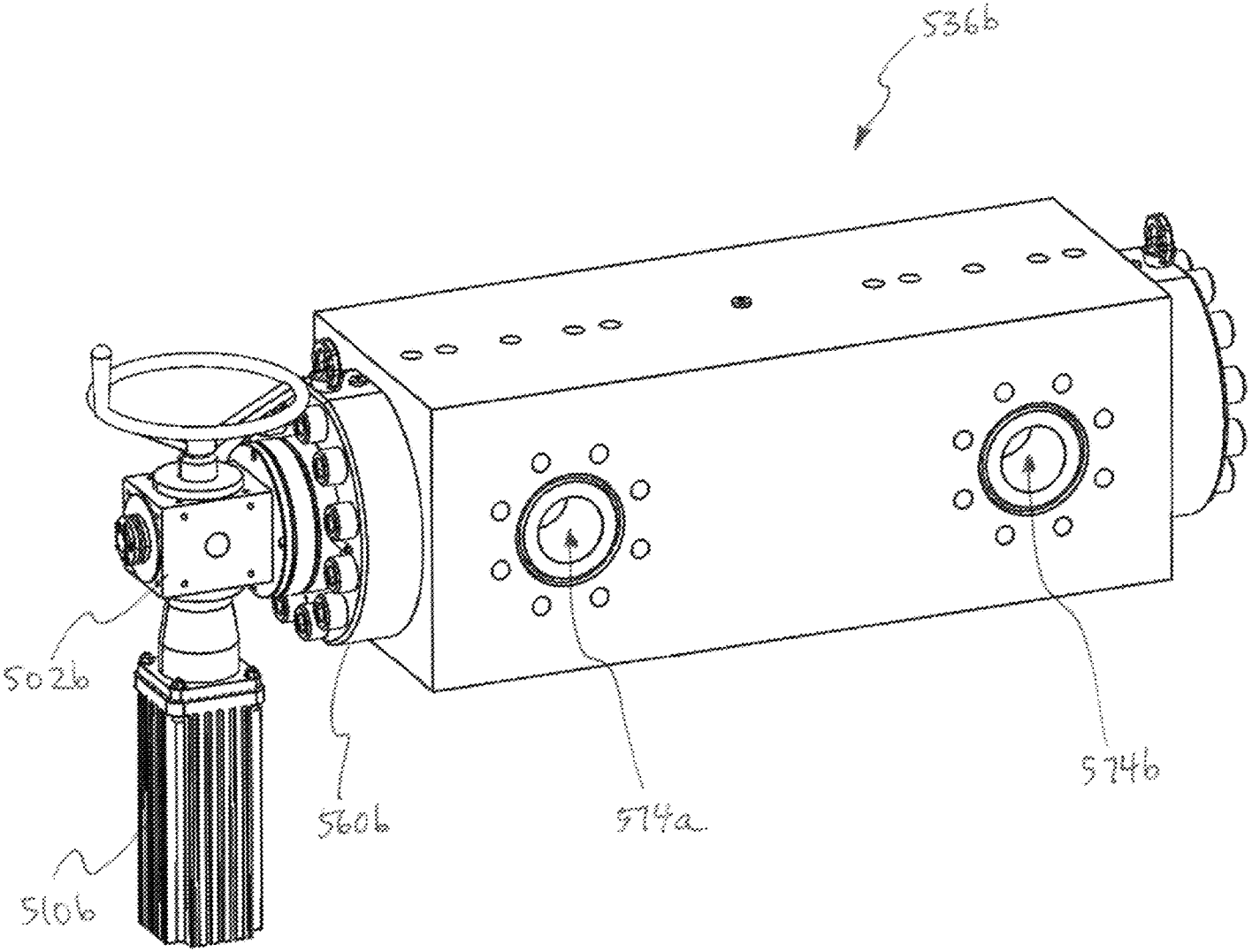
FIG. 30 is a perspective view of a second choke valve of the MPD manifold shown in FIG. 23, according to one embodiment of the present disclosure.

With reference to FIGS. 23 to 29 and further reference to FIG. 30, flow block 550 is coupled to, and in fluid communication with, the second choke valve 536*b* via spools 558*a*,558*b*. In some embodiments, the inlet 18 is in fluid communication with spool 558*a* and the outlet 518 is in fluid communication with spool 558*b*. The second choke valve 536*b* has a first fluid passageway 574*a* and a second fluid passageway 574*b* extending therethrough. In the illustrated embodiment, spools 558*a*,558*b* are operably connected to the second choke valve 536*b* such that spools 558*a*,558*b* can fluidly communicate with the first and second passageways 574*a*,574*b*, respectively. The first fluid passageway 574*a* is in fluid communication with an inlet 576*a* of the second choke 30*b* and the second fluid passageway 574*b* is in fluid communication with an outlet 576*b* of the second choke 30*b*, such that fluid enters the second choke 30*b* via passageway 574*a* and exits via passageway 574*b*.

In the illustrated embodiment, an upstream portion of the choke gut line is in fluid communication with passageway 554*a* of the first choke valve 536*a* via spool 552*a*, and passageway 574*a* of the second choke valve 536*b* via spool 558*a*. A downstream portion of the choke gut line is in fluid communication with passageway 554*b* of the first choke valve 536*a* via spool 552*b*, and passageway 574*b* of the second choke valve 536*b* via spool 558*b*. The upstream portion of the choke gut line is in fluid communication with the inlet 18 and the downstream portion of the choke gut line is in fluid communication with the outlet 518. In some embodiments, the choke gut line comprises an axially extending bore defined in flow block 550, and one end of the axial bore is (or is in fluid communication with) the inlet 18 and the other end of the axial bore is (or is in fluid communication with) the outlet 518.

In the illustrated embodiment, flow block 550 is operably connected to the flow block 580 via a spool 566, such that the outlet 518 of flow block 550 is in fluid communication with an inlet 522 of flow block 580 in order for flow block 580 to receive incoming fluid from flow block 550. The inlet 522 is positioned in one of the fluid passageways of flow block 580 and outlet 22 is positioned in another one of the fluid passageways of the flow block 580. In the illustrated embodiment, the flowmeter gut line is defined within the flow block 580 and, in some embodiments, the flowmeter gut line may be an axial fluid passageway extending between a first end and a second end of the flow block 580. The inlet 522 and outlet 22 are in fluid communication with the flowmeter gut line. At least a portion of the flowmeter gut line valve 544*b* is positioned in flow block 580 to control fluid flow through the flowmeter gut line.

Flow block 580 is coupled to, and in fluid communication with, the flowmeter valve 544*a* via spools 568*a*,568*b*. In some embodiments, the inlet 522 is in fluid communication with spool 568*a* and the outlet 22 is in fluid communication with spool 568*b*. The flowmeter valve 544*a* has a first fluid passageway and a second fluid passageway extending therethrough. In some embodiments, spools 568*a*,568*b* are operably connected to the flowmeter valve 544*a* such that spools 568*a*,568*b* can fluidly communicate with the first and second passageways of the flowmeter valve, respectively. The first fluid passageway of the flowmeter valve 544*a* is in fluid communication with the inlet 90 of the flowmeter 40 and the second fluid passageway of the flowmeter valve 544*a* is in fluid communication with the outlet 92 of the flowmeter 40. In the illustrated embodiment, the inlet 90 is operably coupled to the flowmeter valve 544*a* via a spool 570*a* and a flow block 586. In some embodiments, the pressure sensor 26 is positioned in flow block 586 for measuring the pressure of fluid entering the flowmeter 40. In the illustrated embodiment, the outlet 92 is operably coupled to the flowmeter valve 544*a* via a tubing 594, a flow block 596, and a spool 570*b*, respectively. The first and second fluid passageways of the flowmeter valve 544*a* are coupled to and in fluid communication with spools 570*a*,570*b*, respectively, such that fluid enters the flowmeter 40 via the first passageway of the flowmeter valve 544*a* and fluid exists the flowmeter 40 via the second passageway of the flowmeter valve 544*a*.

In the illustrated embodiment, an upstream portion of the flowmeter gut line is in fluid communication with the first passageway of the flowmeter valve 544*a* via spool 568*a*. A downstream portion of the flowmeter gut line is in fluid communication with the second passageway of the flowmeter valve 544*a* via spool 568*b*. The upstream portion of the flowmeter gut line is in fluid communication with the inlet 522 and the downstream portion of the flowmeter gut line is in fluid communication with the outlet 22. In some embodiments, the flowmeter gut line comprises an axially extending bore defined in flow block 580, and one end of the axial bore is (or is in fluid communication with) the inlet 522 and the other end of the axial bore is (or is in fluid communication with) the outlet 22.

In a sample embodiment, as illustrated in FIGS. 23 to 29, inlet 18 and/or outlet 518 is substantially perpendicular to one or both of spools 552*a*,552*b*. In some embodiments, inlet 18 is positioned adjacent to spool 552*a* and outlet 518 is positioned adjacent spool 552*b*. In some embodiments, spool 552*a* is parallel to spool 552*b*. In some embodiments, inlet 18 and/or outlet 518 is substantially perpendicular to one or both of spools 558*a*,558*b*. In some embodiments, inlet 18 is positioned adjacent to spool 558*a* and outlet 518 is positioned adjacent spool 558*b*.

In some embodiments, spool 552*a* is parallel to spool 552*b*. In some embodiments, spool 558*a* is parallel to spool 558*b*. In some embodiments, one or both of spools 552*a*, 552*b* are substantially perpendicular to one or both of spools 558*a*,558*b*. In some embodiments, the first choke valve 536*a* is positioned adjacent one side of the flow block 550 and the second choke valve 536*b* is positioned adjacent another side of the flow block 550. In some embodiments, the choke gut line is substantially parallel to and/or coaxial with one or both of inlet 18 and outlet 518. In some embodiments, inlet 18 and outlet 518 are substantially parallel and/or coaxial with one another.

In some embodiments, spool 566 is substantially perpendicular to one or both of spools 552*b*,558*b*. In some embodiments, inlet 522 and/or outlet 22 is substantially perpendicular to one or both of spools 568*a*,568*b*. In some embodiments, inlet 522 is positioned adjacent to spool 568*a* and outlet 22 is positioned adjacent spool 568*b*. In some embodiments, spool 568*a* is parallel to spool 568*b*. In some embodiments, spool 568*a* is parallel to spool 568*b*. In some embodiments, one or both of spools 568*a*,568*b* are substantially parallel to and/or coaxial with one or both of spools 570,570*b*. In some embodiments, spool 570*a* is parallel to spool 570*b*. In some embodiments, the flow block 550 is positioned adjacent to one end of the flow block 580 and the flowmeter valve 544*a* is positioned adjacent one side of the flow block 580. In some embodiments, the flowmeter gut line is substantially parallel to and/or coaxial with one or both of inlet 522 and outlet 22. In some embodiments, inlet 522 and outlet 22 are substantially parallel and/or coaxial with one another.

In some embodiments, tubing 594 comprises a first portion 595*a* that is substantially vertical and may be perpendicular to one or both of spools 570*a*,570*b*; and a second portion 595*b* that is substantially horizontal and may be perpendicular to one or both of spools 570*a*,570*b*.

In some embodiments, two or more of flow blocks 550, 580, the second choke valve 536*b*, and the flowmeter valve 544*a* are substantially on the same plane. In a further embodiment, one or both of flow blocks 586,596 are substantially on the same plane as the flowmeter valve 544*a*. In some embodiments, the first choke valve 536*a* is on a different plane than that of one or more of flow blocks 550,580, the second choke valve 536*b*, and the flowmeter valve 544*a*.

In some embodiments, as shown for example in FIGS. 30 and 31, each of the first and second choke valves 536*a*,536*b* is actuatable between an open position and a closed position by a respective actuator 502*a*,502*b*. In some embodiments, each actuator 502*a*,502*b* comprises a respective flange 560*a*, 560*b* and a respective motor 510*a*,510*b*. In the illustrated embodiment, the first and second choke valves 536*a*,536*b* are substantially identical so only the first choke valve will be described in detail.

According to a sample embodiment shown in FIGS. 31 and 32, the first choke valve 536*a* comprises the actuator 502*a*, an end flange 562, a housing 440 having an outer housing 442*a* and an inner housing 442*b*. In some embodiments, flange 560*a* is attached to a first end of the housing 440 and flange 562 is attached to a second end of the housing 440. While the illustrated embodiment shows inner housing 442*b* as a separate component positioned inside outer housing 442*a*, outer housing 442*a* and inner housing 442*b* may be integrally formed as a single component in other embodiments. Outer housing 442*a* and inner housing 442*b* have aligned apertures to define the first fluid passageway 554*a* and the second fluid passageway 554*b* of the first choke valve 536*a*.

The first choke valve 536*a* further comprises a valve control mechanism. In the illustrated embodiment, with specific reference to FIGS. 31 and 32, the valve control mechanism is a slab gate 444 having an elongated body 445 extending axially in inner housing 442*b*. A first opening 446*a* and a second opening 446*b* are defined in the body 445. The actuator 502*a* is operable to move the slab gate 444 axially within the inner housing 442*b* among an open position, a closed position, and any other axial position between the inner surfaces of the flanges 560*a*,562. In some embodiments, a first end 461 of the slab gate 444 is coupled to the actuator 502*a* to allow the actuator 502*a* to exert axial force on the slab gate 444. Alternative configurations and/or forms of the valve control mechanism are possible.

The first and second openings 446*a*,446*b* are spaced apart and positioned relative to the first and second passageways 554*a*,554*b* such that when the first opening 446*a* is aligned with the first passageway 554*a*, the second opening 446*b* is also aligned with the second passageway 554*b*, and vice versa. Further, when the first opening 446*a* is not aligned with the first passageway 554*a*, the second opening 446*b* is also not aligned with the second passageway 554*b*, and vice versa. With specific reference to FIG. 31B, when the first and second openings 446*a*,446*b* are aligned with the first and second passageways 554*a*,554*b*, the first choke valve 536*a* is in the open position, wherein fluid flow is permitted through passageways 554*a*,554*b*, which means fluid can enter the first choke 30*a* via passageway 554*a* and flow through the first choke 30*a* and can exit via passageway 554*b*. With specific reference to FIG. 31A, when passageways 554*a*,554*b* are blocked by the body 445 of the slab gate 444, the first choke valve 536*a* is in the closed position, wherein fluid flow through passageways 554*a*,554*b* is restricted (or at least reduced) so that no (or almost no) fluid can flow through the first choke 30*a*.

In some embodiments, the flowmeter valve 544*a* has substantially the same configuration as the first and second choke valves. The flowmeter valve 544*a* is actuatable between an open position and a closed position by an actuator that controls a valve control mechanism to open and block the first and second passageways in the flowmeter valve 544*a*. In the open position, the first and second passageways of the flowmeter valve 544*a* are open to allow fluid flow therethrough such that fluid can enter the flowmeter 40 via the first passageway and flow through the flowmeter 40 and exit via the second passageway. In the closed position, the first and second passageways of the flowmeter valve 544*a* are blocked to restrict (or at least reduce) fluid flow therethrough such that no or almost no fluid can flow through the flowmeter 40.

The flow of fluid through the choke gut line and the flowmeter gut line are controlled by the choke gut line valve 536*c* and the flowmeter gut line valve 544*b*, respectively. In the illustrated embodiment, the choke gut line valve 536*c* and the flowmeter gut line valve 544*b* are substantially identical in construction so only the choke gut line valve 536*c* will be described in detail. With reference to FIG. 33, the choke gut line valve 536*c*, which is partially disposed in flow block 550, comprises an actuator 502*c* having a flange 560*c* and a motor 510*c*. The choke gut line valve 536*c* also has an end flange 564 and an inner housing 470 extending between the inner surfaces of flanges 560*c*,564.

In some embodiments, flange 560*c* is attached to a first lateral side of the flow block 550 and flange 564 is attached to a second lateral side, opposite the first lateral side, of the flow block 550. In the illustrated embodiment, the inner housing 470 is disposed in a laterally extending bore defined in flow block 550. The laterally extending bore intersects and is in fluid communication with the choke gut line defined in flow block 550 via an opening. While the illustrated embodiment shows inner housing 470 as a separate component positioned inside the flow block 550, flow block 550 and the inner housing 470 may be integrally formed as a single component in other embodiments. In the illustrated embodiment, the inner housing 470 has aligned apertures to define a gut line fluid passageway 584. The gut line fluid passageway 584 is substantially aligned with the opening of the laterally extending bore in flow block 550 such that gut line fluid passageway 584 is in fluid communication with the choke gut line.

The choke gut line valve 536*c* further comprises a valve control mechanism. In the illustrated embodiment, the valve control mechanism is a slab gate 448 having an elongated body extending axially in inner housing 470. An opening 458 is defined in the body of the slab gate 448. The actuator 502*c* operates to move the slab gate 448 axially within the inner housing 470 among an open position, a closed position, and any other axial position between the inner surfaces of the flanges 560*c*,564. In some embodiments, a first end 481 of the slab gate 448 is coupled to the actuator 502*c* to allow the actuator 502*c* to exert axial force on the slab gate 448. Alternative configurations and/or forms of the valve control mechanism are possible.

Figure 33A:
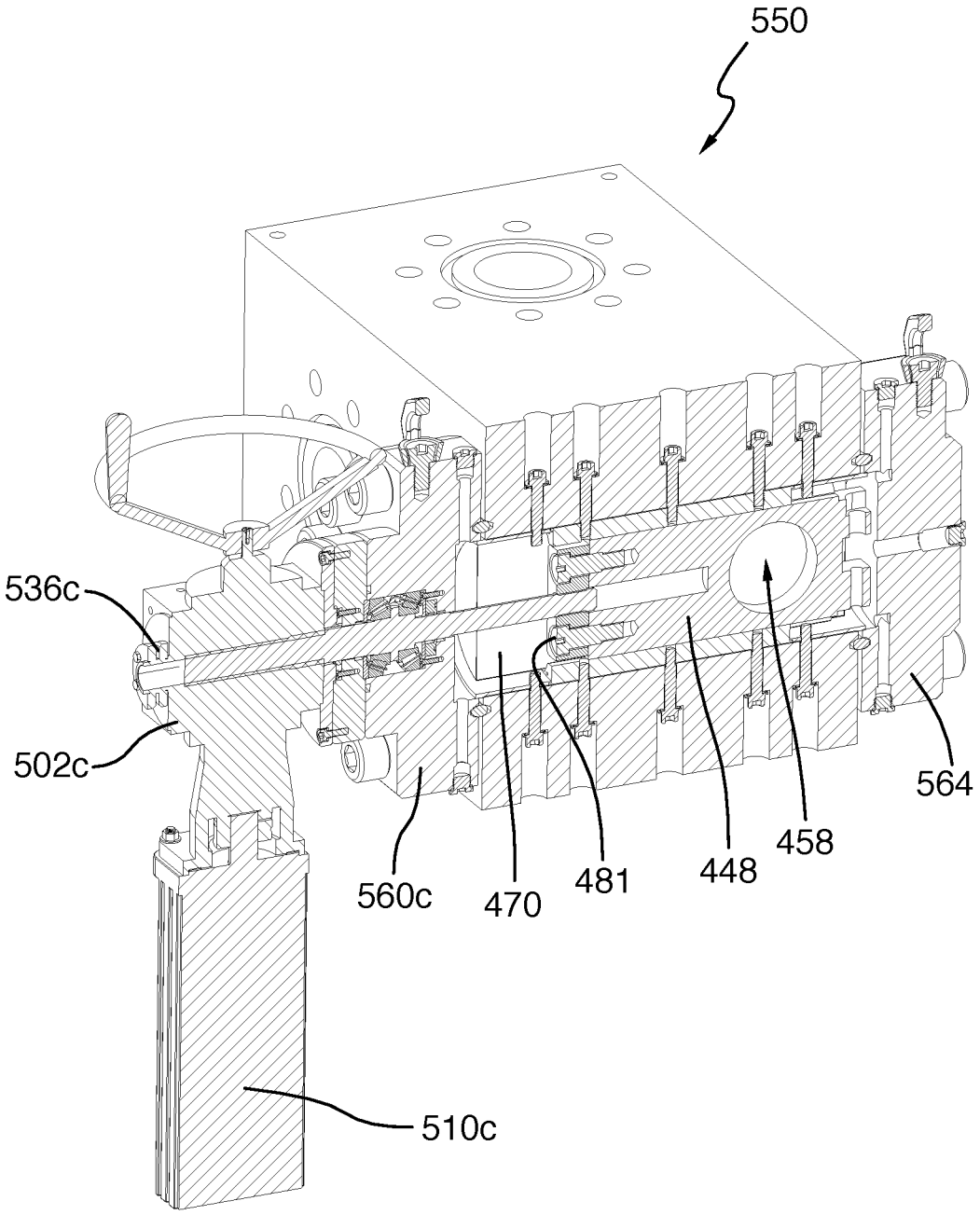
FIGS. 33A and 33B are perspective cross-sectional views of a choke gut line valve of the MPD manifold of FIG. 23, shown in a closed position and an open position, respectively.
Figure 33B:
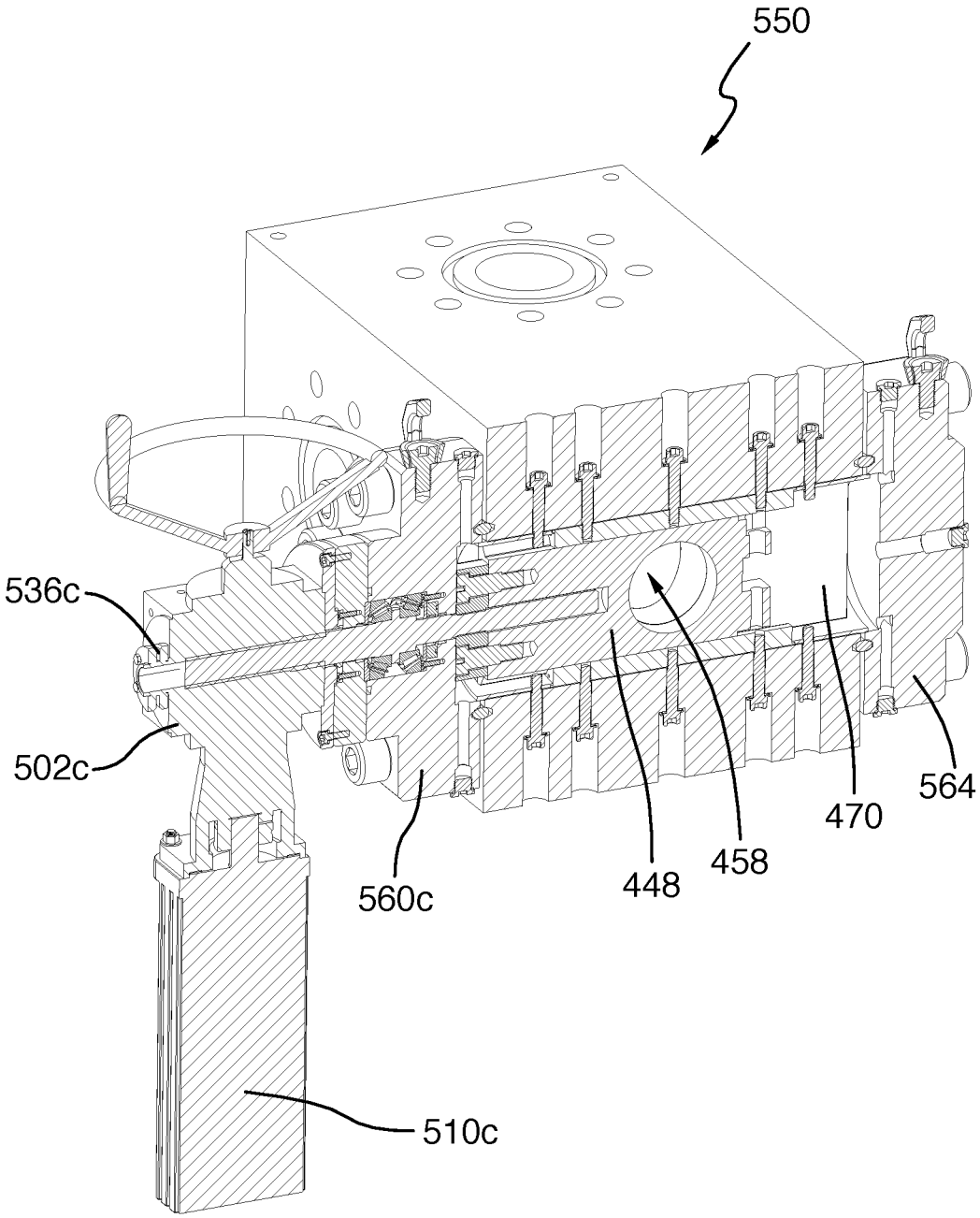

When the actuator 502*c* moves the slab gate 448 to a position where the opening 458 is aligned with the gut line fluid passageway 584, the choke gut line valve 536*c* is in an open position (shown in FIG. 33B). When the actuator 502*c* moves the slab gate 448 to a position where the opening 458 is not aligned with the gut line fluid passageway 584, the choke gut line valve 536*c* is in a closed position (shown in FIG. 33A). When the choke gut line valve 536*c* is in the open position, fluid flow is permitted through passageway 584 via opening 458, which means fluid can enter the flow block 550 via inlet 18 and flow through the choke gut line (via opening 458 and passageway 584) and exit the flow block 550 via outlet 518. When the choke gut line valve 536*c* is in the closed position, fluid flow through passageway 584 is restricted (or at least reduced) so that no or almost no fluid can flow through the choke gut line.

Figure 34:
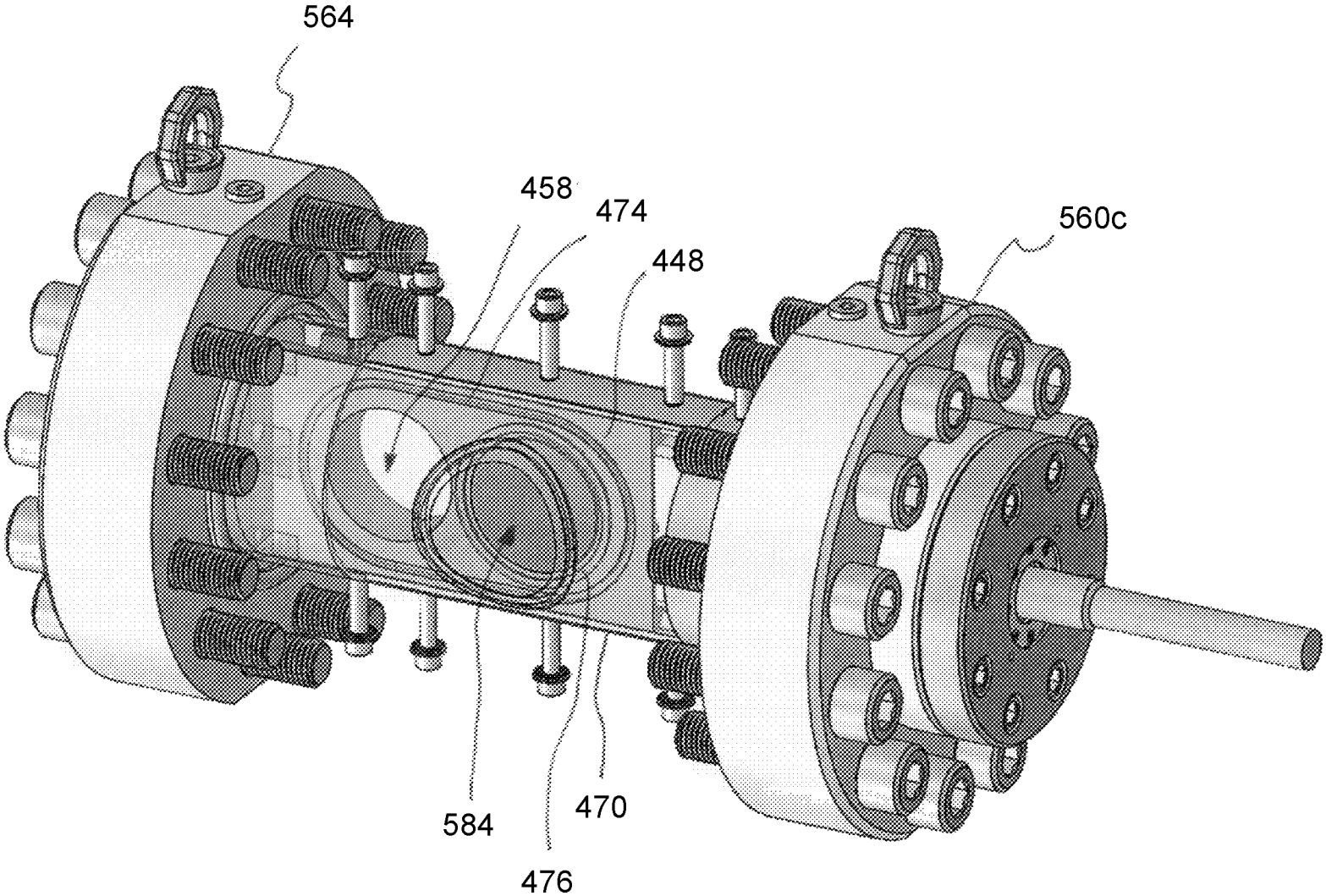
FIG. 34 is a semi-transparent perspective view of the choke gut line valve shown in FIG. 33A.
Figure 35:
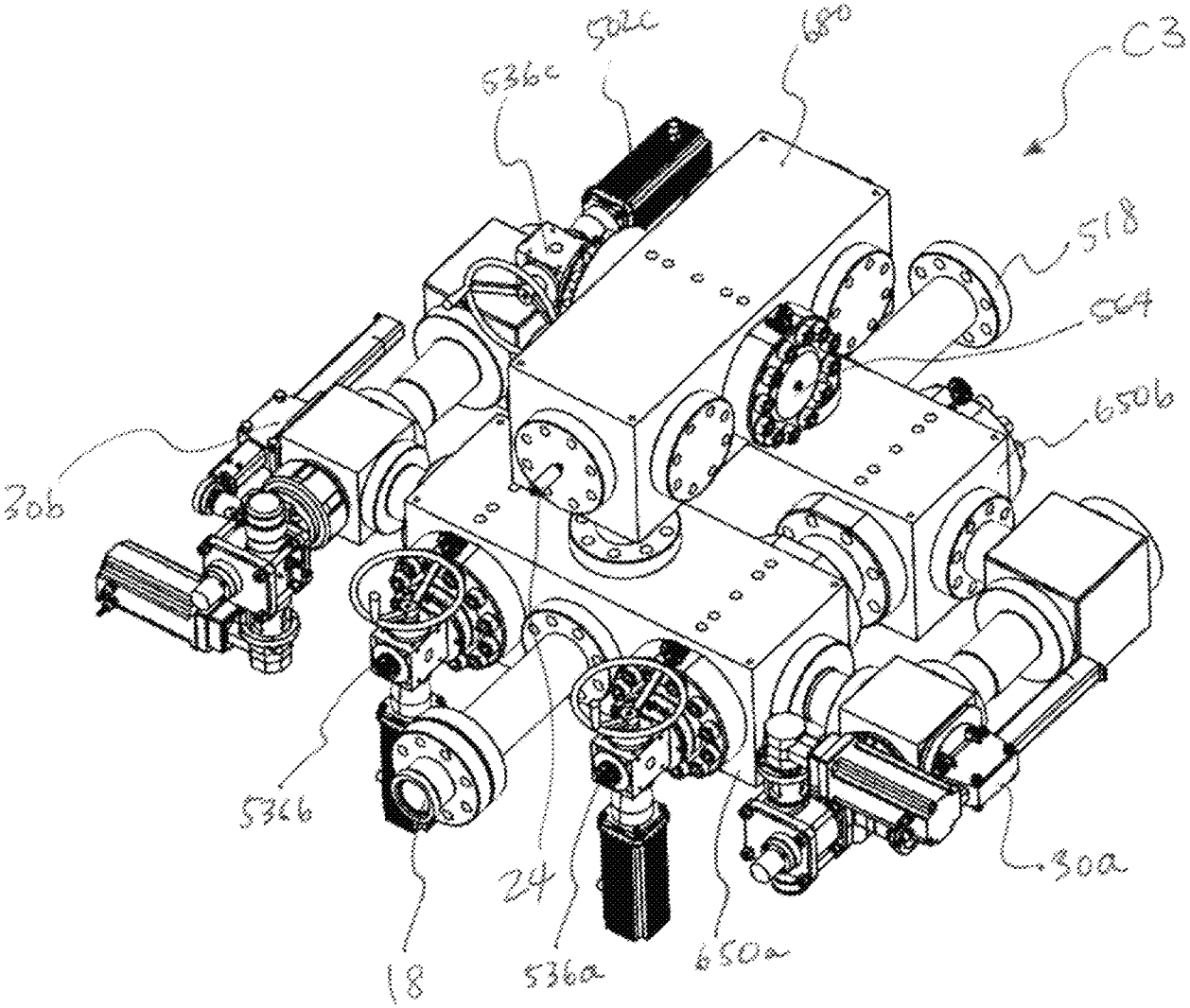
FIG. 35 is a perspective view of a choke section usable in an MPD manifold according to another embodiment of the present disclosure.
Figure 36:
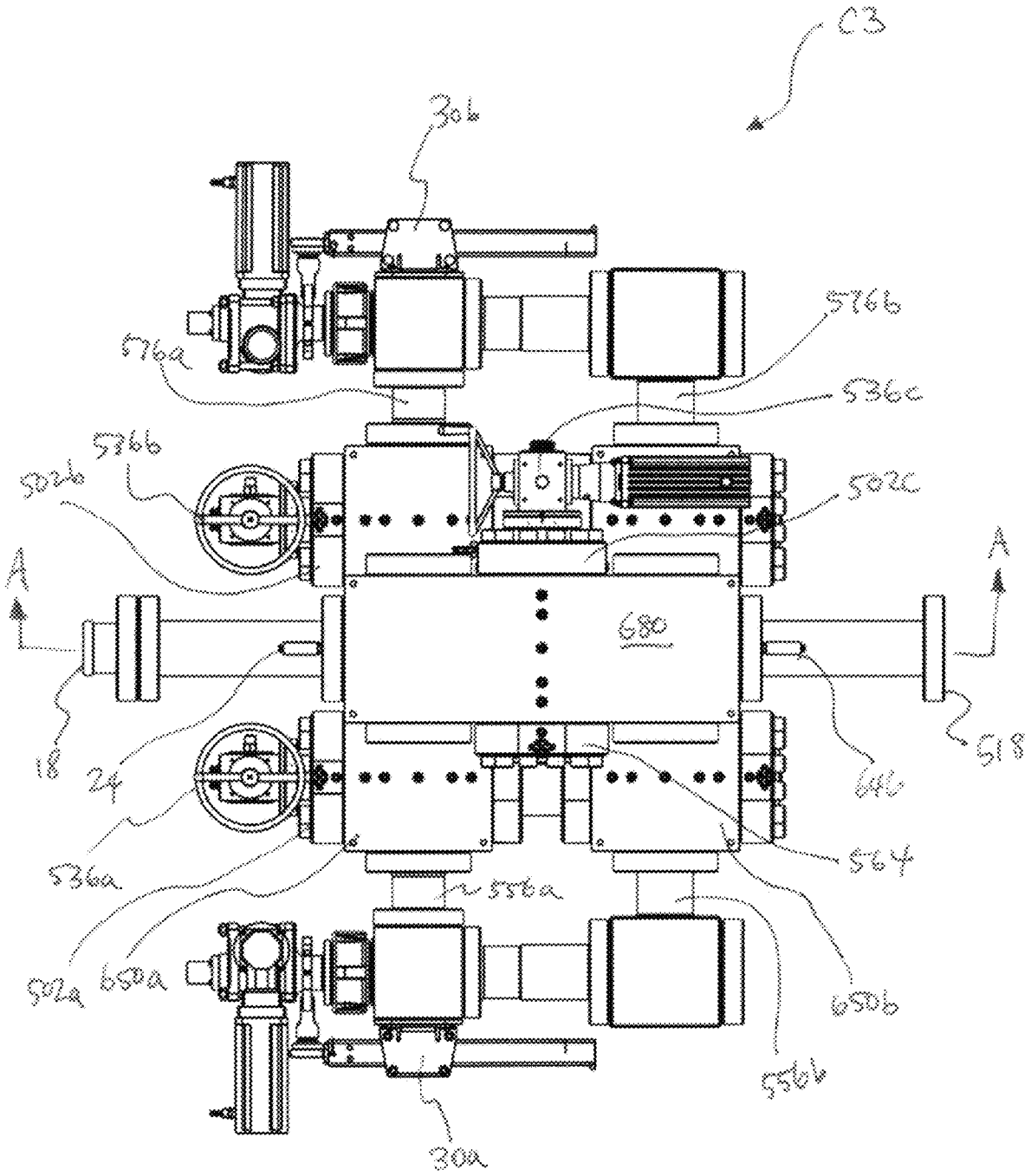
FIG. 36 is a top plan view of the choke section shown in FIG. 35.

With reference to FIG. 34, in some embodiments, slab gate 448 has a seal 474 and the opening 584 has a seal 476 to fluid seal the interface between the slab gate 448 and the inner surface of housing 470. In some embodiments, seals 474,476 operate to isolate fluid flowing through the opening 458 from any lubrication fluid in the valve 536*c*. In some embodiments, seal 474 is an o-ring type seal and seal 476 is a v-lip type seal. As a skilled person in the art can appreciate, other types of seals and configurations are possible. In some embodiments, any of the valves described herein may have the same or similar seals to isolate fluid flowing therethrough from the lubrication fluid in the valve. In some embodiments, any of the valves may include a lubrication fluid pressure sensor for monitoring the pressure of the lubrication fluid inside the valve. Since the seal 474 is for isolating the lubrication fluid from the fluid flowing through the manifold, any increase in pressure detected by the lubrication fluid pressure sensor may be an indication of possible failure of seal 474.

In operation, with reference to FIGS. 23 to 33, fluid enters the manifold 520 at inlet 18 and the pressure of the fluid is measured by pressure sensor 24. If the first choke valve 536*a* is open and the second choke valve 536*b* and the choke gut line valve 536*c* are closed, the fluid exits block 550 via spool 556*a*, enters the first choke 30*a* via passageway 554*a*, flows through the first choke 30*a*, exits the first choke 30*a* via passageway 554*b*, re-enters flow block 550 via spool 556*b*, and then exits flow block 550 via outlet 518. If the second choke valve 536*b* is open and the first choke valve 536*a* and the choke gut line valve 536*c* are closed, the fluid exits block 550 via spool 558*a*, enters the second choke 30*b* via passageway 574*a*, flows through the second choke 30*b*, exits the second choke 30*b* via passageway 574*b*, re-enters flow block 550 via spool 558*b*, and then exits flow block 550 via outlet 518. If the first and second choke valves 536*a*,536*b* are closed and the choke gut line valve 536*c* is open, the fluid flows through flow block 550 via passageway 584, bypassing the first and second chokes, and exits flow block 550 via outlet 518. If both the first and second choke valves 536*a*,536*b* are open and the choke gut line valve 536*c* is closed, the fluid exits block 550 via spools 556*a*,558*a*, enters the first and second chokes 30*a*,30*b* via passageways 554*a*, 574*a*, respectively, flows through the first and second chokes 30*a*,30*b*, exits the first and second chokes 30*a*,30*b* via passageways 554*b*,574*b*, respectively, re-enters flow block 550 via spools 556*b*,558*b*, and then exits flow block 550 via outlet 518.

Fluid exiting outlet 518 enters flow block 580 via spool 566 and inlet 522. If the flowmeter valve 544*a* is open and the flowmeter gut line valve is closed 544*b*, the fluid exits flow block 580 via spool 568*a*, enters the flowmeter via the first passageway of the flowmeter valve 544*a*, spool 570*a*, and flow block 586, flows through the flowmeter, exits the flowmeter via tubing 594, flow block 596, spool 570*b* and the second passageway of the flowmeter valve 544*a*, re-enters flow block 580 via spool 568*b*, and then exits flow block 580 via outlet 22. The pressure of fluid entering the flowmeter 40 is measured by pressure sensor 26 as fluid flows through flow block 586. If the flowmeter valve 544*a* is closed and the flowmeter gut line valve is open, the fluid flows through block 580 via the passageway in the flowmeter gut line valve, bypassing the flowmeter, and exits the flow block 580 via outlet 22.

FIGS. 35 to 43 show another configuration of a choke section, in accordance with the embodiment shown in FIG. 22. In the illustrated embodiment, the choke section C3 comprises pressure sensor 24, first and second chokes 30*a*, 30*b*, first choke valve 536*a*, second choke valve 536*b*, choke gut line valve 536*c*, flow blocks 650*a*,650*b*,680, inlet 18, and outlet 518, all of which are interconnected by various spools.

Figure 43:
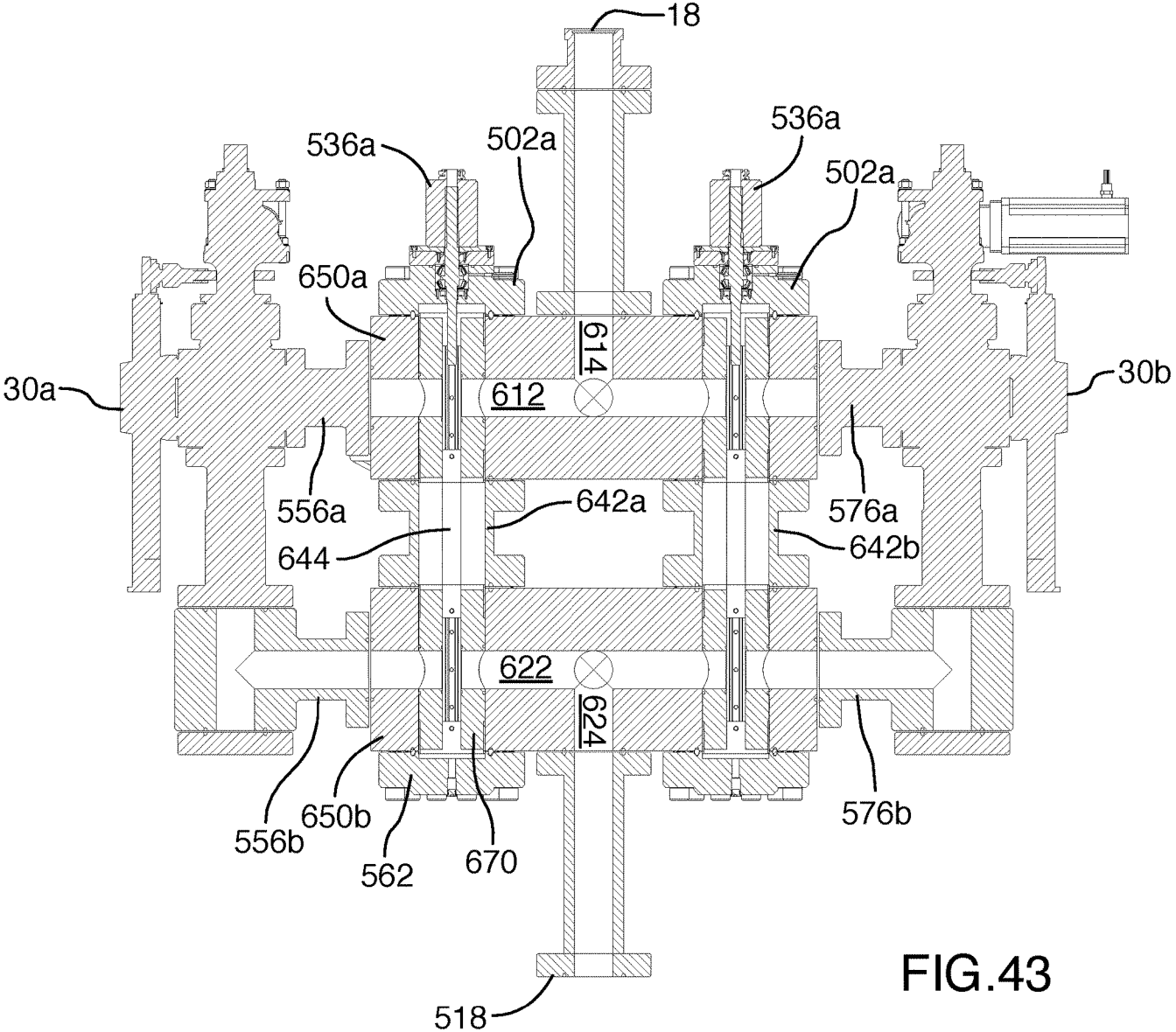
FIG. 43 is a cross-sectional view of the choke section shown in FIG. 38, taken along line B-B.

As best shown in FIGS. 42 and 43, flow block 650*a* has an axial fluid passageway 612 extending between a first end and a second end of the flow block 650*a*. Flow block 650*a* has a first lateral fluid passageway 614 opening to one side and a second lateral fluid passageway 616 opening to another side of the flow block 650*a*. The first and second lateral passageways 614,616 are fluid connected to one another. The first and second lateral passageways 614,616 intersect and are in fluid communication with passageway 612. In some embodiments, inlet 18 is positioned in and/or in fluid communication with the first lateral fluid passageway 614.

Flow block 650*b* has an axial fluid passageway 622 extending between a first end and a second end of the flow block 650*b*. Flow block 650*b* has a first lateral fluid passageway 624 opening to one side and a second lateral fluid passageway 626 opening to another side of the flow block 650*b*. The first and second lateral passageways 624,626 are fluid connected to one another. The first and second lateral passageways 624,626 intersect and are in fluid communication with passageway 622. In some embodiments, outlet 518 is positioned in and/or in fluid communication with the first lateral fluid passageway 624.

The flow block 680 has an axial fluid passageway 632 extending between a first end and a second end of the flow block 680. Flow block 680 has a first lateral fluid passageway 634 and a second later fluid passageway 636 both opening to the same side of the flow block 680 in the illustrated embodiment. The first lateral passageway 634 intersects and is fluidly connected to passageway 632 near the first end of the flow block 680. The second lateral passageway 636 intersects and is fluidly connected to passageway 632 near the second end of the flow block 680. A least a portion of the choke gut line valve 536*c* is positioned in flow block 680 to control the flow of fluid through axial passageway 632.

In some embodiments, the pressure sensor 24 is positioned in flow block 680 such that it is in fluid communication with the first lateral passageway 634. In the illustrated embodiment, the pressure sensor 24 is positioned at the first end of flow block 680, adjacent passageway 634, and it is in fluid communication with axial passageway 632 and passageway 634. In some embodiments, the choke section comprises a third pressure sensor 646. The third pressure sensor 646 is positioned in the flow block 680 such that it is in fluid communication with the second lateral passageway 636. In the illustrated embodiment, the third pressure sensor 646 is positioned at the second end of flow block 680, adjacent passageway 636, and it is in fluid communication with axial passageway 632 and passageway 636. The first sensor 24 can measure the pressure of fluid entering the choke section, before the fluid passes through one or both of the chokes 30*a*,30*b* or the choke gut line. The third sensor 646 can measure the pressure of fluid exiting one or both of the chokes 30*a*,30*b* or the choke gut line.

The flow block 650*a* is coupled to the first choke such that the first end of passageway 612 is in fluid communication with the inlet 556*a* of the first choke 30*a*. The flow block 650*a* is coupled to the second choke such that the second end of passageway 612 is in fluid communication with the inlet 576*a* of the second choke 30*b*. The flow block 650*b* is coupled to the first choke such that the first end of passageway 622 is in fluid communication with the outlet 556*b* of the first choke 30*a*. The flow block 650*b* is coupled to the second choke such that the second end of passageway 622 is in fluid communication with the outlet 576*b* of the second choke 30*b*.

A first portion of the first choke valve 536*a* is positioned in flow block 650*a* to control the flow of fluid at or near a first end of axial passageway 612, adjacent inlet 556*a* of the first choke 30*a*. A second portion of the first choke valve 536*a* is positioned in flow block 650*b* to control the flow of fluid at or near a first end of axial passageway 622, adjacent outlet 556*b* of the first choke 30*a*. A first portion of the second choke valve 536*b* is positioned in flow block 650*a* to control the flow of fluid at or near a second end of axial passageway 612, adjacent inlet 576*a* of the second choke 30*b*. A second portion of the second choke valve 536*b* is positioned in flow block 650*b* to control the flow of fluid at or near a second end of axial passageway 622, adjacent outlet 576*b* of the second choke 30*b*.

In some embodiments, a spool 642*a* is positioned between flow blocks 650*a*,650*b* to house a third portion of the first choke valve 536*a* that connects the first portion with the second portion. In some embodiments, a spool 642*b* is positioned between flow blocks 650*a*,650*b* to house a third portion of the second choke valve 536*b* that connects the first portion with the second portion. In some embodiments, one end of spool 642*a* is coupled to a lateral side of flow block 650*a* and the other end is coupled to a lateral side of flow block 650*b*; and one end of spool 642*b* is coupled to a lateral side of flow block 650*a* and the other end is coupled to a lateral side of flow block 650*b*.

The flow block 650*a* is coupled to the flow block 680, via a spool 640*a* for example, such that lateral passageway 616 is in fluid communication with the lateral passageway 634. The flow block 650*b* is coupled to the flow block 680, via a spool 640*b* for example, such that lateral passageway 626 is in fluid communication with the lateral passageway 636. In the illustrated embodiment, the choke gut line is provided by passageways 616,634,632,636,626. The choke gut line is thus in fluid communication with the inlet 18 via passageway 614 in flow block 650*a* and with the outlet 518 via passageway 624 in flow block 650*b*. In some embodiments, the at least a portion of the choke gut line valve 536*c* is positioned at an axial location of the flow block 680 between the first and second lateral fluid passageways 634,636, to control fluid flow through the choke gut line.

In a sample embodiment, as illustrated in FIGS. 35 to 43, inlet 18 and/or outlet 518 is substantially perpendicular to one or both of spools 640*a*,640*b*. In some embodiments, inlet 18 is positioned adjacent to spool 640*a* and outlet 518 is positioned adjacent spool 640*b*. In some embodiments, spool 640*a* is parallel to spool 640*b*. In some embodiments, inlet 18 and/or outlet 518 is substantially parallel to one or both of spools 642*a*,642*b*. In some embodiments, spool 642*a* is parallel to spool 642*b*. In some embodiments, one or both of spools 640*a*,640*b* are substantially perpendicular to one or both of spools 642*a*,642*b*.

In some embodiments, one or both of passageways 612, 622 are substantially perpendicularly to the inlet 18 and/or outlet 518. Passageway 632 is substantially parallel one or both of inlet 18 and outlet 518. In some embodiments, inlet 18 and outlet 518 are substantially parallel and/or coaxial with one another. In some embodiments, the lengthwise axes of flow blocks 650*a*,650*b* are substantially parallel to one another and the lengthwise axis of flow block 680 is substantially perpendicular to that of one or both of blocks 650*a*,650*b*.

In some embodiments, two or more of flow blocks 650*a*, 650*b*, spools 642*a*,642*b*, the first and second chokes 30*a*, 30*b*, the inlet 18, and the outlet 518 are substantially on the same plane. In some embodiments, the flow block 680 is on a different plane than that of one or more of the other components of the choke section C3.

In some embodiments, each of the first and second choke valves 536*a*,536*b* is actuatable between an open position and a closed position by a respective choke valve actuator 502*a*,502*b*. In the illustrated embodiment, the first and second choke valves 536*a*,536*b* are substantially identical so only the first choke valve will be described in detail.

According to a sample embodiment as best shown in FIG. 43, the first choke valve 536*a* comprises the actuator 502*a*, an end flange 562, an inner housing 670 extending between the actuator 502*a* and the flange 562. In some embodiments, the flange of actuator 502*a* is attached to one lateral side of the flow block 650*a* and flange 562 is attached to a lateral side of flow block 650*b*. In the illustrated embodiment, a first portion of the inner housing 670 is disposed in a laterally extending bore defined in flow block 650*a* and a second portion of the inner housing 670 is disposed in a laterally extending bore defined in flow block 650*b*. The laterally extending bores in flow blocks 650*a*,650*b* each intersect and is in fluid communication with passageways 612,622, respectively, near the first ends of the passageways 612,622. While the illustrated embodiment shows the first and second portions of the inner housing 670 as being separate components, the inner housing comprise a single piece of material extending through both flow blocks 650*a*,650*b* in other embodiments. While inner housing 670 is shown as a separate component positioned inside the flow blocks 650*a*, 650*b*, one or both of the flow blocks 650*a*,650*b* and the inner housing 670 may be integrally formed as a single component in other embodiments. In the illustrated embodiment, the inner housing 670 has aligned apertures to define an inlet passageway in the first portion (adjacent the inlet 556*a* of the first choke 30*a*) and an outlet passageway in the second portion (adjacent the outlet 556*b* of the first choke 30*a*). The inlet passageway is in fluid communication with passageway 612 of flow block 650*a* and the outlet passageway is in fluid communication with passageway 622 of flow block 650*b*.

The first choke valve 536*a* further comprises a valve control mechanism. In the illustrated embodiment, with specific reference to FIG. 43, the valve control mechanism is a slab gate 644 having an elongated body extending axially in inner housing 670, through the inside of spool 642*a*, and extending laterally relative to flow blocks 650*a*, 650*b*, adjacent the first ends of the flow blocks. An inlet opening (adjacent the first portion of inner housing 670) and an outlet opening (adjacent the second portion of inner housing 670) are defined in the body of the slab gate 644. The actuator 502*a* operates to move the slab gate 644 axially within the inner housing 670 and spool 642*a* among an open position, a closed position, and any other axial position between the inner surfaces of actuator 502*a* and flange 562. In some embodiments, a first end of the slab gate 644 is coupled to the actuator 502*a* to allow the actuator 502*a* to exert axial force on the slab gate 644. Alternative configurations and/or forms of the valve control mechanism are possible.

The inlet and outlet openings of slab gate 644 are spaced apart and positioned relative to the inlet and outlet passageways of inner housing 670 such that when the inlet opening is aligned with the inlet passageway, the outlet opening is also aligned with the outlet passageway, and vice versa. Further, when the inlet opening of slab gate 644 is not aligned with the inlet passageway of inner housing 670, the outlet opening is also not aligned with the outlet passageway, and vice versa. When the inlet and outlet openings are aligned with the inlet and outlet passageway, respectively, the first choke valve 536*a* is in the open position, wherein fluid flow is permitted through inlet and outlet passageways, which means fluid can enter the first choke 30*a* via passageway 612 and the inlet passageway, and then flow through the first choke 30*a*, and then exit via the outlet passageway and passageway 622. When the inlet and outlet passageways of inner housing 670 are blocked by the body of the slab gate 644, as shown in FIG. 43, the first choke valve 536*a* is in the closed position, wherein fluid flow through the inlet and outlet passageways is restricted (or at least reduced) so that no (or almost no) fluid can flow through the first choke 30*a*.

In some embodiments, spool 642*a* is configured to house a portion of the slab gate 644 that is between the inlet opening and the outlet opening. In some embodiments, the interface between flow block 650*a* and spool 642*a* and the interface between flow block 650*b* and spool 642*a* are fluidly sealed to protect the slab gate 644 and to retain any lubrication fluid in the first choke valve 536*a*.

The flow of fluid through the choke gut line is controlled by the choke gut line valve 536*c*. With reference to FIG. 42, the choke gut line valve 536*c*, which is partially disposed in flow block 680, comprises an actuator 502*c*. The choke gut line valve 536*c* also has an end flange 564 and an inner housing 672 extending between the actuator 502*c* and flange 564.

In some embodiments, actuator 502*c* is attached to a first lateral side of the flow block 680 and flange 564 is attached to a second lateral side, opposite the first lateral side, of the flow block 580. In the illustrated embodiment, the inner housing 672 is disposed in a laterally extending bore defined in flow block 680. The laterally extending bore intersects and is in fluid communication with passageway 632 of the choke gut line. While the illustrated embodiment shows inner housing 672 as a separate component positioned inside the flow block 680, flow block 680 and the inner housing 672 may be integrally formed as a single component in other embodiments. In the illustrated embodiment, the inner housing 672 has aligned apertures to define a gut line fluid passageway. The gut line fluid passageway is positioned in the intersection between the laterally extending bore and the passageway 632 so that the gut line fluid passageway is in fluid communication with passageway 632 of the choke gut line.

The choke gut line valve 536*c* further comprises a valve control mechanism. In the illustrated embodiment, the valve control mechanism is a slab gate 674 having an elongated body extending axially in inner housing 672. A gut line opening is defined in the body of the slab gate 674. The actuator 502*c* operates to move the slab gate 674 axially within the inner housing 672 among an open position, a closed position, and any other axial position between the actuator 502*c* and flange 564. In some embodiments, a first end of the slab gate 674 is coupled to the actuator 502*c* to allow the actuator 502*c* to exert axial force on the slab gate 674. Alternative configurations and/or forms of the valve control mechanism are possible.

When the actuator 502*c* moves the slab gate 674 to a position where the gut line opening is aligned with the gut line fluid passageway, the choke gut line valve 536*c* is in an open position (shown in FIG. 42). When the actuator 502*c* moves the slab gate 674 to a position where the gut line opening is not aligned with the gut line fluid passageway, the choke gut line valve 536*c* is in a closed position. When the choke gut line valve 536*c* is in the open position, fluid flow is permitted through the gut line fluid passageway via the gut line opening, which means fluid can enter the flow block 680 via passageway 634 and flow through passageway 632 and exit the flow block 680 via passageway 636. When the choke gut line valve 536*c* is in the closed position, fluid flow through passageway 632 and the gut line fluid passageway is restricted (or at least reduced) so that no (or almost no) fluid can flow through the choke gut line.

In operation, with reference to FIGS. 35 to 43, fluid enters the choke section C3 at inlet 18 and fills passageways 614,616 of flow block 650*a*, spool 640*a*, and passageway 634 of flow block 680 to reach the pressure sensor 24. If the first choke valve 536*a* is open and the second choke valve 536*b* and the choke gut line valve 536*c* are closed, the fluid flows through passageway 612 of flow block 650*a* via the inlet passageway of the inner housing 670 of the first choke valve 536*a*, enters the first choke 30*a* via inlet 556*a*, flows through the first choke 30*a*, exits the first choke 30*a* via outlet 556*b*, enters flow block 650*b* via passageway 622 and the outlet passageway of the first choke valve 536*a*, and then exits flow block 650*b* via passageway 624 and outlet 518. If the second choke valve 536*b* is open and the first choke valve 536*a* and the choke gut line valve 536*c* are closed, the fluid flows through passageway 612 of flow block 650*a* via the inlet passageway of the inner housing of the second choke valve 536*b*, enters the second choke 30*b* via inlet 576*a*, flows through the second choke 30*b*, exits the second choke 30*b* via outlet 576*b*, enters flow block 650*b* via passageway 622 and the outlet passageway of the second choke valve 536*b*, and then exits flow block 650*b* via passageway 624 and outlet 518. If the first and second choke valves 536*a*,536*b* are closed and the choke gut line valve 536*c* is open, the fluid flows through passageways 614,616 of flow block 650*a*, spool 640*a*, passageways 634,632,636 of flow block 680, spool 640*b*, and passageways 626,624 of flow block 650*b* and exits at outlet 518, thereby bypassing the first and second chokes. If both the first and second choke valves 536*a*,536*b* are open and the choke gut line valve 536*c* is closed, the fluid enters and flows through both chokes 30*a*,30*b* as described above, and then exits the choke section C3 via outlet 518. Any fluid exiting the choke section C3 also fills passageway 636 of flow block 680, spool 640*b*, and passageways 626,624 of flow block 650*b* such that the pressure of the fluid exiting the choke section can be measured by the third pressure sensor 646.

In some embodiments, the valve control mechanism of the first and second choke valves 536*a*,536*b* and choke gut line valve 536*c* are controlled by separate actuators 502*a*, 502*b*,502*c* such that the first and second choke valves and the choke gut line valve operate independently. In other embodiments, two or more of the first and second choke valves 536*a*,536*b* and the choke gut line valve 536*c* are configured to operate together such that the respective slab valve mechanisms move in a synchronized manner, such that as one valve closes, at least another valve is opening at the same time. In some embodiments, per the configurations shown in FIGS. 22 to 43, the first and second choke valves 536*a*,536*b*, if desired, may both be open at the same time to allow both the first and second chokes 30*a*,30*b* to operate simultaneously in parallel to maintain the wellbore pressure.

As can be appreciated, any of the above-described MPD manifolds can be modified to include additional chokes and/or flowmeters. For example, with reference to FIGS. 24 and 25, manifold 520 can be modified to include a third choke by connecting the third choke to flow block 550 via a third choke valve, wherein the third choke valve has a similar configuration as the first and second choke valves 536*a*,536*b*. In another example, a second flowmeter may be added to manifold 520 by connecting a second flowmeter to flow block 580 via a second flowmeter valve, wherein the second flowmeter valve has a similar configuration as the flowmeter valve 544*a*.

In some embodiments, the MPD manifold may include one or more manual contingency valves, in addition to the choke section valve assembly and the flowmeter section valve assembly. The one or more manual contingency valves can be place at the inlet and/or outlet of one or more of the chokes, the choke gut line, the flowmeter, and the flowmeter gut line. In some embodiments, the manual contingency valves can be manually actuated to close one or more fluid passageways in the manifold in the case of a power outage.

In some embodiments, the MPD manifold is in communication with a control unit. The control unit is configured to monitor pressure data collected by the one or more pressure sensors in real-time and to control the one or more actuators of the manifold. Based on the pressure data from the one or more pressure sensors, the control unit can predict pressures in the near future in order to anticipate increases above the safety threshold of one or more components (e.g. drilling chokes and flowmeters) of the manifold. By predicting further pressures, the control unit may provide early detection of potential choke failure and/or flowmeter failure and may thus have sufficient time to actuate and change the position of one or more of block valves 132,136,142 to redirect fluid flow within the manifold to avoid choke and/or flowmeter failure. In some embodiments, if the control unit detects any washed out choke components and/or potential clogging of a choke or a flowmeter, the control unit may provide an alert to a human operator to indicate that inspection and/or maintenance of the particular choke or flowmeter is required. The alert may be, for example, an electronic message to the operator via a display and/or an audio alarm or visual indicator in the manifold.

For example, the at least one second pressure sensor 26 may provide data to the control unit for monitoring pressure variations and predicting potential clogging of the flowmeter 40 before the fluid pressure reaches the maximum operating pressure of the flowmeter. This configuration may be beneficial as flowmeters generally have a low operating pressure and can burst quickly if clogged. If the control unit predicts potential clogging of the flowmeter 40, the control unit controls at least one of the actuators to actuate the valve control mechanism of block valve 142 to transition the block valve 142 from the first position to the second position, thereby diverting fluid to the flowmeter gut line 44 to bypass the flowmeter 40. The control unit may also provide the alert to the operator to indicate that the flowmeter 40 requires inspection and/or maintenance.

In this manner, the manifold of the present disclosure, together with the control unit, may be used to predict and reduce the frequency of or prevent well kicks during drilling operations by analyzing the fluid flow characteristics measured upstream and downstream of the well. The manifold of the present disclosure (including any of the actuators therein) may be fully automated and/or may be controlled remotely by the control unit. As such, the manifold may provide fast and precise execution of fluid rerouting sequences with reduced or minimal human intervention as compared to conventional MPD manifolds (e.g. the prior art manifold 10). The manifold disclosed herein may be useful for unmanned wells and/or offshore rigs where prompt operator access to the manifold is unavailable or restricted.

In some embodiments, the manifold of the present disclosure may operate with the control unit and the control unit has a processor and a non-transitory computer readable medium operably coupled thereto; a plurality of instructions, such as control logic software, may be stored on the non-transitory computer readable medium, and the instructions are accessible to, and executable by, the processor. In some embodiments, the control unit is in communication with one of more of drilling chokes 30*a*,30*b*, flowmeter 40, any of the abovementioned valves, pressure sensors 24,26,646, and any other component of the manifold. In some embodiments, the control unit may communicate control signals to the drilling chokes 30*a*30*b*, based on measurement data received from the pressure sensor 24. In a sample embodiment, the control unit may communicate control signals to the actuator 202 of the first block valve 132, based on measurement data received from the pressure sensor 24. In another sample embodiment, the control unit may communicate control signals to the actuator 302 of the third block valve 142, based on measurement data received from the pressure sensor 26. In some embodiments, the control unit is also in communication with one or more other sensors associated with the drilling system such as, for example, one or more sensors associated with the drilling tool, the wellhead, the blowout preventor, the rotating control device, the mud gas separator, the flare, the shaker, and/or the mud pump; therefore, the control unit may communicate control signals to the drilling chokes 30*a*,30*b* based on measurement data received from the one or more sensors.

Figure 44:
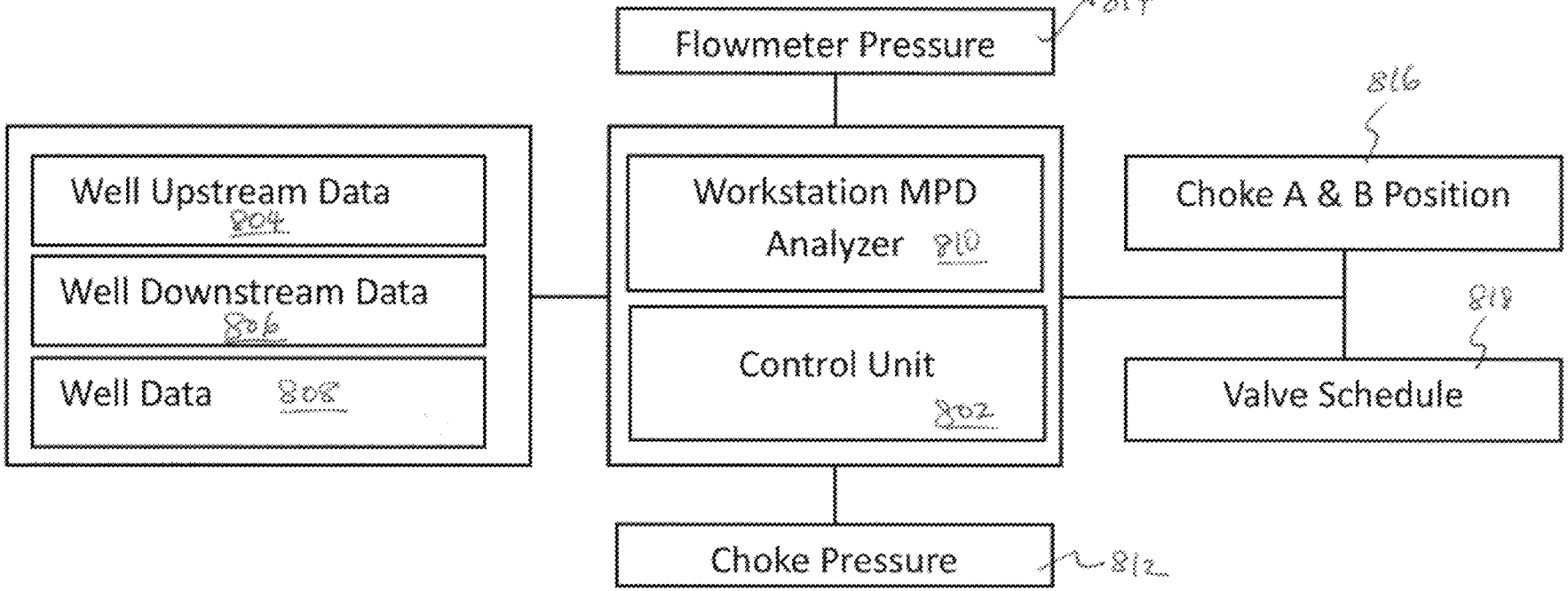
FIG. 44 is a diagrammatic illustration of the operation of a control unit according to one embodiment of the present disclosure.

With reference to FIG. 44, a sample control unit 802 can work with a workstation MPD analyzer 810 to operate and control the MPD manifold. In general, the control unit 802 can collect data and control the components of the MPD manifold, while the workstation MPD analyzer 810 is configured to analyze data, provide a user interface for the operator, and/or record and monitor operational parameters of the manifold.

According to one embodiment, the control unit 802 is configured to collect data relating to the wellbore, which may comprise well upstream data 804, well downstream data 806, and/or well data 808. Well upstream data 804 may include one or more of fluid density, fluid rheology, fluid temperature, flow rate, and pressure of the drilling fluid, all measured upstream of the well. Well downstream data 806 may include one or more of: fluid density, fluid rheology, fluid temperature, flow rate, and pressure of the drilling fluid, all measured by one or more sensors (for example, sensors 24,26,646) and/or the flowmeter. Well data may include one or more of: bit depth, maximum casing shoe pressure, fracture pressure, well collapse pressure, pore pressure, well geometry, drill string and BHA information, drill bit information, rate of penetration, rock density, rotary speed, and surface facilities pressure rating.

The control unit 802 can also collect data on choke pressure 812 and flowmeter pressure 814. The choke pressure 812 may include real-time measurements of the pressure of fluid entering one or both of the chokes, for example as determined by pressure sensor 24. The choke pressure 812 may also include real-time measurements of the pressure of fluid exiting one or both of the chokes, for example as determined by pressure sensor 646. The flowmeter pressure 814 may include real-time measurements of the pressure of fluid entering the flowmeter, for example as determined by pressure sensor 26.

The control unit 802 may also collect choke position data 816 on the real-time position of the first and second chokes. The control unit 802 may further collect valve position data on the real-time position of any of the valves in the manifold.

The workstation MPD analyzer 810 can receive the collected data from the control unit 802. Further, mud properties and well characteristics can be provided to the workstation MPD analyzer. The workstation MPD analyzer is configured to analyze all the data, generate a result, send the result to the control unit. The control unit can, based on the result, generate commands for the actuators to help the manifold maintain certain conditions such as fluid flow routes, well head pressure, and/or response to failure events.

In some embodiments, the control unit 802 is operable according to a valve schedule 818 based on the result the control unit receives from the workstation MPD analyzer. For example, based on the result the control unit receives, if it is determined that the first choke is defective, the control unit may automatically change the position of (or open or close) one or more valves according to the valve schedule. For manifold 20 shown in FIG. 2, a sample valve schedule is shown in the tables below:

Valve Schedule of Choke Section C2 of Manifold 20

| First Choke Status | Second Choke Status | First Block Valve 132 | Second Block Valve 136 |
|---|---|---|---|
| In operation (not defective) | On standby | First position | First position |
| On standby | In operation (not defective) | Second position | Second position |
| Defective (or checkup) | In operation (not defective) | Second position | Second position |
| In operation (not defective) | Defective (or checkup) | First position | First position |
| Defective (or checkup) | Defective (or checkup) | Third position | Third position |
| On standby | On standby | Third position | Third position |

Valve Schedule of Flowmeter Section F2 of Manifold 20

| Flowmeter Status | Third Block Valve 142 |
|---|---|
| In operation (not defective) | First position |
| Defective (or checkup) | Second position |

For manifold 420 shown in FIG. 22, a sample valve schedule is shown in the tables below:

Valve Schedule of Choke Section C3 of Manifold 420

| First Choke Status | Second Choke Status | First Choke Valve 536a | Second Choke Valve 536b | Choke Gut Line Valve 536c |
|---|---|---|---|---|
| In operation (not defective) | On standby | Open | Open or Closed | Closed |
| On standby | In operation (not defective) | Open or Closed | Open | Closed |
| Defective (or checkup) | In operation (not defective) | Closed | Open | Closed |
| In operation (not defective) | Defective (or checkup) | Open | Closed | Closed |
| In operation (not defective) | In operation (not defective) | Open | Open | Closed |
| Defective (or checkup) | Defective (or checkup) | Closed | Closed | Open |
| On standby | On standby | Closed | Closed | Open |

Valve Schedule of Flowmeter Section F3 of Manifold 420

| Flowmeter Status | Flowmeter Valve 544a | Flowmeter Gut Line Valve 544b |
|---|---|---|
| In operation (not defective) | Open | Closed |
| Defective (or checkup) | Closed | Open |

In some embodiments, a plurality of instructions, or computer program(s), are stored on a non-transitory computer readable medium, the instructions or computer program(s) being accessible to, and executable by, one or more processors. In some embodiments, the one or more processors execute the plurality of instructions (or computer program(s)) to operate in whole or in part the above-described illustrative embodiments. In some embodiments, the one or more processors are part of the control unit 802 and/or the workstation MPD analyzer 810, one or more other computing devices, or any combination thereof. In some embodiments, the non-transitory computer readable medium is part of the control unit 802 and/or the workstation MPD analyzer 810, one or more other computing devices, or any combination thereof.

In some embodiments, each of the one or more computing devices may include a microprocessor, an input device, a storage device, a video controller, a system memory, a display, and a communication device all interconnected by one or more buses. In some embodiments, the storage device may include a floppy drive, hard drive, CD-ROM, optical drive, any other form of storage device and/or any combination thereof. In some embodiments, the storage device may include, and/or be capable of receiving, a floppy disk, CD-ROM, DVD-ROM, or any other form of computer-readable medium that may contain executable instructions. In some embodiments, the communication device may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

In some embodiments, one or more of the components of the above-described illustrative embodiments include at least the computing device and/or components thereof, and/or one or more computing devices that are substantially similar to the computing device and/or components thereof. In some embodiments, one or more of the above-described components of the computing device include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an illustrative embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more illustrative embodiments of the present disclosure may be embodied in the RAM of a computer to transform a standard computer into a new specific computing machine. In some embodiments, data structures are defined organizations of data that may enable an embodiment of the present disclosure. In an illustrative embodiment, a data structure may provide an organization of data, or an organization of executable code.

In some embodiments, any networks and/or one or more portions thereof, may be designed to work on any specific architecture. In an illustrative embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an illustrative embodiment, the data contained in the location of a character file can be mapped to a field in a second table. In some embodiments, the physical location of the database is not limiting, and the database may be distributed. In an illustrative embodiment, the database may exist remotely from the server, and run on a separate platform. In an illustrative embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described illustrative embodiments of the drilling system, the MPD manifold 20,120, the related methods, and/or any combination thereof. In some embodiments, such a processor may include one or more of the microprocessor, the processor, and/or any combination thereof, and such a non-transitory computer readable medium may include the computer readable medium and/or may be distributed among one or more components of the drilling system and/or the MPD manifold 20,120. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

Accordingly, in some embodiments, the MPD manifold of the present disclosure comprises one or more multi-passageway valves that can be actuated synchronously to allow fluid to flow within the manifold according to the well drilling conditions and operational status of the chokes and flowmeters in the manifold. The one or more valves may comprise a seal to isolate the lubrication fluid in the valve from the drilling fluid flowing through the manifold. The one or more valves may comprise a sensor to detect failure of the seal.

In some embodiments, the manifold of present disclosure may comprise sensors to allow determination of the valve positions in real-time. The sensors may be positioned on the valve actuators, the valve control mechanism, and/or, if hydraulic assemblies are used, any moving component of the hydraulic assemblies.

In some embodiments, the manifold of present disclosure allows the transition of valve positions, for example, to switch between chokes, between a choke and the choke gut line, between flowmeters, or between a flowmeter and the flowmeter gut line, to occur smoothly, rapidly, and remotely without fully blocking fluid flow in the manifold.

In some embodiments, the manifold of present disclosure may be operated by a control in cooperation with a workstation MPD analyzer. The control unit collects data and sends the data to the workstation MPD analyzer for analysis. The analyzer then sends the analysis result to the control unit and the control unit controls the manifold components, for example the valves and chokes, based on the analysis result.

In some embodiments, the manifold of present disclosure includes a pressure sensor to monitor the pressure of fluid entering the flowmeter to allow the fluid to be promptly re-routed to bypass the flowmeter via the flowmeter gut line if potential over-pressurization of the flowmeter is detected.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A manifold for use in a managed pressured drilling operation, the manifold comprising:

one or more housings;

a first passageway and a second passageway defined in the one or more housings;

a first valve assembly comprising:

a first valve control mechanism in communication with the first and second passageways, the first valve control mechanism movable to synchronously open and/or close the first and second passageways; and a first actuator operably coupled to the first valve control mechanism for actuating the first valve control mechanism to transition the first valve assembly between a first position and a second position, wherein one of:

(i) in the first position, the first passageway is open and the second passageway is closed; and in the second position, the first passageway is closed and the second passageway is open; and (ii) in the first position, the first and second passageways are open; and in the second position, the first and second passageways are closed;

a third passageway defined in the one or more housings, wherein the first valve control mechanism is in communication with the third passageway, the first valve control mechanism movable to synchronously open and/or close the first, second, and third passageways;

the first actuator is operable to actuate the first valve control mechanism to transition the first valve assembly between the first position, the second position, and a third position; and one of:

(i) in the first position, the first passageway is open, and the second and third passageways are closed; in the second position, the first and third passageways are closed, and the second passageway is open; and in the third position, the first and second passageways are closed, and the third passageways is open;

(ii) in the first position, the first and third passageways are open, and the second passageway is closed; in the second position, the first passageway is closed, and the second and third passageways are open; and in the third position, the first and second passageways are open, and the third passageway is closed; and (iii) in the first position, the first and third passageways are open, and the second passageway is closed; in the second position, the first and third passageways are closed, and the second passageway is open; and the third position is the same as the second position;

a fourth passageway and a fifth passageway defined in the one or more housings; and a second valve assembly comprising:

a second valve control mechanism in communication with the fourth and fifth passageways, the second valve control mechanism movable to synchronously open and/or close the fourth and fifth passageways; and a second actuator operably coupled to the second valve control mechanism for actuating the second valve control mechanism to transition the second valve assembly between a fourth position and a fifth position, wherein the second actuator is one and the same as the first actuator;

one of:

(i) in the fourth position, the fourth passageway is open and the fifth passageway is closed; and in the fifth position, the fourth passageway is closed and the fifth passageway is open; and (ii) in the fourth position, the fourth and fifth passageways are open; and in the fifth position, the fourth and fifth passageways are closed;

and wherein one or more of:

the first and second actuators are one and the same; and the first actuator and the second actuator are configured to simultaneously actuate the first and second valve control mechanisms, respectively, and the first and second actuators are synchronized mechanically, electrically, hydraulically, pneumatically, or a combination thereof, such that:

when the first and second passageways are open, the fourth and fifth passageways are closed; and when the first and second passageways are closed, the fourth and fifth passageways are open.

2. The manifold of claim 1, wherein actuating the first valve control mechanism comprises moving the first valve control mechanism axially and/or rotationally.

3. The manifold of claim 1, wherein the first valve control mechanism comprises a gate valve.

4. The manifold of claim 1, wherein the first, second, and third passageways are defined in one of the one or more housings.

5. The manifold of claim 1, wherein the first valve control mechanism is hydraulically synchronized with the second valve control mechanism such that when the first valve assembly is in the first and second positions, the second valve assembly is in the fourth and fifth positions, respectively.

6. The manifold of claim 1 comprising:

a sixth passageway defined in the one or more housings; and a third valve assembly comprising:

a third valve control mechanism in communication with the sixth passageway, the third valve control mechanism movable to open and close the sixth passageway; and a third actuator operably coupled to the third valve control mechanism for actuating the third valve control mechanism to transition the third valve assembly between a sixth position and a seventh position, wherein in the sixth position, the sixth passageway is open; and in the seventh position, the sixth passageway is closed.

7. The manifold of claim 6, wherein the third actuator is one and the same as the first actuator.

8. The manifold of claim 6, wherein the first actuator and the third actuator are configured to simultaneously actuate the first and third valve control mechanisms, respectively, and the first and third actuators are synchronized mechanically, electrically, hydraulically, pneumatically, or a combination thereof, such that:

when the first and second passageways are open, the sixth passageway is closed; and when the first and second passageways are closed, the sixth passageway is open.

9. The manifold of claim 1 comprising:

an inlet; and a drilling choke, wherein the first and second passageways are in communication with the inlet; and one of the first and second passageways is in communication with the drilling choke.

10. The manifold of claim 1 comprising:

an inlet; and a drilling choke, wherein the first passageway is in communication with the inlet; and the first and second passageways are in communication with the drilling choke.

11. The manifold of claim 10 comprising:

a sixth passageway defined in the one or more housings, the sixth passageway being in communication with the inlet; and a third valve assembly comprising:

a third valve control mechanism in communication with the sixth passageway, the third valve control mechanism movable to open and close the sixth passageway; and a third actuator operably coupled to the third valve control mechanism for actuating the third valve control mechanism to transition the third valve assembly between a sixth position and a seventh position, wherein in the sixth position, the sixth passageway is open; and in the seventh position, the sixth passageway is closed.

12. The manifold of claim 1 comprising:

an outlet; and a flowmeter, wherein the first passageway is in communication with the flowmeter; and the first and second passageways are in communication with the outlet.

13. The manifold of claim 1 comprising:

an outlet; and a flowmeter, wherein the first and second passageways are in communication with the flowmeter; and the second passageway is in communication with the outlet.

14. The manifold of claim 13 comprising:

a sixth passageway defined in the one or more housings, the sixth passageway being in communication with the outlet; and a third valve assembly comprising:

a third valve control mechanism in communication with the sixth passageway, the third valve control mechanism movable to open and close the sixth passageway; and a third actuator operably coupled to the third valve control mechanism for actuating the third valve control mechanism to transition the third valve assembly between a sixth position and a seventh position, wherein in the sixth position, the sixth passageway is open; and in the seventh position, the sixth passageway is closed.

15. The manifold of claim 1, wherein the first actuator is remotely controlled.

16. The manifold of claim 1, wherein the first actuator is a hydraulic actuator, an electrical actuator, a pneumatic actuator, or a combination thereof.

* * * * *